US007588463B2

(12) United States Patent
Yamada et al.

(10) Patent No.: US 7,588,463 B2
(45) Date of Patent: Sep. 15, 2009

(54) CONNECTOR AND METHOD OF PRODUCING THE SAME

(75) Inventors: Shinji Yamada, Kanagawa (JP); Naoki Takahashi, Kanagawa (JP); Noriyuki Akai, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 12/108,980

(22) Filed: Apr. 24, 2008

(65) Prior Publication Data

US 2008/0268708 A1 Oct. 30, 2008

(30) Foreign Application Priority Data

Apr. 26, 2007 (JP) ..... 2007-117407
Dec. 14, 2007 (JP) ..... 2007-323626

(51) Int. Cl.
*H01R 13/648* (2006.01)

(52) U.S. Cl. ..... 439/608; 439/108; 439/701

(58) Field of Classification Search ..... 439/608, 439/108, 701
See application file for complete search history.

(56) References Cited

U.S. PATENT DOCUMENTS 6,843,687 B2 * 1/2005 McGowan et al. ..... 439/608
7,387,535 B2 * 6/2008 Minich ..... 439/608

* cited by examiner

*Primary Examiner*—Tho D Ta
(74) *Attorney, Agent, or Firm*—McCormick, Paulding & Huber LLP

(57) ABSTRACT

A receptacle includes contact modules, each of which includes contacts, one of common ends thereof being connected to contact pins of a plug when the receptacle and the plug are connected to each other, and the other of the common ends of the contacts being connected to a circuit board. Each contact module includes holding plates arranged in a direction of thickness of the each contact module. At least one conductive layer and at least one insulating portion are formed on opposed surfaces of adjacent holding plates. At least one of contacts is held between the insulating portions that are formed on the opposed surfaces of the adjacent holding plates.

25 Claims, 32 Drawing Sheets

CONNECTOR AND METHOD OF PRODUCING THE SAME

CROSS REFERENCE TO RELATED APPLICATION

The present invention is related to and claims priority of the following co-pending applications, namely, Japanese Patent Applications Nos. 2007-117407 filed on Apr. 26, 2007 and 2007-323626 filed on Dec. 14, 2007.

BACKGROUND OF THE INVENTION

1. Field of the Invention

The present invention relates to a type of connector including a plurality of contact modules, and further relates to a method of producing this type of connector.

2. Description of the Prior Art

In recent years, information and communication apparatuses, broadcast and video apparatuses, control devices for factory automation systems, medical equipment, semi-conductor manufacturing equipment, semi-conductor testers, etc., have been required to process enormous volumes of data at a high speed with a high degree of precision. Therefore, connectors for these apparatuses or devices are required to have a high shielding capability.

The connector (the plug connector 3) disclosed in Japanese unexamined patent publication 2005-197163 is provided with a front housing 5 and a plurality of contact modules 6 which are fixed to the front housing 5 to be arranged in layers in a specific direction.

Each contact module 6 includes an insulator 28, a plurality of signal contacts 16 fixed to the insulator 28, and a plurality of shielding members (the first ground plates 14 and the second ground plates 15) which are made of metal by insert molding and embedded in the insulator 28. One end of each signal contact 16 is connected to a board (electrical circuit board), while the other end of each signal contact 16 is connectable with contact pins of another connector (the receptacle connector 4), respectively.

Each of the first and second ground plates 14 and 15 includes a plurality of substantially L-shaped portions 18 and a plurality of protrusion-shaped ribs 22. The substantially L-shaped portions 18 and the protrusion-shaped ribs 22 partly surround the signal contacts 16 in the insulator 28 to shield each signal contact 16 electromagnetically.

However, in the connector disclosed in the aforementioned patent publication, the connector needs to be provided with shielding members (the first ground plates 14 and the second ground plates 15) and also needs to be formed in a complicated shape in order to exhibit a shielding effect. Therefore, the number of elements of the connector increases; moreover, it is difficult to increase productivity, and accordingly, the cost of production tends to increase.

In addition, although the metal-made shielding members are provided for the purpose of surrounding the signal contacts 16, the internal area and the external surface area of an integrally-molded product 27 (i.e., the portion of the contact module 6 excluding the signal contacts 16) in which no shielding member exits are large, and accordingly, it is hard to obtain a sufficient shielding effect.

Additionally, since the plurality of shielding members are embedded in the insulator 28, it is difficult to miniaturize the integrally-molded product 27 (it is difficult for the integrally-molded product 27 to have a high a space-saving efficiency). Accordingly, each contact module 6 becomes large in size, thus increasing the dimensions of the connector.

Additionally, since the plurality of shielding members are embedded in the insulator 28, it is difficult to achieve a higher density in each contact module 6 (i.e., increase the number of the signal contacts 16 in each contact module 6 with no increase in size of each contact module 6).

SUMMARY OF THE INVENTION

The present invention provides a simple and easy-to-produce connector (receptacle/plug) having a small number of elements, wherein a high-shielding capability is obtained even if each contact module is miniaturized.

According to an aspect of the present invention, a receptacle is provided, including a plurality of contact modules, each of which includes a plurality of contacts, one of common ends of the contacts being connected to a corresponding plurality of contact pins of a plug, respectively, when the receptacle and the plug are connected to each other, and the other of the common ends of the contacts being connected to a circuit board. Each of the plurality of contact modules includes a plurality of holding plates arranged in a direction of thickness of the each contact module. At least one conductive layer and at least one insulating portion are formed on each of opposed surfaces of adjacent holding plates of the plurality of holding plates, and at least one of the plurality of contacts is held between the insulating portions that are formed on the opposed surfaces of the adjacent holding plates, respectively.

In an embodiment, a plug is provided, including a plurality of contact modules, each of which includes a plurality of contact pins, one of common ends of the contact pins being inserted into a receptacle to be connected to a corresponding plurality of contacts included in the receptacle, respectively, when the plug and the receptacle are connected to each other, and the other of the commons ends of the plurality of contact pins being connected to a circuit board. Each of the contact modules includes a plurality of holding plates arranged in a direction of thickness of the each contact module. At least one conductive layer and at least one insulating portion are formed on each of opposed surfaces of adjacent holding plates of the holding plates. At least one of the contact pins is held between the insulating portions that are formed on the opposed surfaces of the adjacent holding plates, respectively. It is desirable for each of the plurality of contact modules to include two adjacent holding plates of the plurality of holding plates.

It is desirable for each of the plurality of contact modules to include at least three holding plates of the plurality of holding plates.

Accordingly, the receptacle and the plug achieve a smaller number of elements and are simpler in structure than those of conventional connectors using one or more metal-made shielding members in either case where the contact or contact pins of the receptacle and the plug are constituted by the same type of contacts or contact pins (this case also includes both the case of single-ended signaling and the case of differential signaling, as described above, and where the contact or contact pins of the receptacle and the plug are constituted by two types of contacts or contact pins.

Moreover, since no metal shielding member becomes no longer necessary, each contact module can be made smaller than before and the contacts or contact pins in each contact module can be further densified in the case where each contact module is provided therein with the same number of contacts or contact pins as a conventional contact module.

Furthermore, the shielding effect of the connector (receptacle/plug) can be enhanced because the surface area of each conductive layer can be increased. Accordingly, the connector (receptacle/plug) according to the present invention makes high-speed signal transmission possible.

It is desirable for the opposed surfaces of the adjacent holding plates to include first opening recesses and second opening recesses, respectively, the first opening recesses and second opening recesses being open at common end surfaces of the adjacent holding plates, respectively. Engaging holes, through which an outside and an inside of the each contact module are communicatively connected to each other, is formed by the first opening recesses and the second opening recesses upon the adjacent holding plates being joined to each other. Electrical continuity is established between the contacts of the each contact module and the contact pins of the plug upon the contact pins of the plug being inserted into the each contact module through the engaging holes, respectively.

It is desirable for the opposed surfaces of the adjacent holding plates to include first opening recesses and second opening recesses, respectively, the first opening recesses and the second opening recesses being open at common end surfaces of the adjacent holding plates, respectively. Engaging holes through which outside and inside of the each contact module are communicatively connected to each other are formed by the first opening recesses and the second opening recesses upon the adjacent holding plates being joined to each other. The contact pins project to the outside of the each contact module through the engaging holes.

Accordingly, the connector (receptacle/plug) does not have to be provided with a housing that is an indispensable element of a convention connector, which achieves a further reduction in the number of elements of the connector.

It is desirable for at least one of the adjacent holding plates to include a plurality of contact holding grooves formed on the insulating portion, the contacts being engaged in the contact holding grooves to be held thereby, respectively.

It is desirable for some of the contacts to be held between the insulating portions formed on the adjacent holding plates, and for the remainder of the plurality of contacts to be held between the conductive layers formed on the adjacent holding plates.

It is desirable for a plurality of the insulating portions to be formed on each of the opposed surfaces of the adjacent holding plates with the conductive layer on the each of the opposed surfaces of the adjacent holding plates being provided on opposite sides of each of the plurality of insulating portions. Only one of the contacts is held between each of the insulating portions that are formed on the opposed surfaces of the adjacent holding plates, respectively.

Accordingly, each contact or contact pin can be securely held by the adjacent holding plates.

It is desirable for the conductive layer to be formed entirely over each of the opposed surfaces of the adjacent holding plates of the plurality of holding plates, and for the insulating portion to be formed partly on the conductive layer.

Accordingly, since the range of shielding by the conductive layer with respect to the contacts or contact pins that are held by the associated insulating portions widens, a far superior shielding effect is achieved.

It is desirable for the conductive layer to cover a pair of side edges of each of the insulating portions positioned on both sides of the plurality of contacts.

Accordingly, if each contact or contact pin is held between the insulating portions formed on the opposed surfaces of the adjacent holding plates, the perimeter of each contact or contact pin is perfectly shielded since each contact or contact pin is totally surrounded by the conductive layers of a pair of holding plates. Accordingly, an extremely superior shielding effect is obtained.

It is desirable for a continuous conductive layer to be formed on all surfaces of the adjacent holding plates other than the opposed surfaces of the adjacent holding plates.

If the conductive layer portion is formed entirely over the surface of each holding plate in such a manner, the surface area of each conductive layer becomes extremely large, so that a far superior shielding effect is achieved.

It is desirable for each of the plurality of holding plates to include a conductive layer portion including a resin-made substrate on which the conductive layer is plated, and at least one insulation recess formed on a surface which faces the other of the adjacent holding plates; and for the insulating portion to be made of a resin material and be provided in the insulation recesses so as to occupy the insulation recesses.

Accordingly, the holding plates can be easily produced.

It is desirable for the receptacle to include a retainer which is attached to a contact module group formed by the plurality of contact modules arranged in layers to combine the plurality of contact modules into one integral module.

Accordingly, the contact module group can be easily combined into one integral body.

In an embodiment, a method is provided for making a receptacle with a plurality of contact modules, each of which includes a plurality of contacts, one of common ends of the contacts being connected to a corresponding plurality of contact pins of a plug, respectively, when the receptacle and the plug are connected to each other, and the other of the common ends of the contacts being connected to a circuit board. The method includes forming a plurality of conductive layer portions which each include a resin-made substrate which has been plated; forming a plurality of holding plates by putting a resin-made insulating portion on each of the conductive layer portions so as to occupy a part of a surface thereof; forming the contact modules by arranging the holding plates in a direction of thickness of the each contact module and by joining opposed surfaces of adjacent holding plates thereof, on which the insulating resin-made insulating portion is placed, to each other so that at least one of the contacts is held between the insulating portions that are formed on the opposed surfaces of the adjacent holding plates; and connecting the contact modules into one integral module.

Accordingly, a receptacle which includes contact modules which are simple in structure with a small number of elements and which can achieve a high shielding capability even if the size of each contact module is reduced, can be easily produced.

In an embodiment, a method is provided for making a plug with a plurality of contact modules each of which includes a plurality of contact pins, one of common ends of the contact pins being inserted into a receptacle to be connected to a corresponding plurality of contacts included in the receptacle, respectively, when the plug and the receptacle are connected to each other, and the other of the common ends of the plurality of contact pins being connected to a circuit board. The method includes forming a plurality of conductive layer portions which each include a resin-made substrate which has been plated, respectively; forming a plurality of holding plates by putting a resin-made insulating portion on each of the conductive layer portions so as to occupy a part of a surface thereof; forming the contact modules by arranging the holding plates in a direction of thickness of the each contact module and by joining opposed surfaces of adjacent holding plates thereof, on which the insulating resin-made insulating portion is placed, to each other so that at least one of the contact pins is held between the insulating portions that are formed on the opposed surfaces of the adjacent holding plates; and connecting the contact modules into one integral module.

Similarly, a plug which includes contact modules which are simple in structure with a small number of elements and which can achieve a high shielding capability even if the size of each contact module is reduced, can be easily produced.

It is desirable for the connecting of the contact modules into one integral module to include arranging the plurality of contact modules in layers to form a contact module group, and attaching a retainer to the contact module group.

Accordingly, a connector (receptacle/plug) can be easily produced since the contact module group can be easily combined into one integral body.

BRIEF DESCRIPTION OF THE DRAWINGS

The present invention will be discussed below in detail with reference to the accompanying drawings, in which.

DESCRIPTION OF THE PREFERRED EMBODIMENTS

A first embodiment of a connector according to the present invention will be discussed below with reference to FIGS. 1 through 26. Note that forward, rearward, leftward and rightward directions of the connector (receptacle/plug) in the following descriptions are determined with reference to the double-headed arrows shown in FIGS. 1, 2, 6, etc.

Figure 1:
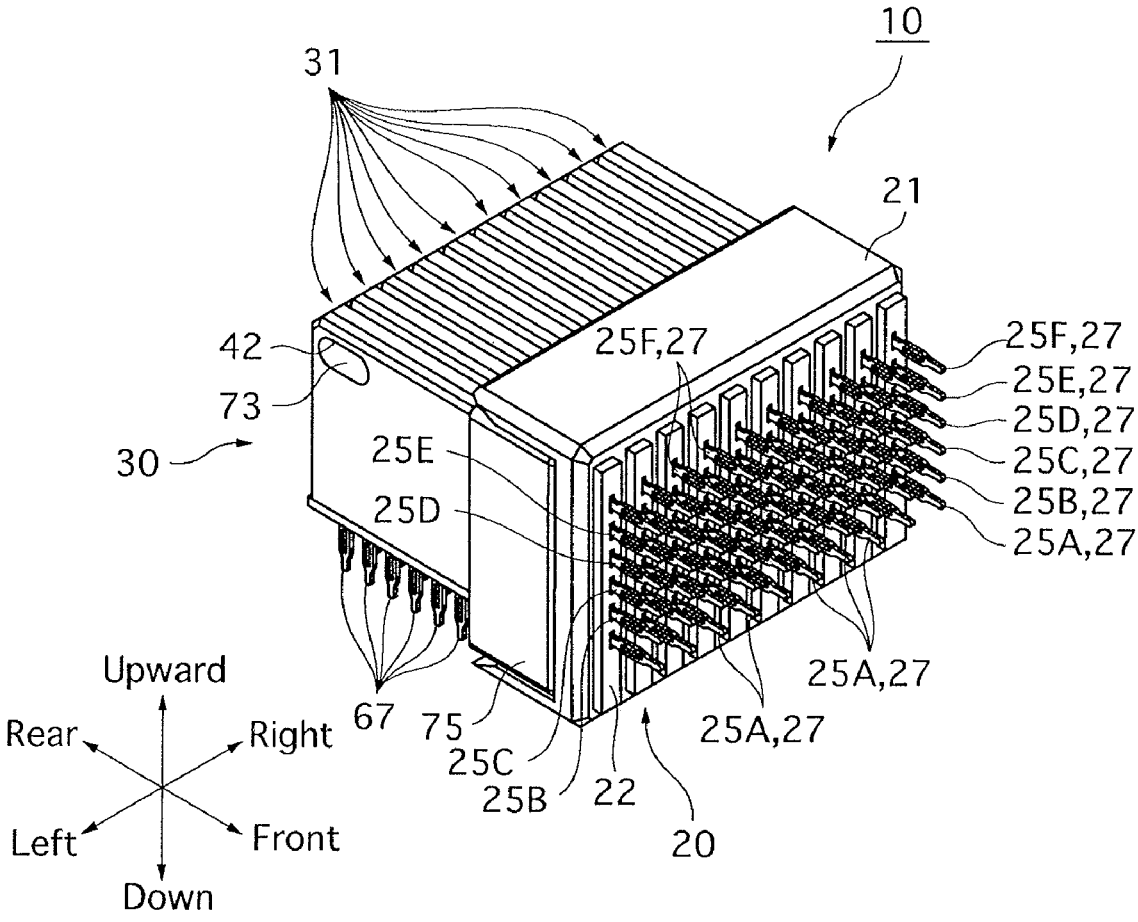
FIG. 1 is a perspective view of a first embodiment of a connector according to the present invention which includes a receptacle and a plug, showing a state where the receptacle and the plug are connected to each other.
Figure 2:
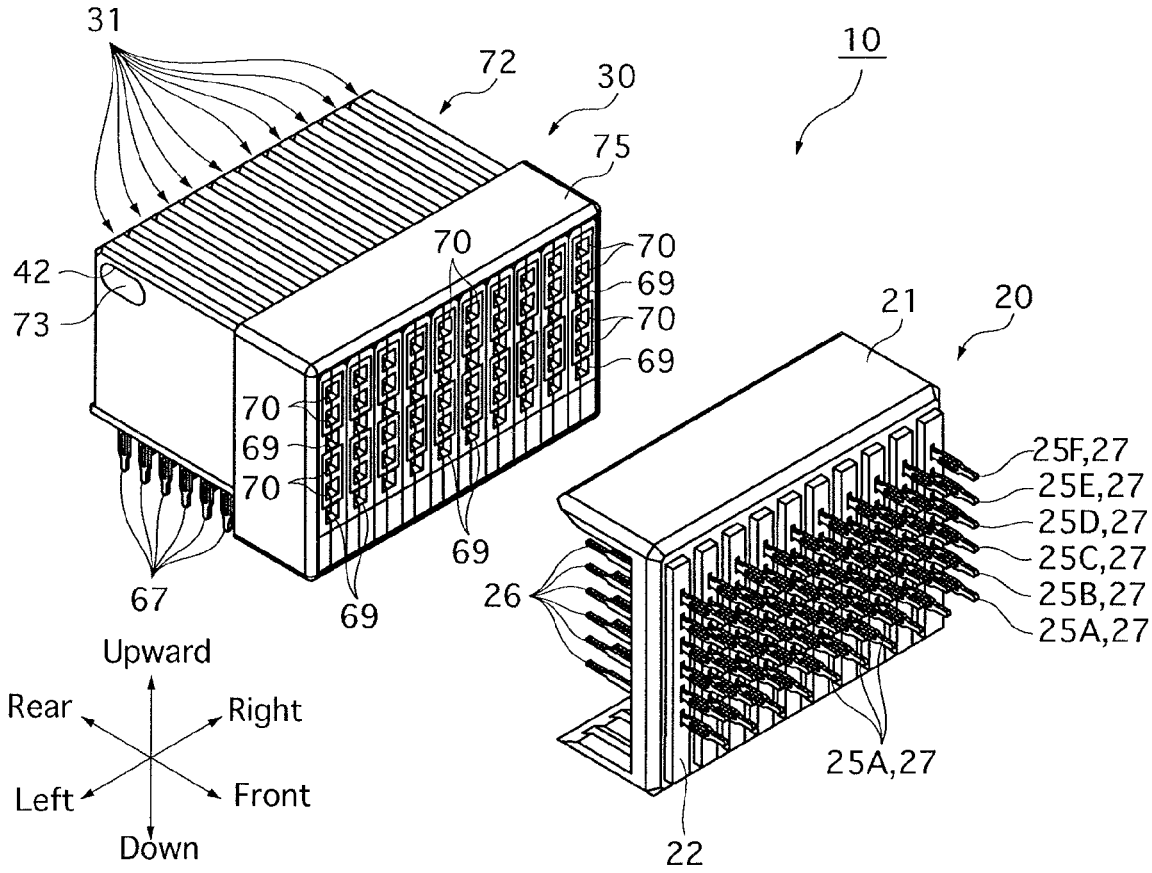
FIG. 2 is a perspective view of the receptacle and the plug, showing a state where the receptacle and the plug are disengaged from each other.

As shown in FIGS. 1 and 2, the first embodiment of the connector 10 is for use in differential signaling and includes ground contacts and signal contacts. For instance, the connector 10 is applicable to information and communication apparatuses, broadcast and video apparatuses, control devices for factory automation systems, medical equipment, semi-conductor manufacturing equipment, semi-conductor testers, etc. The connector 10 is provided with a plug 20 and a receptacle 30 which are engageable with each other. The plug 20 and the receptacle 30 are electrically connected to each other when connected to each other as shown in FIG. 1.

As shown in FIGS. 2, 24 through 26, etc., the plug 20 is provided with an insulator 21 having a substantially U-shaped cross section, a large number of ground contact pins 25A and 25D, and a large number of signal contact pins 25B, 25C, 25E and 25F. The insulator 21 is made of a heat-resistant insulating synthetic resin by injection molding. The insulator 21 is provided in a bottom plate portion 22 thereof with a large number of through holes into which the ground contact pins 25A and 25D and the signal contact pins 25B, 25C, 25E and 25F are press-fitted. The ground contact pins 25A and 25D and the signal contact pins 25B, 25C, 25E and 25F are all identical in shape and arranged in a 10 by 6 matrix of contact pins, i.e., there are ten columns of contact pins arranged in the left-right direction. The ground contact pins 25A and 25D and the signal contact pins 25B, 25C, 25E and 25F are all stamp molded out of metal. More specifically, in order to manufacture each contact pin 25A through 25F of the receptacle 30, a base material (e.g., phosphor bronze, beryllium copper, titanium copper, stainless steel, or Corson-copper alloy) is first coated with a base plating (e.g., nickel (Ni) plating) and subsequently with a finish plating (e.g., gold(Au) plating, tin(Sn)-copper(Cu) plating, or tin(Sn)-lead(Pb) plating). The rear ends of the ground contact pins 25A and 25D and the signal contact pins 25B, 25C, 25E and 25F are formed as contact ends connectable with the front ends of ground contacts 65A and 65D and signal contacts 65B, 65C, 65E and 65F of the plug 20, respectively. The front ends of the ground contact pins 25A and 25D and the signal contact pins 25B, 25C, 25E and 25F are formed as press-fit terminals 27 which are driven (press-fitted) into through holes formed in a circuit board (not shown), respectively. The press-fit terminals 27 of the ground contact pins 25A and 25D are electrically connected to a ground pattern on the circuit board, and the press-fit terminals 27 of the signal contact pins 25B, 25C, 25E and 25F are electrically connected to a circuit pattern on the same circuit board.

The receptacle 30 will be discussed with reference mainly to FIGS. 5 through 23. The receptacle 30 is provided with ten contact modules 31 and a retainer 75 as relatively large elements of the receptacle 30.

Each contact module 31 is provided with a pair of holding plates 33 and 34, two of the ground contacts 65A and 65D and four of the signal contacts 65B, 65C, 65E and 65F.

Figure 12:
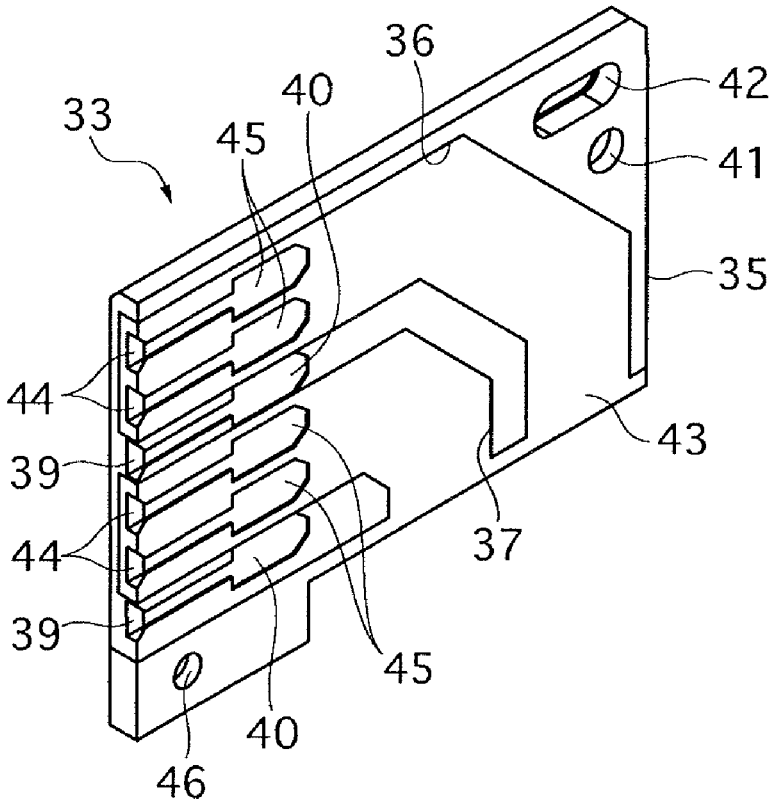
FIG. 12 is a perspective view of one of the two holding plates of each contact module.
Figure 13:
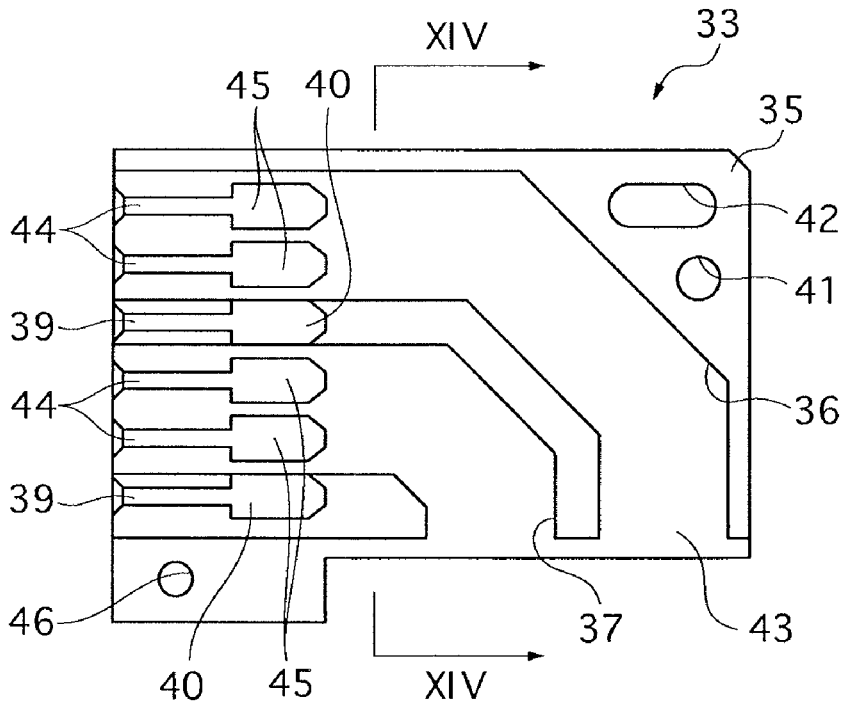
FIG. 13 is a side elevational view of the holding plate shown in FIG. 12.
Figure 14:
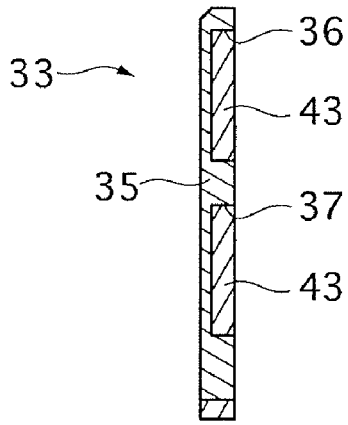
FIG. 14 is a cross sectional view taken along the XIV-XIV line shown in FIG. 13, viewed in the direction of the appended arrows.

As discussed below, the holding plate 33 shown in FIGS. 12 through 14 is made of two resin members integrated into one piece.

Figure 15:
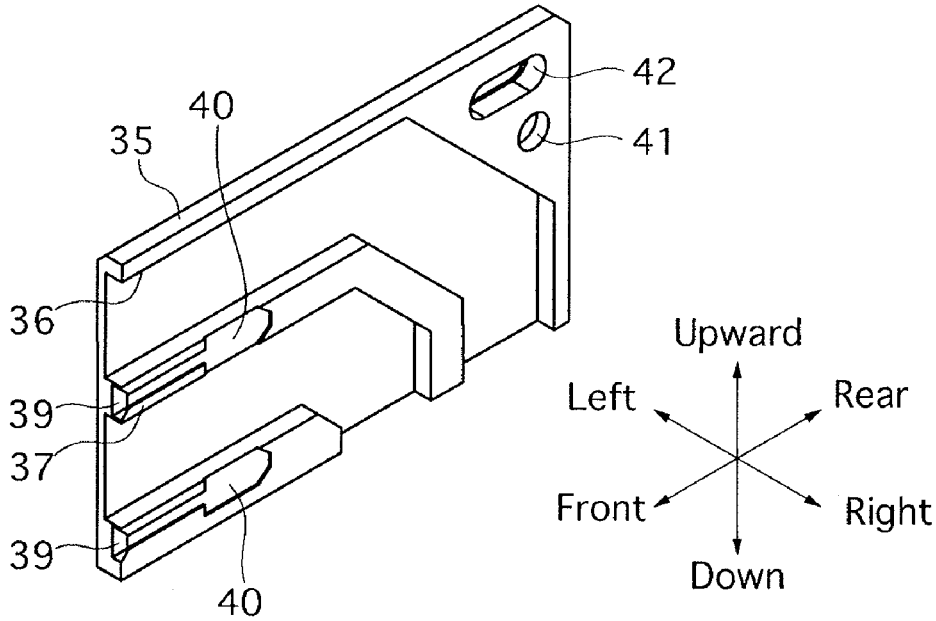
FIG. 15 is a perspective view of the holding plate shown in FIG. 12 before an insulating portion is molded integrally with the holding plate.
Figure 16:
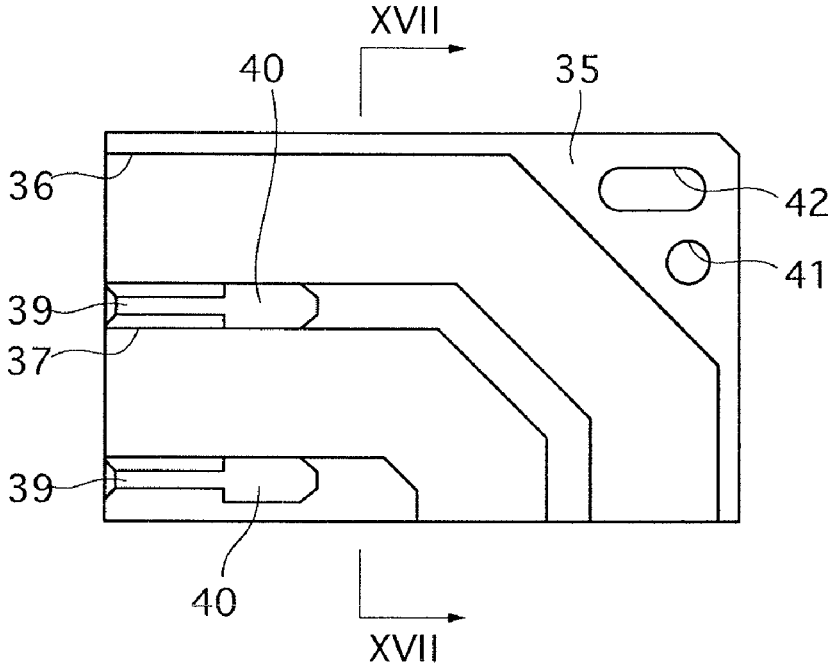
FIG. 16 is a side elevational view of the holding plate shown in FIG. 15.
Figure 17:
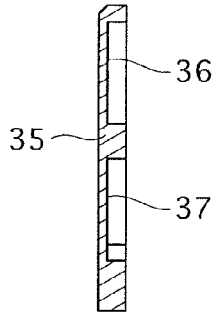
FIG. 17 is a cross sectional view taken along the XVII-XVII line shown in FIG. 16, viewed in the direction of the appended arrows.
Figure 18:
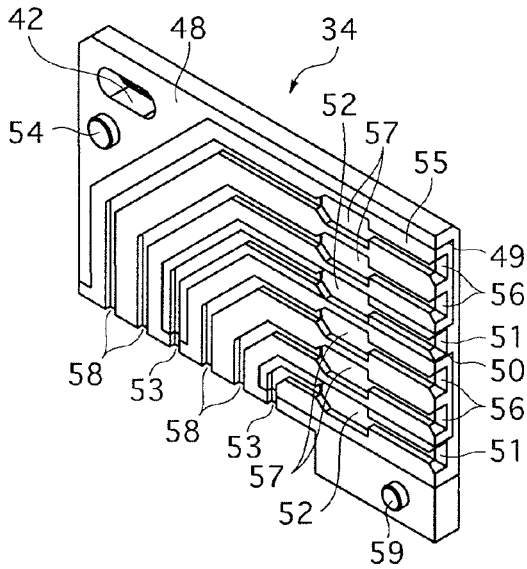
FIG. 18 is a perspective view of the other of the two holding plates of each contact module.
Figure 19:
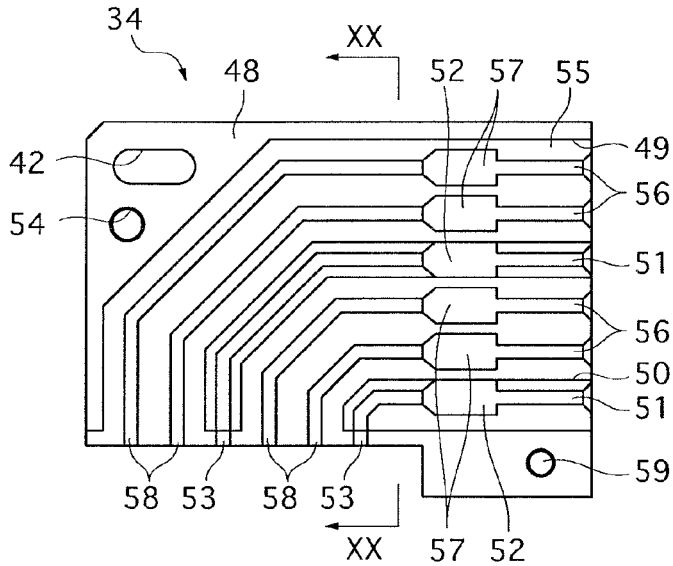
FIG. 19 is a side elevational view of the holding plate shown in FIG. 18.
Figure 20:
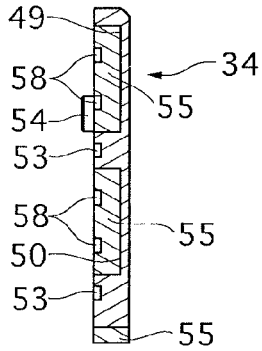
FIG. 20 is a cross sectional view taken along the XX-XX line shown in FIG. 19, viewed in the direction of the appended arrows.

A conductive layer portion (conductive layer) 35 serving as a base of the holding plate 33 is made by firstly being molded from an insulating synthetic resin into the shape shown in FIGS. 15 through 17 with the use of molding dies (not shown), and subsequently being entirely plated so as to constitute a continuous conductive layer.

The method of applying such plating can be a so-called resin plating method or thin-film forming method (evaporation method, spattering, etc.). In the case of the resin plating method, firstly a molded member (molding) as a base of the conductive layer portion 35 is subjected to a grease removing process to remove grease from the outer surface of the molded member, a cleaning process to cleanse the outer surface of the molded member and thereafter a surface activating process to activate the outer surface of the molded member by catalysis. Thereafter, the molded member is given electroless plating, nickel strike plating, electric copper plating, nickel plating, and finish plating in that order. Alternatively, the conductive layer portion 35 can be molded by MID (molded interconnect device).

As shown in the drawings, the conductive layer portion 35 is provided on the inner surface thereof with two insulation recesses 36 and 37 which are open to both the front end surface and the bottom end surface of the conductive layer portion 35. The conductive layer portion 35 is further provided, on two ribs formed on the inner surface of the conductive layer portion 35 which are respectively adjacent to the two insulation recesses 36 and 37, with two opening recesses 39 and two end accommodation grooves (ground-contact holding grooves) 40 positioned immediately behind the two opening recesses 39, respectively. The two opening recesses 39 are elongated rearward from the front end surface of the conductive layer portion 35, and the two end accommodation grooves 40 are communicatively connected with the rear ends of the two opening recesses 39 and are greater in width than the two opening recesses 39, respectively. The conductive layer portion 35 is further provided, on the inner surface thereof in the vicinity of the upper rear corner of the conductive layer portion 35, with a circular-columnar-shaped engaging recess (bottomed hole) 41 and an elongated insertion hole (through-hole) 42.

An insulating portion 43 made of an insulating synthetic resin is molded with the use of molding dies (not shown) to be integral with the inner surface of the conductive layer portion 35, which is molded in the above described manner, so that the two insulation recesses 36 and 37 are provided (occupied) with the insulating portion 43 as shown in FIGS. 12 through 14. In addition, at the time of molding the insulating portion 43, four opening recesses 44 which are identical in shape to the two opening recesses 39, and associated four end accommodation grooves (contact holding grooves) 45 which are identical in shape to the two end accommodation grooves 40 and are communicatively connected with the rear ends of the four opening recesses 44 are formed in the insulating portion 43 in the two insulation recesses 36 and 37, and a circular-columnar-shaped engaging recess 46 is formed in the insulating portion 43 in the vicinity of the bottom front corner of the conductive layer portion 35.

The two holding plates 33 and 34 of each contact module 31 are substantially bilaterally symmetrical in shape; however, the holding plate 34 is partly different in shape from the holding plate 33.

Figure 21:
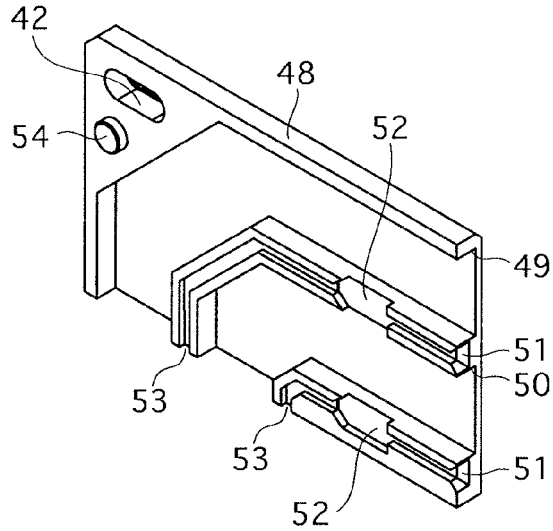
FIG. 21 is a perspective view of the holding plate shown in FIG. 18 before an insulating portion is molded integrally with the holding plate.
Figure 22:
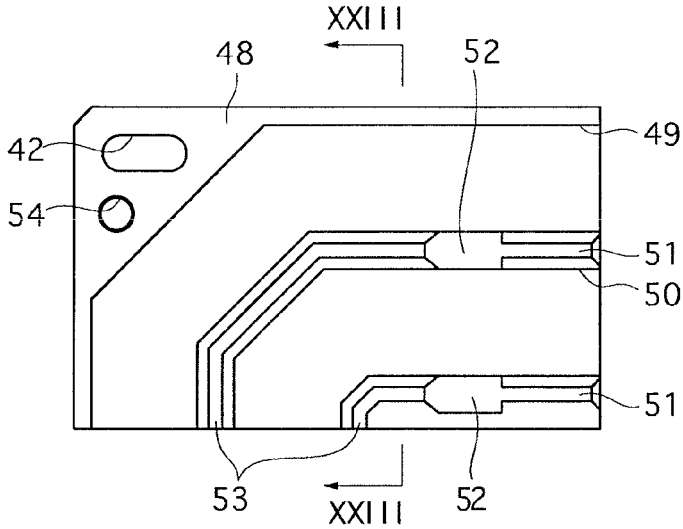
FIG. 22 is a side elevational view of the holding plate shown in FIG. 21.
Figure 23:
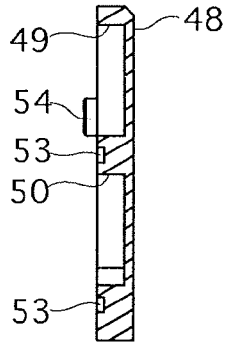
FIG. 23 is a cross sectional view taken along the XXIII-XXIII line shown in FIG. 22, viewed in the direction of the appended arrows.
Figure 24:
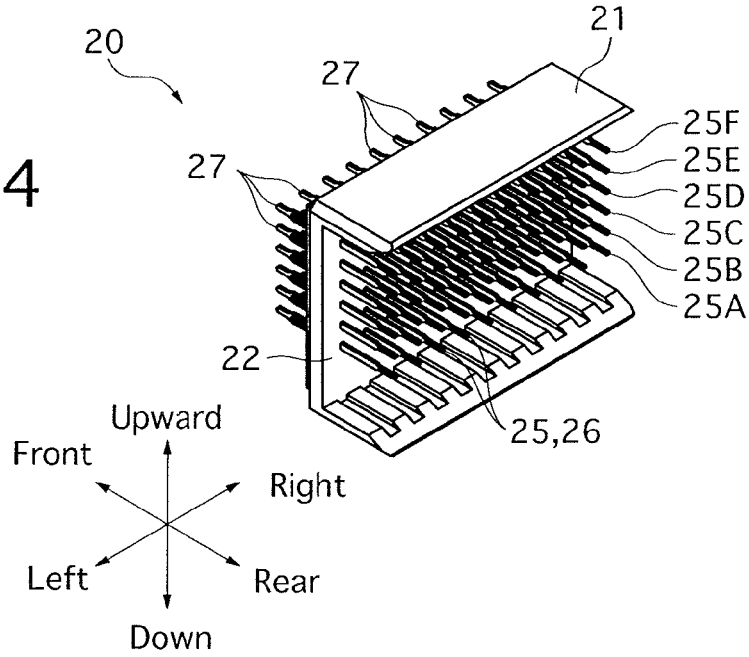
FIG. 24 is a rear perspective view of the plug shown in FIGS. 1 and 2.
Figure 25:
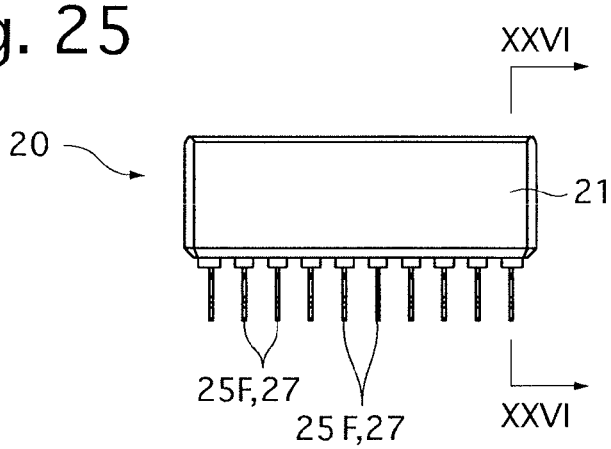
FIG. 25 is a plan view of the plug.
Figure 26:
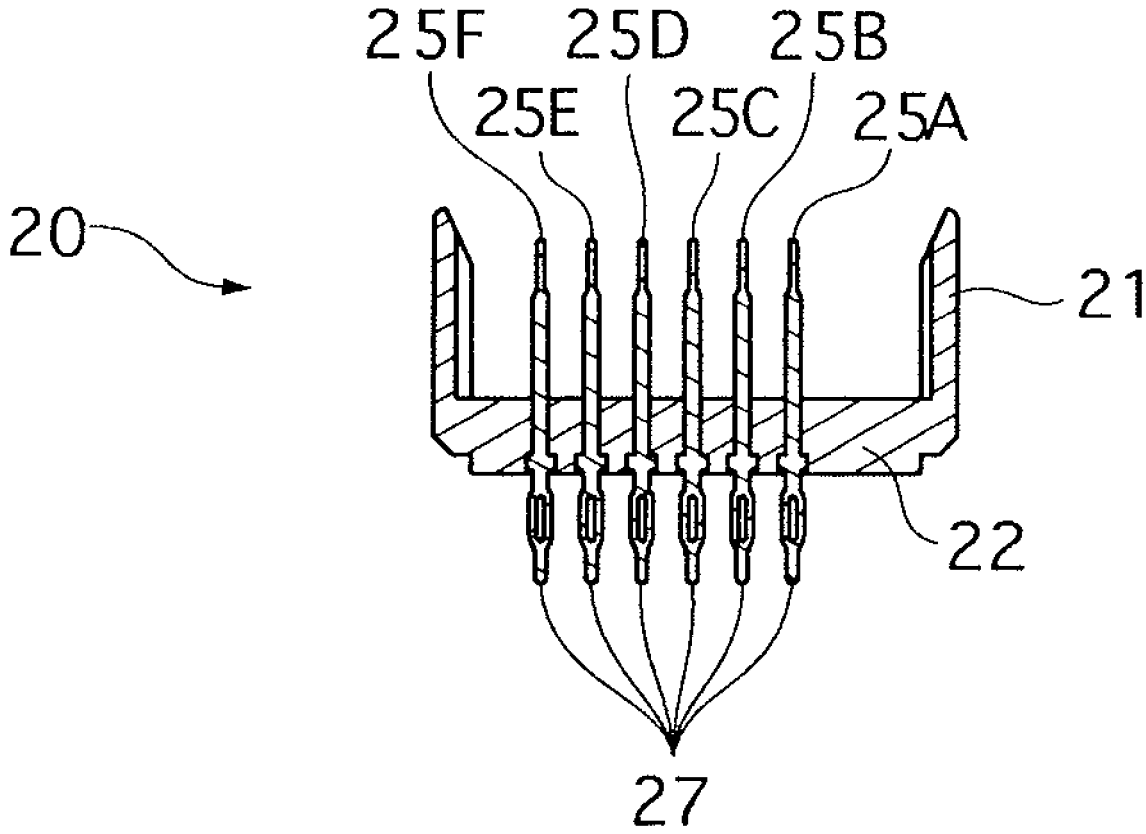
FIG. 26 is a cross sectional view taken along the XXVI-XXVI line shown in FIG. 25, viewed in the direction of the appended arrows.

A conductive layer portion (conductive layer) 48 of the holding plate 34, which is shown in FIGS. 21 through 23, is an element corresponding to the conductive layer portion 35 of the holding plate 33 (the material of the conductive layer portion 48 (including the plating material) is the same as that of the conductive layer portion 35). The conductive layer portion 48 is molded with the use of molding dies (not shown) in the same manner as the conductive layer portion 35, and is provided with two insulation recesses 49 and 50, two opening recesses 51 and two end accommodation grooves (ground-contact holding grooves) 52 which correspond to the two insulation recesses 36 and 37, the two opening recesses 39 and the two end accommodation grooves 40 of the conductive layer portion 35 of the holding plate 33, respectively. The two insulation recesses 49 and 50, two opening recesses 51 and two end accommodation grooves 52, and the two insulation recesses 36 and 37, the two opening recesses 39 and the two end accommodation grooves 40 are bilaterally symmetrical to each other (mirror images to each other), respectively. Unlike the conductive layer portion 35, the conductive layer portion 48 is further provided, on two ribs formed on the inner surface of the conductive layer portion 48 which are respectively adjacent to the two insulation recesses 49 and 50, with two communication grooves (ground-contact holding grooves) 53. One end (front ends) of each of the two communication grooves 53 is communicatively connected to each of the two end accommodation grooves 52, respectively, and the other end of each of the two communication grooves 53 is open to the bottom end surface of the conductive layer portion 48. Each communication groove 53 is narrower than each end accommodation groove 52. Additionally, the conductive layer portion 48 is provided, in the vicinity of the upper rear corner of the conductive layer portion 48, with an elongated insertion hole (through-hole) 42 which corresponds to the elongated insertion hole 42 of the conductive layer portion 35, and is further provided, on the inner surface thereof in the vicinity of the upper rear corner of the conductive layer portion 48, with an engaging projection 54 which is shaped to correspond to the circular-columnar-shaped engaging recess 41 of the conductive layer portion 35 to be engageable therein. An insulating portion 55 which corresponds to the insulating portion 43 of the holding plate 33 is molded with the use of molding dies (not shown) to be integral with the inner surface of the conductive layer portion 48 after the conductive layer portion 48 has been molded (the material of the insulating portion 55 and the method of molding thereof are the same as those of the insulating portion 43). Four opening recesses 56 and four end accommodation grooves (contact holding grooves) 57 which correspond to the four opening recesses 44 and the four end accommodation grooves 45, respectively, are formed on the inner surface of the insulating portion 55. In addition, the conductive layer portion 48 is further provided on the inner surface of the insulating portion 55 with four communication grooves (contact holding grooves) 58 which respectively extend from the four end accommodation grooves 57 to the bottom end of the insulating portion 55. Each communication groove 58 is narrower than each end accommodation groove 57. Additionally, an engaging projection 59 which is shaped to correspond to the engaging recess 46 of the insulating portion 43 of the holding plate 33 to be engageable therein is formed in the insulating portion 55 in the vicinity of the bottom front corner of the conductive layer portion 48.

The side edges (upper and lower side edges) of each insulating portion 43 and 55 in each associated insulation recess (36, 37, 49 and 50) are covered by the associated conductive layer.

The two ground contacts 65A and 65D and the four signal contacts 65B, 65C, 65E and 65F, which are held between the two holding plates 33 and 34, are stamp molded out of metal. More specifically, to make each contact 65A through 65F, a base material (e.g., phosphor bronze, beryllium copper, titanium copper, stainless steel, or Corson-copper alloy) is coated firstly with a base plating (e.g., nickel (Ni) plating), and subsequently with a finish plating (e.g., gold(Au) plating, tin(Sn)-copper(Cu) plating, or tin(Sn)-lead(Pb) plating). The side shapes of the ground contacts 65A and 65D and the signal contacts 65B, 65C, 65E and 65F are all in the shape of a substantially letter L and mutually different in length. The front ends and the lower ends of all the ground contacts 65A and 65D and the signal contacts 65B, 65C, 65E and 65F are formed as bifurcated resilient (spring) portions 66 and press-fit terminals 67, respectively.

The ground contacts 65A and 65D, the signal contacts 65B, 65C, 65E and 65F and the two holding plates 33 and 34 are combined into one integral component in the following manner.

First of all, the bifurcated resilient portions 66 of the ground contacts 65A and 65D are respectively accommodated in the two end accommodation grooves 52, and middle portions (conductive positions) of the ground contacts 65A and 65D between the bifurcated resilient portions 66 and the press-fit terminals 67 thereof are respectively held by the two communication grooves 53 (with projections (not shown) which are formed on the aforementioned conductive portions of the ground contacts 65A and 65D pressing against side surfaces of the two communication grooves 53, respectively ) so that the press-fit terminals 67 of the ground contacts 65A and 65D project downward from the bottom end of the holding plate 34. At the same time, the bifurcated resilient portions 66 of the signal contacts 65B, 65C, 65E and 65F are respectively accommodated in the four end accommodation grooves 57, and middle portions (conductive positions) of the signal contacts 65B, 65C, 65E and 65F between the bifurcated resilient portions 66 and the press-fit terminals 67 thereof are respectively held by the four communication grooves 58 (with projections (not shown) which are formed on the aforementioned conductive portions of the signal contacts 65B, 65C, 65E and 65F pressing against side surfaces of the four communication grooves 58, respectively ) so that the press-fit terminals 67 of the signal contacts 65B, 65C, 65E and 65F project downward from the bottom end of the holding plate 34.

Subsequently, the inner surface of the holding plate 33 is combined with the inner surface of the holding plate 34 to which the ground contacts 65A and 65D and the signal contacts 65B, 65C, 65E and 65F have been installed while the engaging projections 54 and 59 of the holding plate 34 are fitted into the engaging recesses 41 and 46, respectively. Thereupon, the bifurcated resilient portions 66 of the ground contacts 65A and 65D are accommodated in the two end accommodation grooves 40 of the conductive layer portion 35 of the holding plate 33, respectively, the bifurcated resilient portions 66 of the signal contacts 65B, 65C, 65E and 65F are accommodated in the four end accommodation grooves 45 of the conductive layer portion 35 of the holding plate 33, respectively, the inner surfaces of the conductive layer portions 35 and 48 come in intimate contact with each other, and the inner surfaces of the insulating portions 43 and 55 come in intimate contact with each other. In addition, the two opening recesses 39 of the holding plate 33 and the two opening recesses 51 of the holding plate 34, which face each other, form two engaging holes 69 at the front end of the contact module 31, and the two opening recesses 44 of the holding plate 33 and the two opening recesses 56 of the holding plate 34, which face each other, form two engaging holes 70 at the front end of the contact module 31 (see FIGS. 2, 3 and 6).

Figure 3:
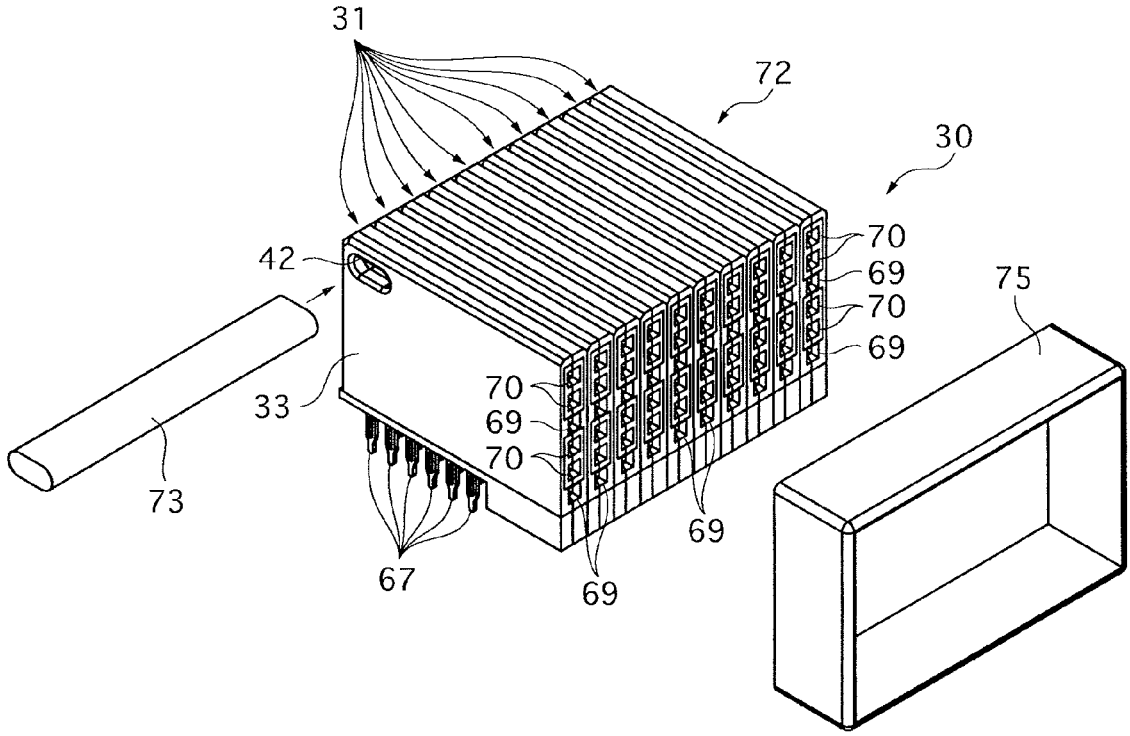
FIG. 3 is an exploded perspective view of the receptacle, which is disassembled into three pieces: a contact module group, a retainer and a connecting rod.
Figure 4:
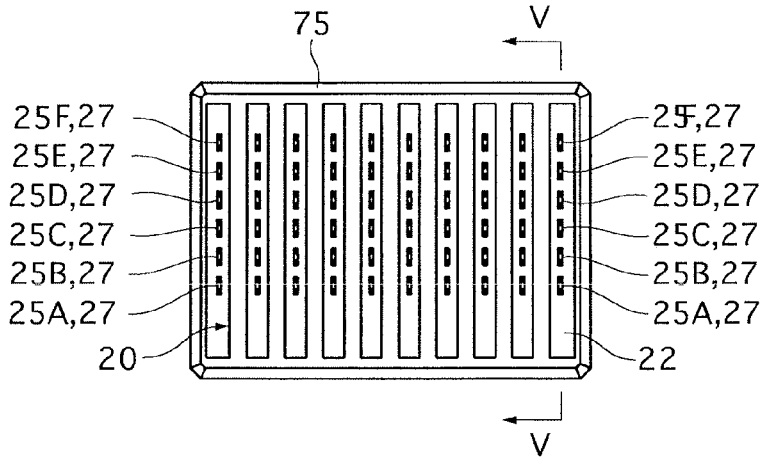
FIG. 4 is a front elevational view of the plug and the receptacle which are connected to each other.

Ten of the contact modules 31, each of which is assembled in the above described manner, are arranged in layers in the left-right direction as shown in FIG. 3 to constitute a contact module group 72. Thereupon, the elongated insertion holes 42 of the ten contact modules 31 are aligned, so that a connecting rod 73 (see FIG. 3) made of synthetic resin and having the same cross sectional shape as each elongated insertion hole 42 is inserted into each elongated insertion hole 42. Additionally, the retainer 75 that is shaped as a rectangular frame is fitted on the outer peripheral surface of the front end of the contact module group 72. Thereupon, the inner peripheral surface of the retainer 75 comes into intimate contact with the outer peripheral surface of the front end of the contact module group 72, which makes each contact module 31 and the retainer 75 integral with each other.

After the receptacle 30 is assembled in the above described manner, the press-fit terminals 67 of the ground contacts 65A and 65D and the signal contacts 65B, 65C, 65E and 65F are driven (press-fitted) into the through holes formed in the aforementioned circuit board (not shown), respectively. Thereupon, the press-fit terminals 67 of the ground contacts 65A and 65D are connected to a ground pattern on this circuit board, and the press-fit terminals 67 of the signal contacts 65B, 65C, 65E and 65F are connected to a circuit pattern on this circuit board.

Figure 5:
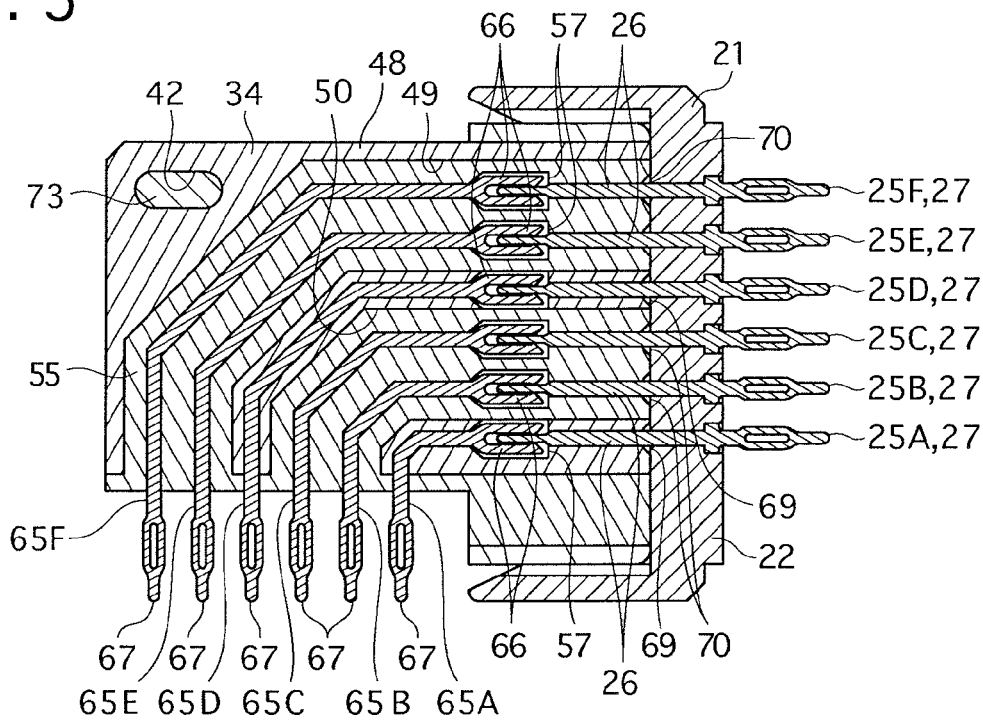
FIG. 5 is a cross sectional view taken along the V-V line shown in FIG. 4, viewed in the direction of the appended arrows.
Figure 6:
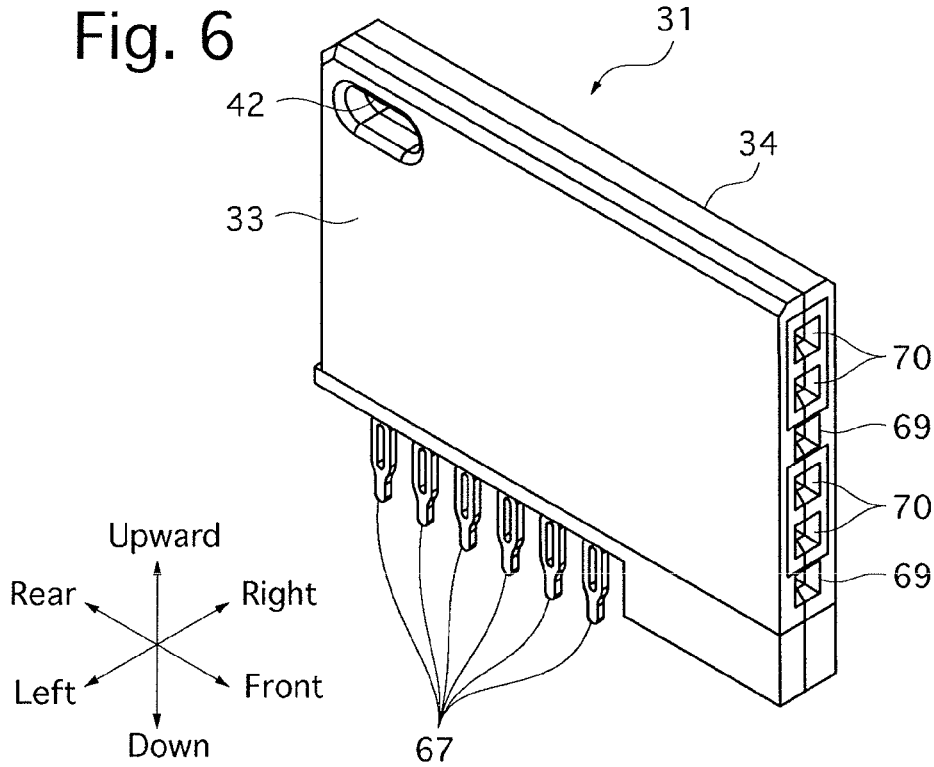
FIG. 6 is a perspective view of each contact module of the receptacle.
Figure 7:
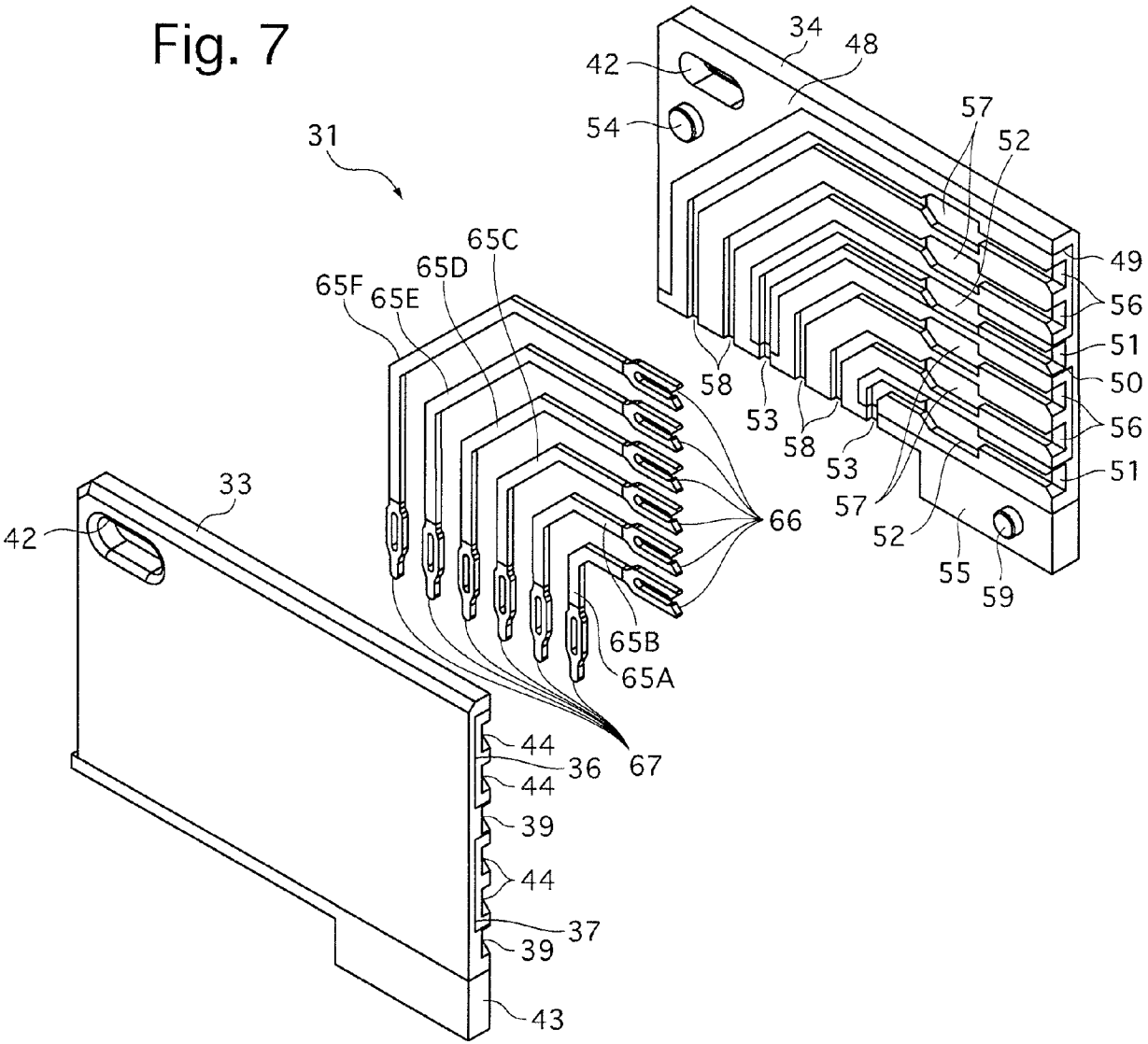
FIG. 7 is an exploded perspective view of the contact module shown in FIG. 6.
Figure 8:
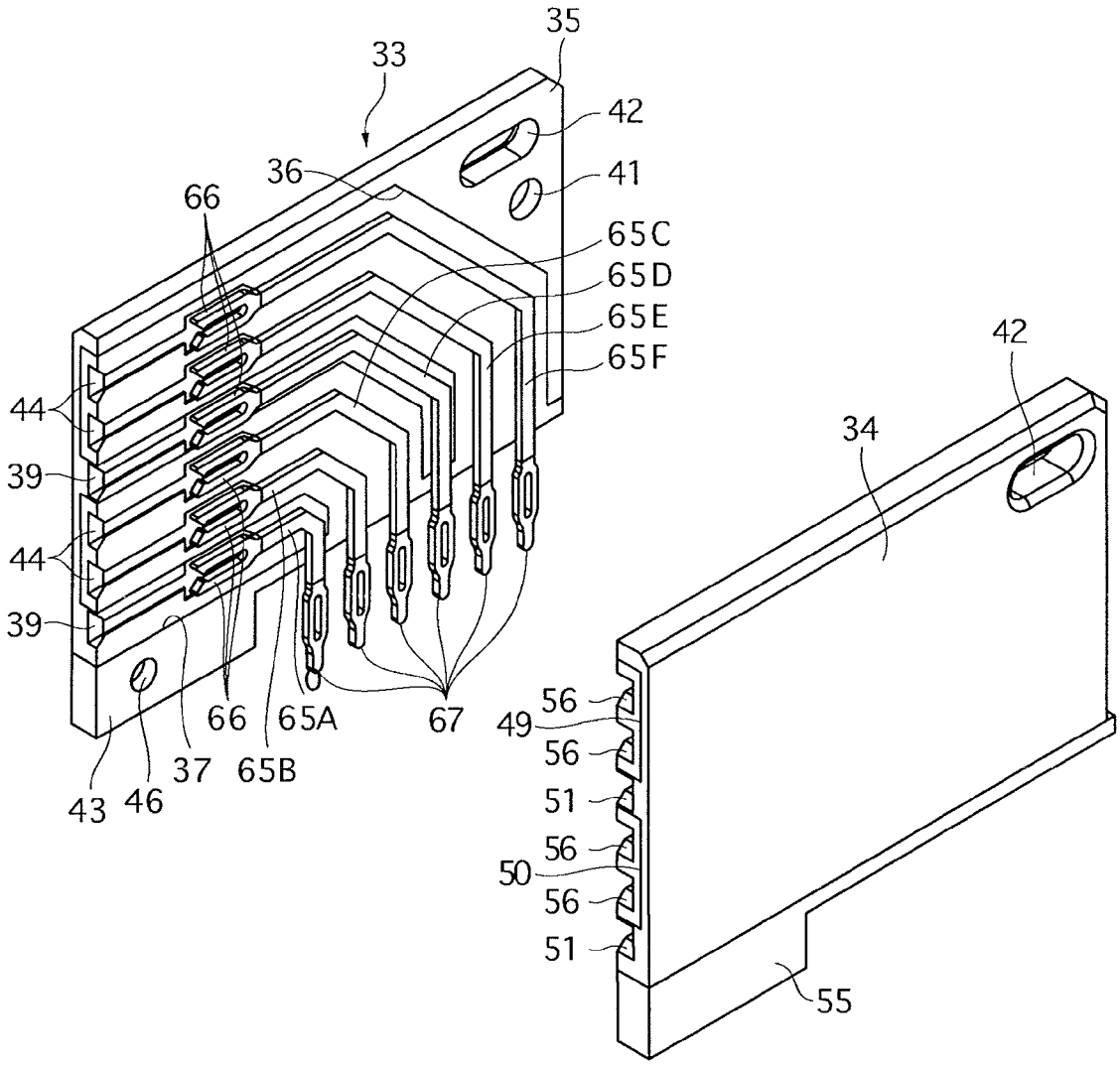
FIG. 8 is an exploded perspective view of the contact module shown in FIG. 6, viewed from a different angle.
Figure 9:
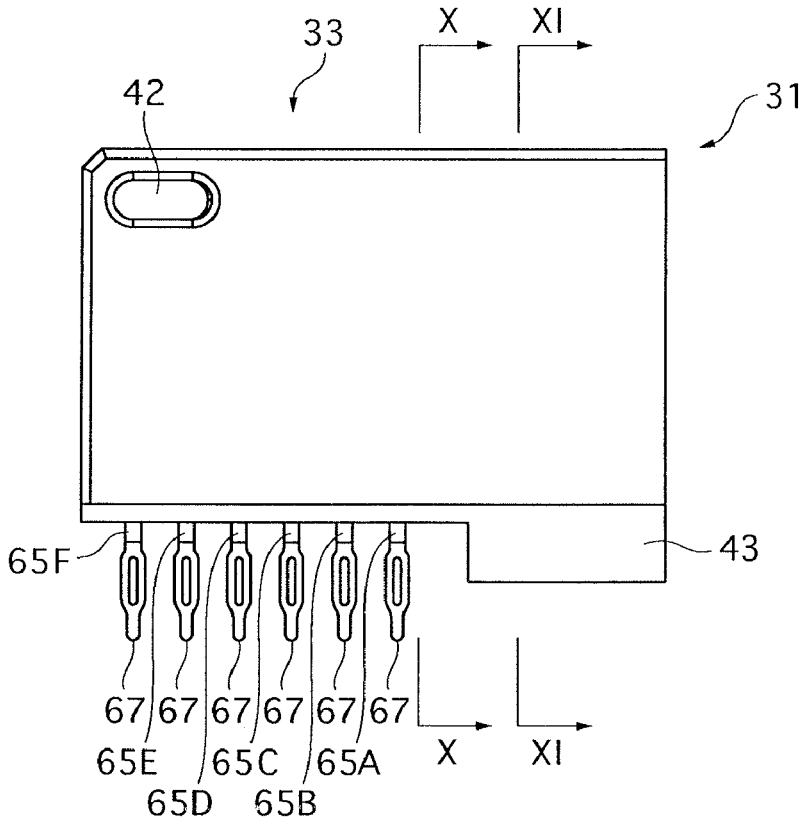
FIG. 9 is a side elevational view of the contact module shown in FIG. 6.
Figure 10:
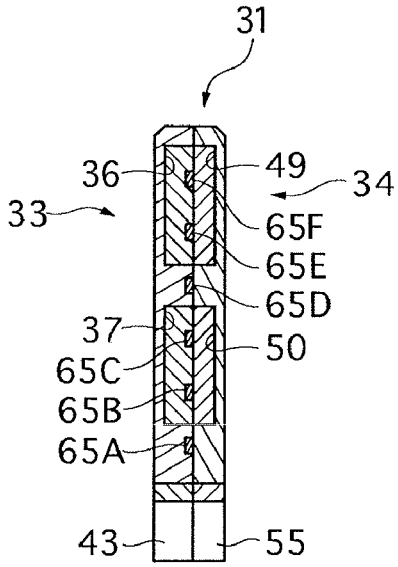
FIG. 10 is a cross sectional view taken along the X-X line shown in FIG. 9, viewed in the direction of the appended arrows.
Figure 11:
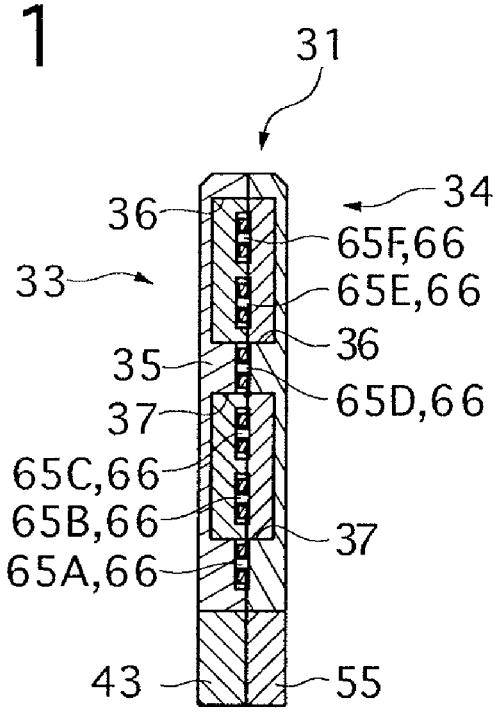
FIG. 11 is a cross sectional view taken along the XI-XI line shown in FIG. 9, viewed in the direction of the appended arrows.

When the receptacle 30 and the plug 20, each of which having the above described structure, are connected to each other as shown in FIG. 1 from an disengaged state shown in FIG. 2, terminal contacts 26 of the ground contact pins 25A and 25D are inserted into the associated engaging holes 69, respectively, that are formed on the front surface of the receptacle 30, so that the terminal contacts 26 of the ground contact pins 25A and 25D enter the spaces formed between the associated end accommodation grooves 52 of the holding plate 34 and the associated end accommodation grooves 40 of the holding plate 33, respectively, through the engaging holes 69 as shown in FIG. 5, while the terminal contacts 26 of the signal contact pins 25B, 25C, 25E and 25F are inserted into the associated engaging holes 70, respectively, that are formed on the front surface of the receptacle 30, so that the terminal contacts 26 of the signal contact pins 25B, 25C, 25E and 25F enter the spaces formed between the associated end accommodation grooves 57 of the holding plate 34 and the associated end accommodation grooves 45 of the holding plate 33, respectively, through the engaging holes 70 as shown in FIG. 5. Thereupon, the terminal contacts 26 of the ground contact pins 25A and 25D enter the bifurcated resilient portions 66 of the ground contacts 65A and 65D while resiliently deforming the same bifurcated resilient portions 66 to establish connections therewith, respectively, while the terminal contacts 26 of the signal contact pins 25B, 25C, 25E and 25F enter the bifurcated resilient portions 66 of the signal contacts 65B, 65C, 65E and 65F while resiliently deforming the same bifurcated resilient portions 66 to establish connections therewith, respectively.

Therefore, the ground contact pins 25A and 25D of the plug 20 are electrically connected to a ground pattern formed on a circuit board on the receptacle 30 side, and the ground contacts 65A and 65D of the receptacle 30 are electrically connected to a ground pattern formed on a circuit board on the plug 20 side. Similarly, the signal contact pins 25B, 25C, 25E and 25F of the plug 20 are electrically connected to a circuit pattern formed on the circuit board on the receptacle 30 side, and the signal contacts 65B, 65C, 65E and 65F of the receptacle 30 are electrically connected to a circuit pattern formed on the circuit board on the plug 20 side.

In the above illustrated first embodiment of the connector, the peripheries of the signal contacts 65B, 65C, 65E and 65F are totally covered by the insulating portions 43 and 55; moreover, the peripheries of the insulating portions 43 and 55 are totally covered by the insulation recesses 36 and 37 and the insulation recesses 49 and 50 that are formed on the conductive layer portions 35 and 48, respectively. Due to this structure, the signal contacts 65B, 65C, 65E and 65F are securely shielded by the inner surfaces of the insulation recesses 36, 37, 49 and 50 (which makes it possible to prevent the signal contacts 65B, 65C, 65E and 65F from both picking up noise from the outside and leaking noise caused by themselves during signal transmission in an extremely effective manner). Accordingly, the connector 10 which has superior shielding characteristics and makes a high-speed signal transmission possible is achieved.

Moreover, the surface areas of the conductive layer portions 35 and 48 are large because the conductive layer portions 35 and 48 are formed over the entire surface of the holding plates 33 and 34 and because a surface (inner surface) of the conductive layer portion 35 of the holding plate 33 which faces the other holding plate 34 is provided with recesses (the insulation recesses 36 and 37) and a surface (inner surface) of the conductive layer portion 48 of the holding plate 34 which faces the other holding plate 33 is also provided with recesses (the insulation recesses 49 and 50).

Furthermore, the connector can be easily produced with no decrease in productivity even if the holding plates 33 and 34 (conductive layer portions and insulating portions) that are elements of each contact module 31 include complicated shapes such as the insulation recesses and the contact holding grooves because each holding plate 33 and 34 is a molded member made of synthetic resin.

Furthermore, since no shielding member made of metal is embedded in each contact module 31, the number of elements of the connector can be reduced as compared with conventional contacts; moreover, each contact module 31 can be miniaturized in the case where the present embodiment of the connector is provided therein with the same number of contacts as a conventional contact.

Furthermore, since the contact modules 31 are joined together by the retainer 75 to be made as an integral member instead of using a housing that was an indispensable element of a conventional connector, in this respect also it can be said that the present embodiment of the connector is easy to produce (assemble).

In addition, since the ground contacts 65A and 65D and the signal contacts signal contacts 65B, 65C, 65E and 65F are held between the end accommodation grooves 40 and 45, which are recessed in the holding plate 33, and the end accommodation grooves 52, the communication grooves 53, the end accommodation grooves 57 and the communication grooves 58, which are recessed in the holding plate 34, the ground contacts 65A and 65D and the signal contacts signal contacts 65B, 65C, 65E and 65F can be firmly held and retained by the holding plates 33 and 34 and easily produced with a high degree of productivity.

A second embodiment of the connector according to the present invention will be discussed below with reference to FIGS. 27 through 56. Note that forward, rearward, leftward and rightward directions of the connector (receptacle/plug) in the following descriptions are determined with reference to the double-headed arrows shown in FIGS. 27, 28, 30, etc.

Figure 27:
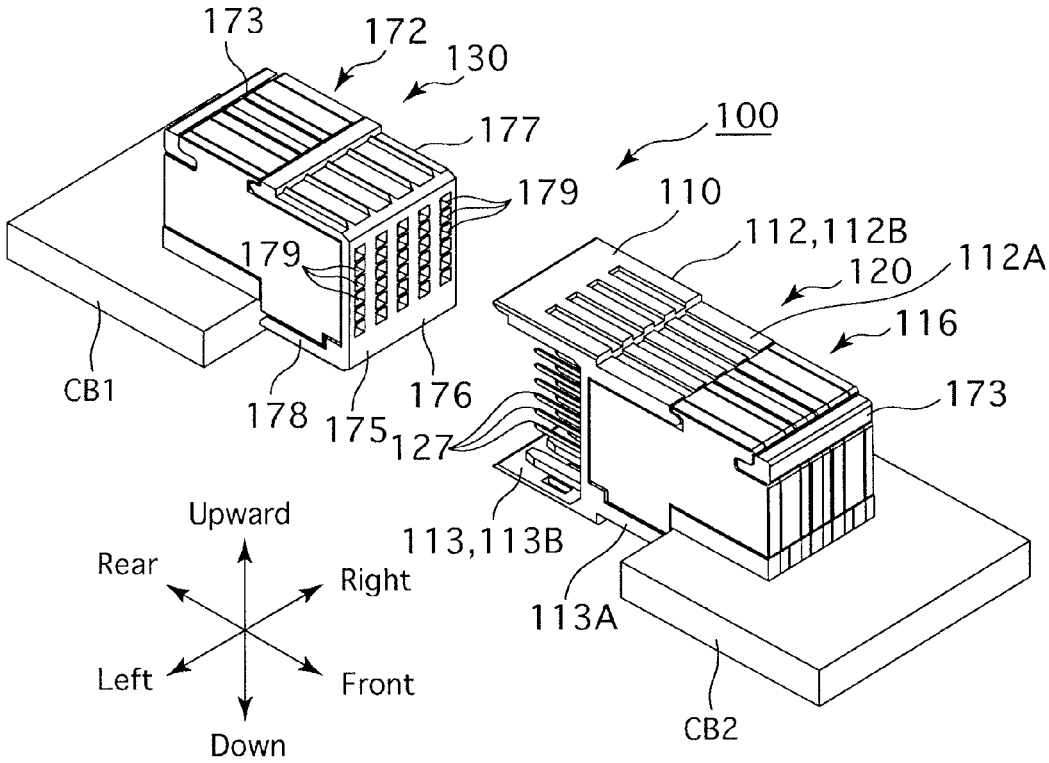
FIG. 27 is a perspective view of a second embodiment of the connector according to the present invention which includes a receptacle and a plug, showing a state where the receptacle and the plug are disengaged from each other.
Figure 28:
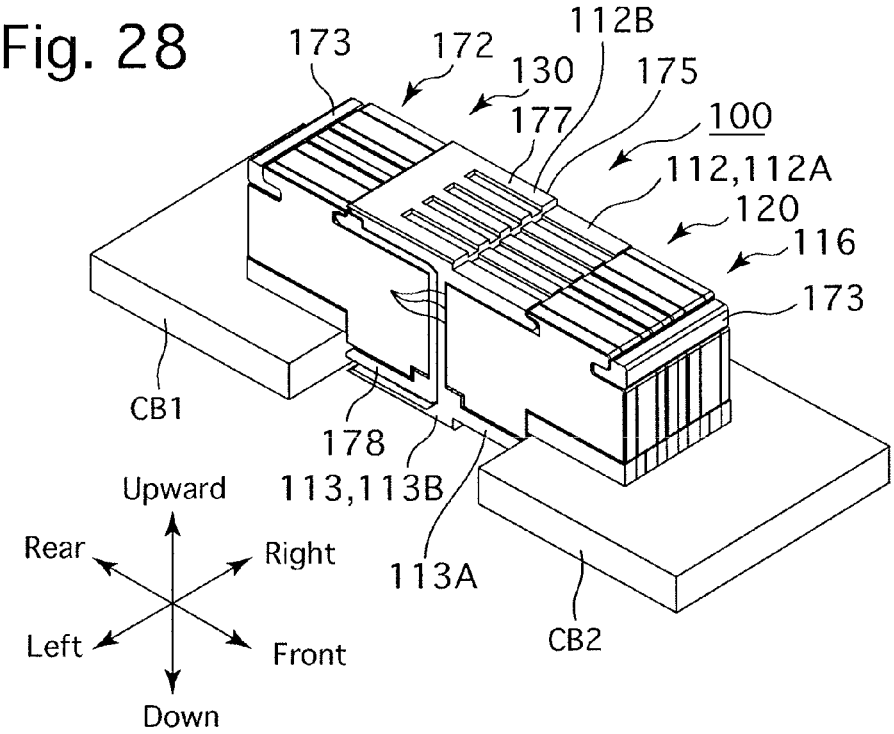
FIG. 28 is a perspective view of the receptacle and the plug of the second embodiment of the connector, showing a state where the receptacle and the plug are connected to each other.

As shown in FIGS. 27 and 28, the second embodiment of the connector 100 is for use in differential signaling and includes ground contacts and signal contacts. For instance, the connector 100 is applicable to information and communication apparatuses, broadcast and video apparatuses, control devices for factory automation systems, medical equipment, semi-conductor manufacturing equipment, semiconductor testers, etc., similar to the above-described first embodiment of the connector 10. The connector 100 is provided with a plug 120 and a receptacle 130 which are engageable with each other. The plug 120 and the receptacle 130 are electrically connected to each other when connected to each other as shown in FIG. 28.

Firstly, the receptacle 130 will be discussed with reference mainly to FIGS. 29 through 49.

The receptacle 130 is provided with three contact modules (two contact modules 131 and a contact module 132), a connecting bar 173 and a retainer 175 as relatively large elements of the receptacle 130.

First of all, the structures of the two contact modules 131 will be discussed hereinafter.

Among the three contact modules 131 and 132, each of the two contact modules 131 that are positioned on the laterally opposite sides of the contact module 132 is provided with two holding plates (side holding plates) 133 and 134, a holding plate (center holding plate) 138 positioned between the two holding plates 133 and 134, four ground contacts 165A and 165D and eight signal contacts 165B, 165C, 165E and 165F.

As shown in FIGS. 34 through 41, each of the holding plates 133, 134 and 138 is made of two resin members integrated into one member.

Figure 37:
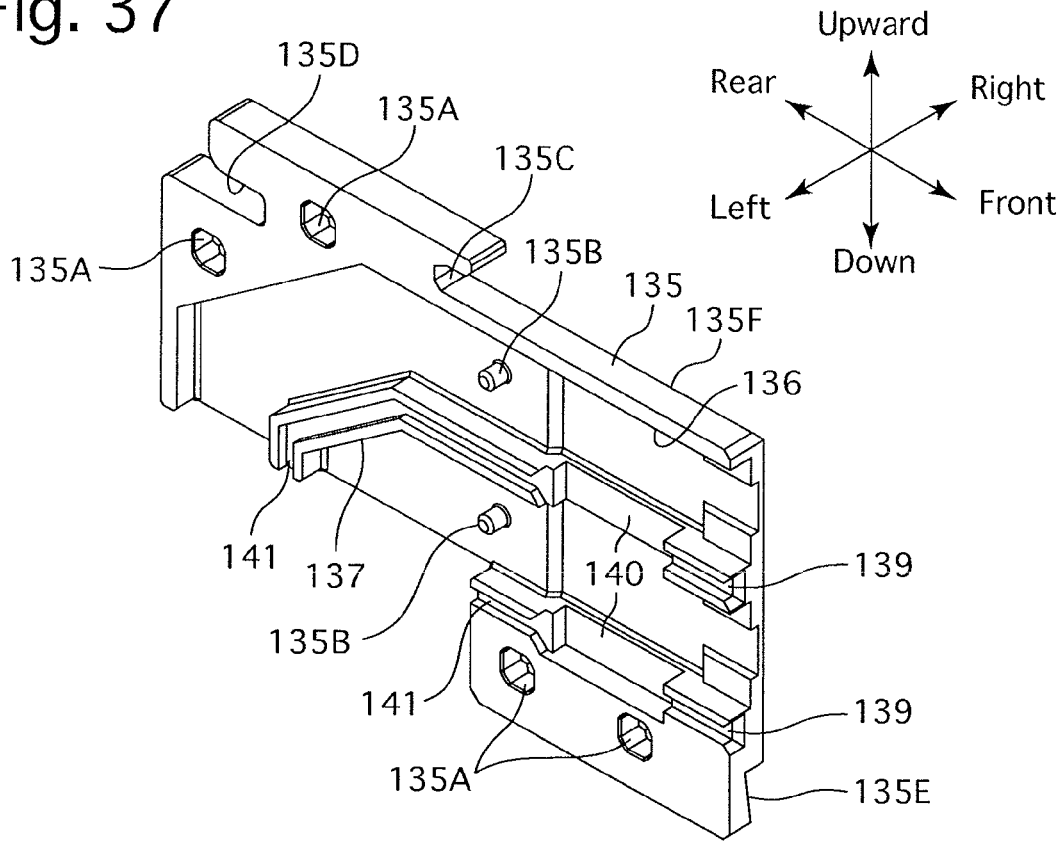
FIG. 37 is a perspective view of the conductive layer portion of the right-side holding plate of the side contact module shown in FIG. 35 in a state before an insulating portion is molded integrally with the conductive layer portion, viewed obliquely from the upper left side.

A conductive layer portion (conductive layer) 135 serving as a base of the holding plate 133 in each contact module 131 is made by firstly being molded of an insulating synthetic resin into the shape shown in FIG. 37 with the use of molding dies (not shown) and subsequently being entirely plated so as to constitute a continuous conductive layer. The method of applying such plating can be a so-called resin plating method or a thin-film forming method (evaporation method, spattering, etc.). In the case of the resin plating method, firstly a molded member (molding) serving as a substrate of the conductive layer portion 135 is subjected to firstly a grease removing process to remove grease from the outer surface of the molded member, a cleaning process to cleanse the outer surface of the molded member and thereafter a surface activating process to activate the outer surface of the molded member by catalysis. Thereafter, electroless plating, nickel strike plating, electric copper plating, nickel plating, and finish plating are applied to the molded member, in that order. Alternatively, the conductive layer portion 135 can be molded by a MID (molded interconnect device).

Figure 47:
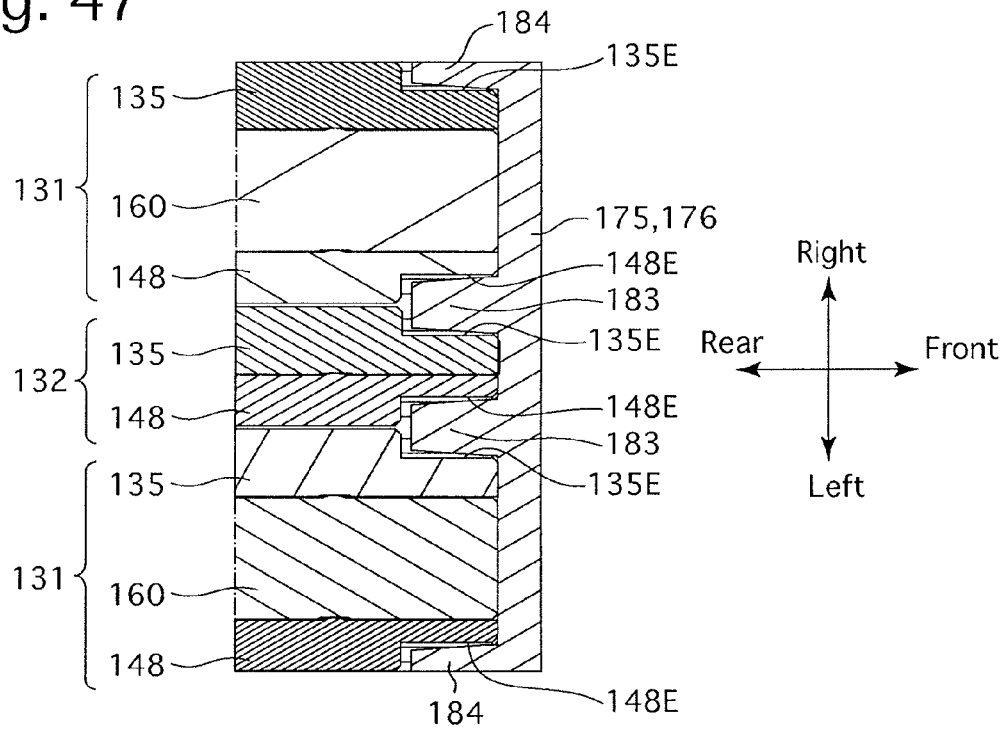
FIG. 47 is a cross sectional view taken along the XLVII-XLVII line shown in FIG. 46, viewed in the direction of the appended arrows.
Figure 48:
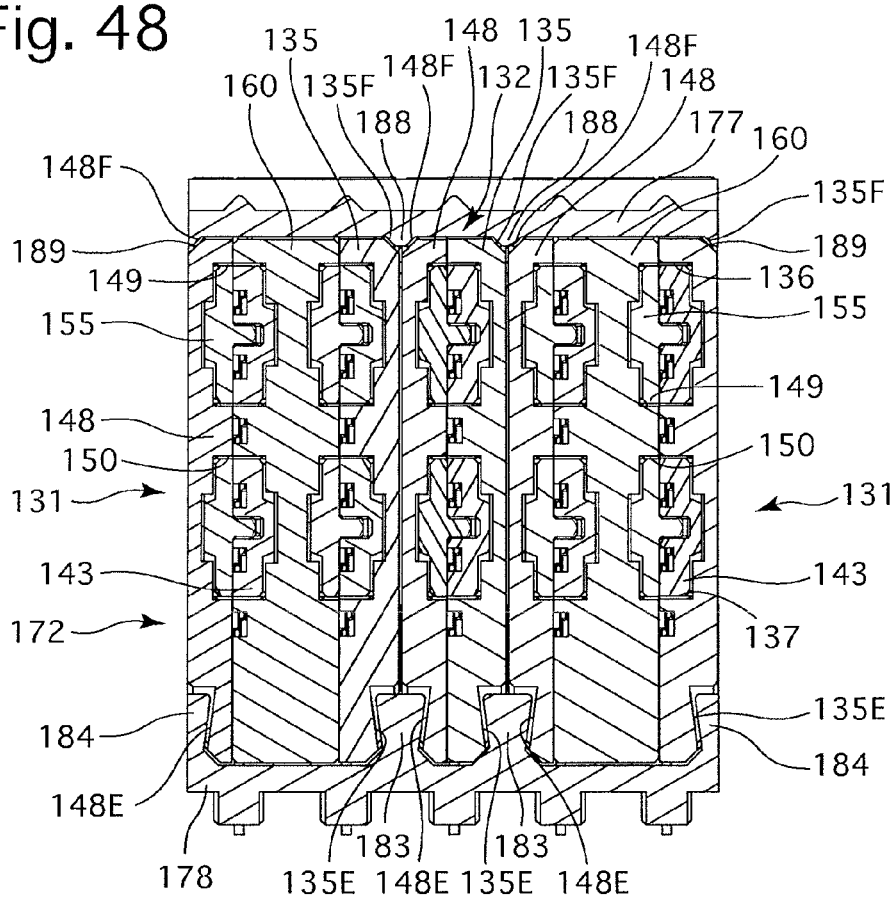
FIG. 48 is a cross sectional view taken along the XLVIII-XLVIII line shown in FIG. 46, viewed in the direction of the appended arrows.
Figure 49:
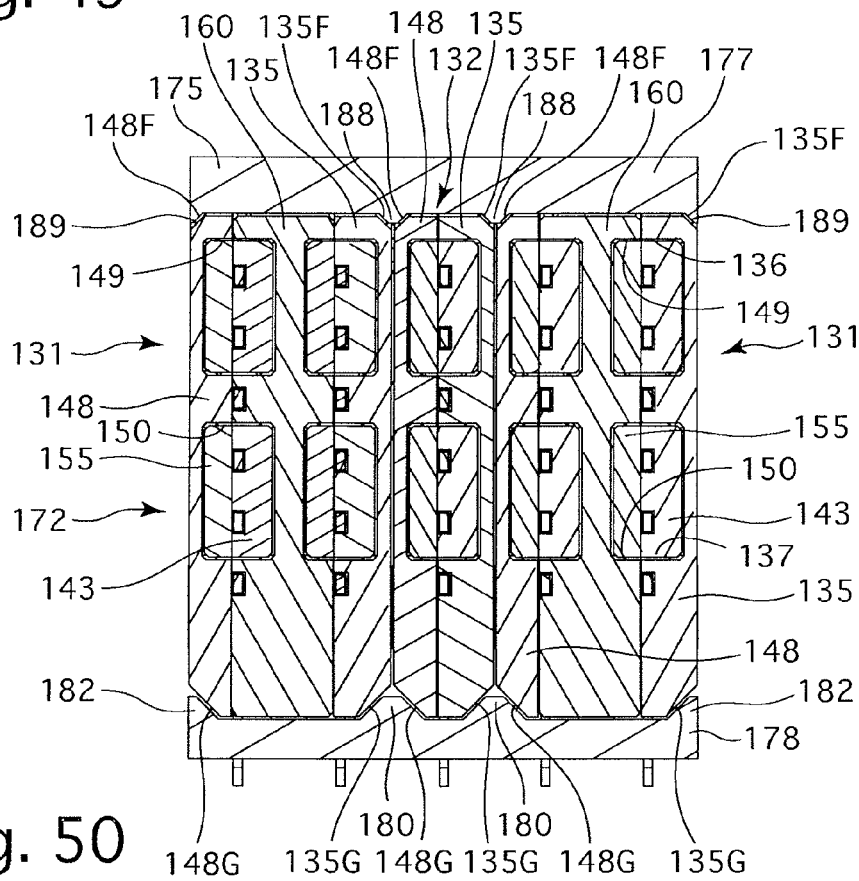
FIG. 49 is a cross sectional view taken along the XLIX-XLIX line shown in FIG. 46, viewed in the direction of the appended arrows.
Figure 50:
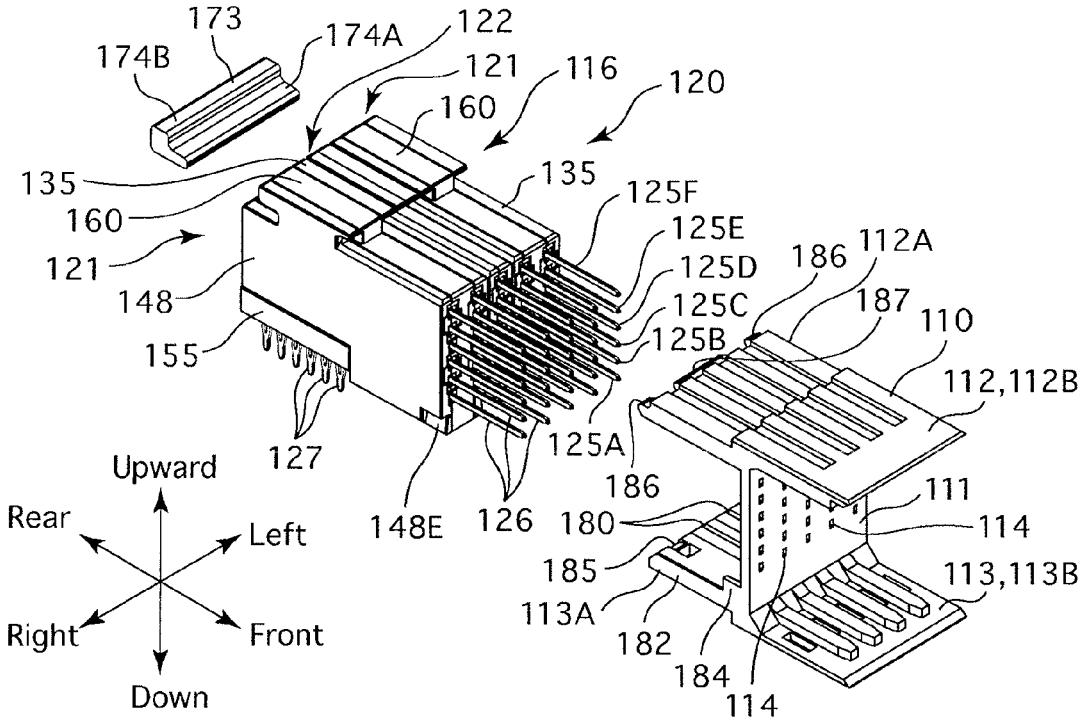
FIG. 50 is an exploded perspective view of the plug of the second embodiment of the connector, which is disassembled into three pieces: a contact module group, a retainer and a connecting rod, viewed obliquely from above.

As shown in the drawings, the conductive layer portion 135 is provided on the left side thereof with two insulation recesses 136 and 137 which are open to both the front end surface and the bottom end surface of the conductive layer portion 135. The conductive layer portion 135 is further provided, on two ribs formed on the left side of the conductive layer portion 135 which are respectively adjacent to the two insulation recesses 136 and 137, with two opening recesses 139, two end accommodation grooves (ground-contact holding grooves) 140 and two communication grooves (ground-contact holding grooves) 141, respectively. The two opening recesses 139 are elongated rearward from the front end surface of the conductive layer portion 135, the two end accommodation grooves 140 are communicatively connected to the rear ends of the two opening recesses 139 and are greater in width than the two opening recesses 139, respectively. The two communication grooves 141 extend from the two end accommodation grooves 140 to the rear ends of the aforementioned two ribs, respectively. Additionally, the conductive layer portion 135 is further provided on the left side thereof with four substantially circular-columnar-shaped engaging recesses 135A and two circular-columnar-shaped engaging pins 135B. The conductive layer portion 135 is further provided, at the upper front end and the upper rear end of the conductive layer portion 135, with a front engaging groove 135C and a rear engaging groove 135D, respectively. The conductive layer portion 135 is further provided, on the right side thereof in the vicinity of the bottom front corner of the conductive layer portion 135, with a key groove 135E having a rectangular shape as viewed from the right side of the conductive layer portion 135. As shown in FIGS. 47 and 48, the depth of each key groove 135E gradually increases in the direction from the bottom upwards. Namely, the bottom surface of the key groove 135E (a portion of the right side of the conductive layer portion 135 in the key groove 125E) is formed as a beveled surface. An upper edge 135F and a lower edge 135G of the front half of the right side of the conductive layer portion 135 are chamfered as shown in FIGS. 48 and 49.

Figure 34:
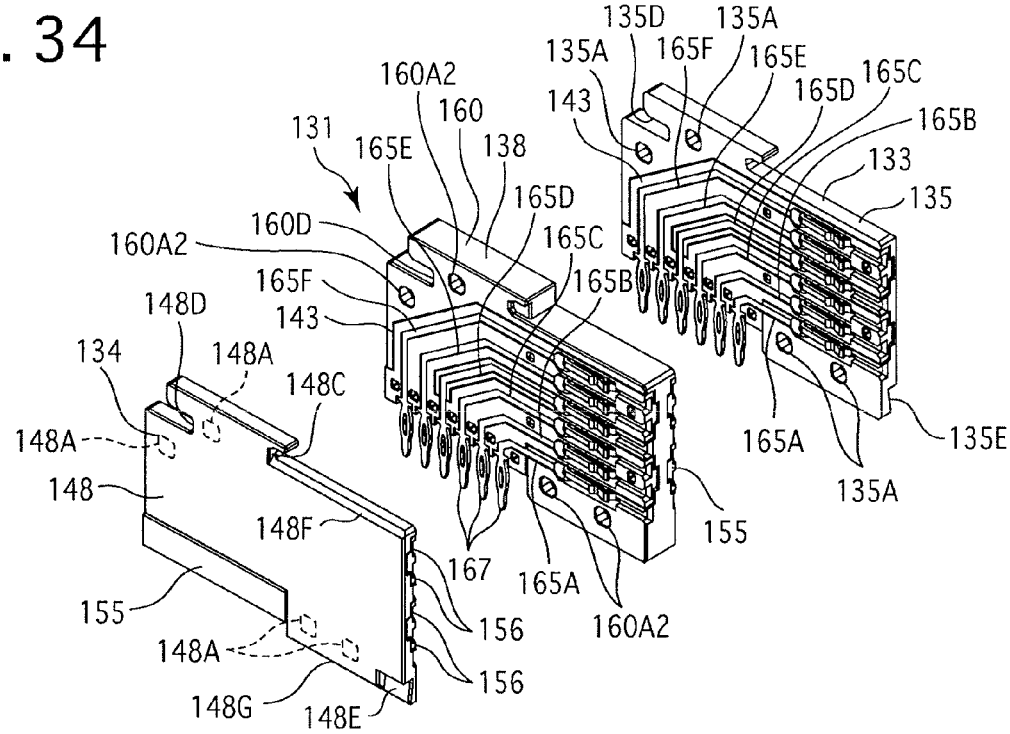
FIG. 34 is an exploded perspective view of each side contact module shown in FIG. 33.
Figure 35:
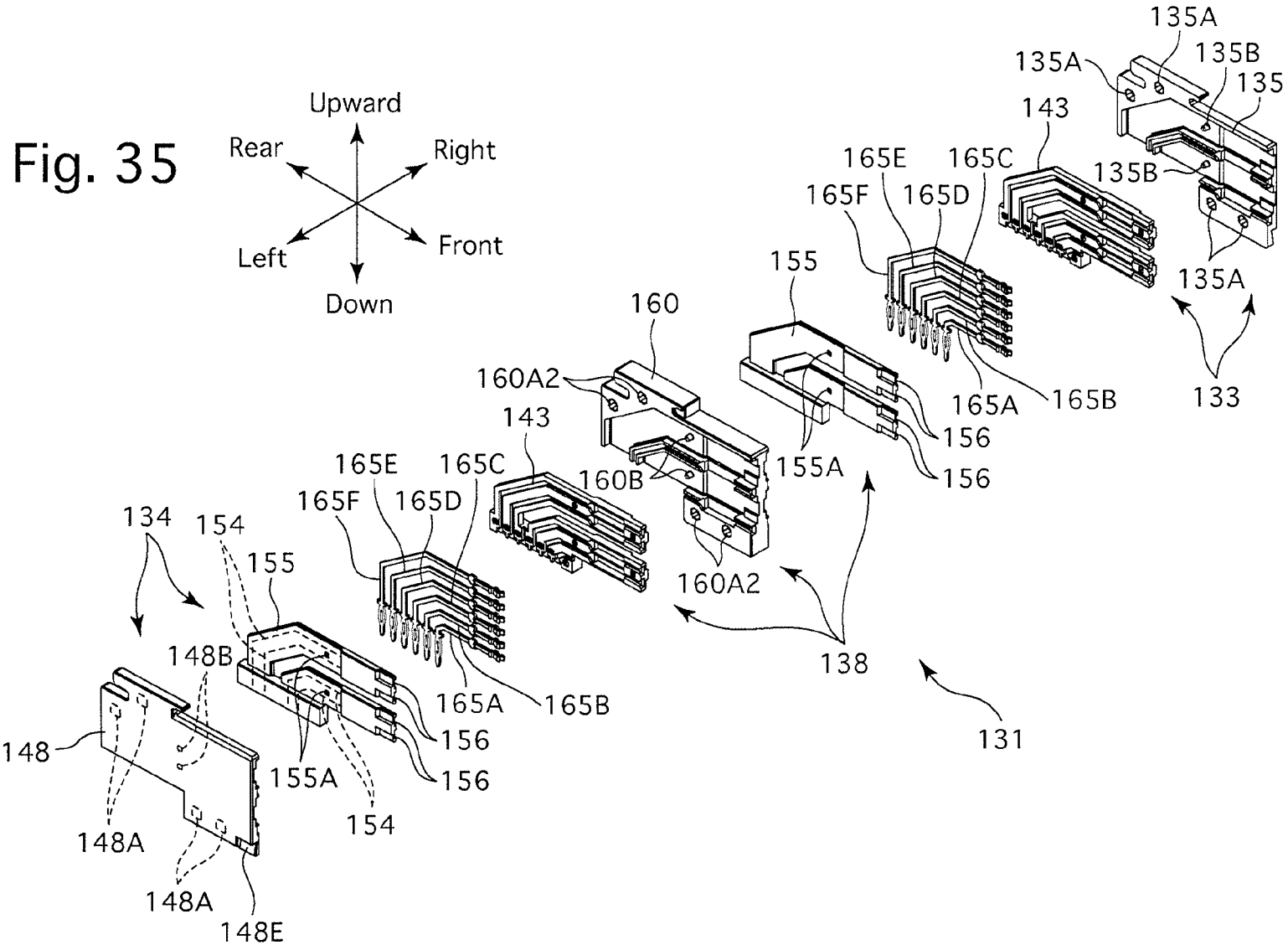
FIG. 35 is an exploded perspective view of each side contact module shown in FIG. 33.
Figure 40:
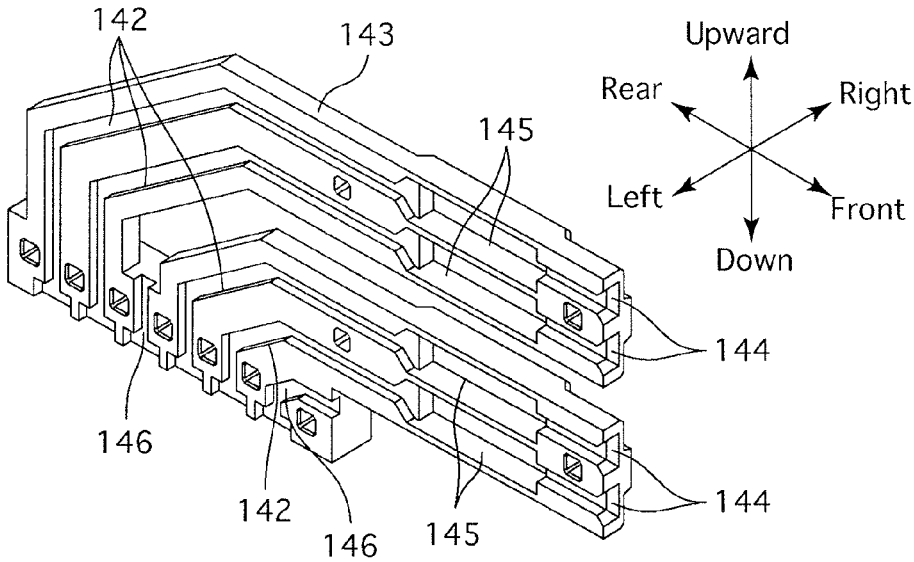
FIG. 40 is an enlarged front perspective view of an insulating portion shown in FIG. 35, viewed obliquely from the upper left side thereof.
Figure 41:
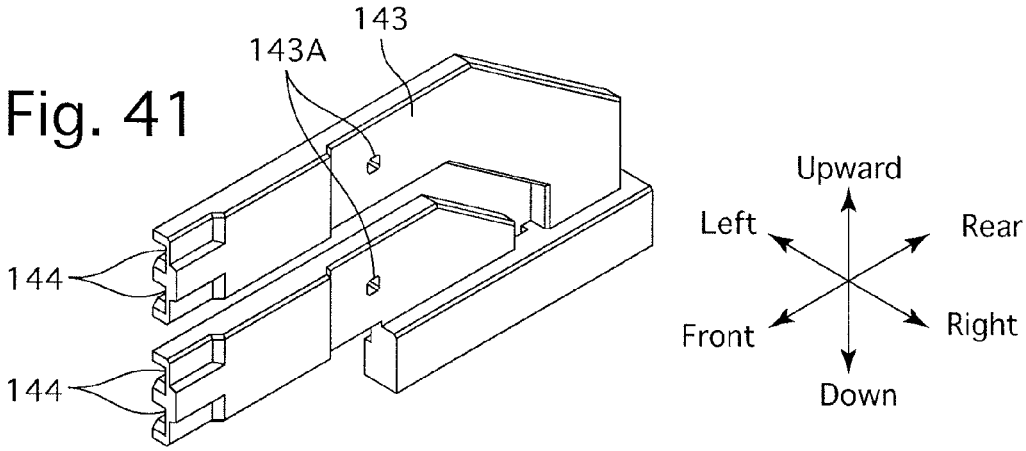
FIG. 41 is an enlarged front perspective view of the insulating portion shown in FIG. 40, viewed obliquely from the upper right side thereof.
Figure 42:
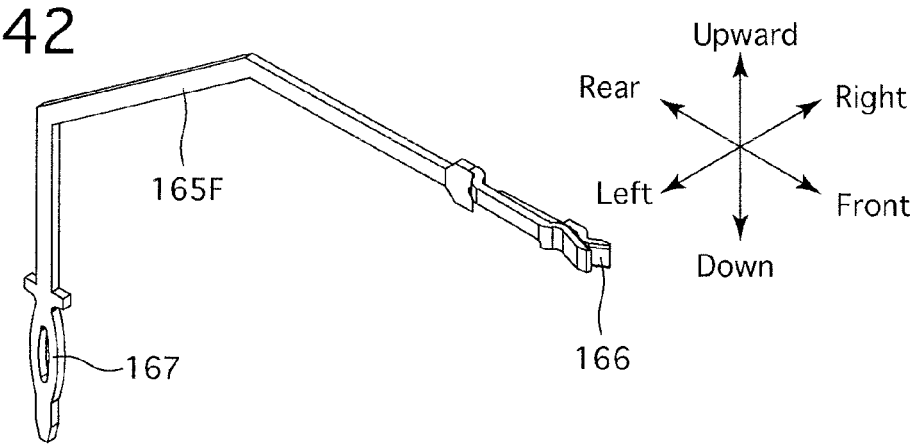
FIG. 42 is an enlarged perspective view of a contact (signal contact) of the second embodiment of the connector, viewed obliquely from the upper left side.
Figure 43:
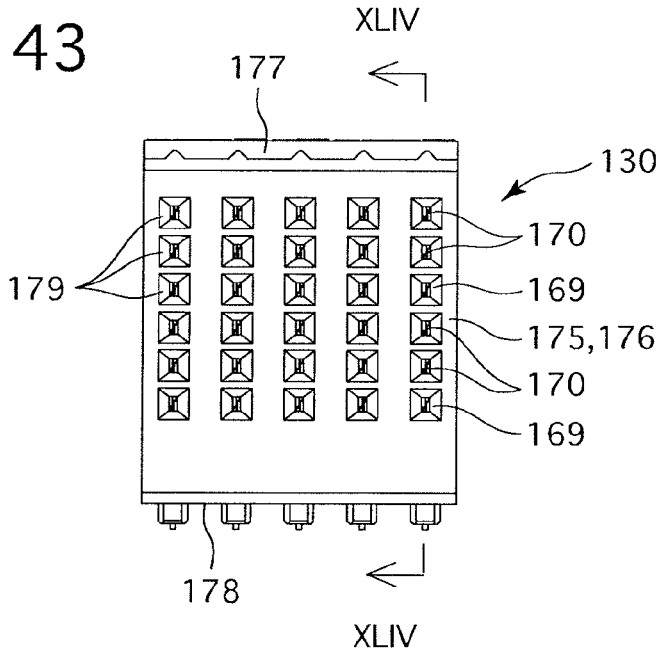
FIG. 43 is a front elevational view of the receptacle of the second embodiment of the connector.

An insulating portion 143 made of an insulating synthetic resin is fitted into the left side of the conductive layer portion 135, which is molded in the above described manner as shown in FIG. 34, etc. The insulating portion 143 is molded with the use of molding dies (not shown) separately from the conductive layer portion 135. As shown in FIG. 40, the insulating portion 143 is provided on the left side thereof with four opening recesses 144, associated four end accommodation grooves (contact holding grooves) 145, four communication grooves (contact holding grooves) 142 and two communication grooves (contact holding grooves) 146. The four opening recesses 144 are identical in shape to the two opening recesses 139. The four end accommodation grooves 145 are identical in shape to the two end accommodation grooves 140 and communicatively connected to the rear ends of the four opening recesses 144. The four communication grooves 142 extend from the rear ends of the of the four end accommodation grooves 145 to the bottom end of the insulating portion 143, respectively. The insulating portion 143 is provided, on surfaces of on the right side thereof which face the associated conductive layer portion 135, with two engaging recesses 143A (see FIG. 41) in which the engaging pins 135B of the associated conductive layer portion 135 can be engaged, respectively. The insulating portion 143 that has the above described structure becomes integral with the conductive layer portion 135 by fitting a substantially upper half portion of the insulating portion 143 into the two insulation recesses 136 and 137 of the conductive layer portion 135 while fitting the two engaging pins 135B into the two engaging recesses 143A, respectively.

The two holding plates 133 and 134 of each contact module 131 are substantially bilaterally symmetrical in shape; however, the holding plate 134 is partly different in shape from the holding plate 133.

A conductive layer portion (conductive layer) 148 of the holding plate 134 is an element corresponding to the conductive layer portion 135 of the holding plate 133 (the material of the conductive layer portion 148 (including the material of plating) is the same as that of the conductive layer portion 135). The conductive layer portion 148 is molded with the use of molding dies (not shown) in the same manner as the conductive layer portion 135. The conductive layer portion 148 is provided, on the right side thereof at positions thereon which correspond to the positions of the two insulation recesses 136 and 137, with two insulation recesses 149 and 150. The two insulation recesses 149 and 150 and the two insulation recesses 136 and 137 are bilaterally symmetrical to each other (are mirror images to each other), respectively. The conductive layer portion 148 is further provided, on the right side thereof at positions thereon which correspond to the positions of the two opening recesses 139, the two end accommodation grooves 140 and the two communication grooves 141, with two opening-forming projecting portions 151, intermediate recessed portions 152 and two pressure ribs 153, respectively. One of the two pressure ribs 153 projects from the surface of a rib on the right side of the conductive layer portion 148 between the two insulation recesses 149 and 150, while the other of the two pressure ribs 153 projects from a portion on the right side of the conductive layer portion 148 directly below the insulation recess 150. Although none of the accompanying drawings shows the right side of the conductive layer portion 148, the two insulation recesses 149 and 150, the two opening-forming projecting portions 151, the intermediate recessed portions 152 and the two pressure ribs 153, which are formed on the right side of the conductive layer portion 148, are identical in shape and size to those formed on the right side of a conductive layer portion (conductive layer) 160 serving as a base of the holding plate 138 in each contact module 131. Accordingly, FIGS. 36 and 38 can be alternatively referred to with regard to the elements formed on the right side of the conductive layer portion 148, which show the right side of the conductive layer portion 160.

Figure 33:
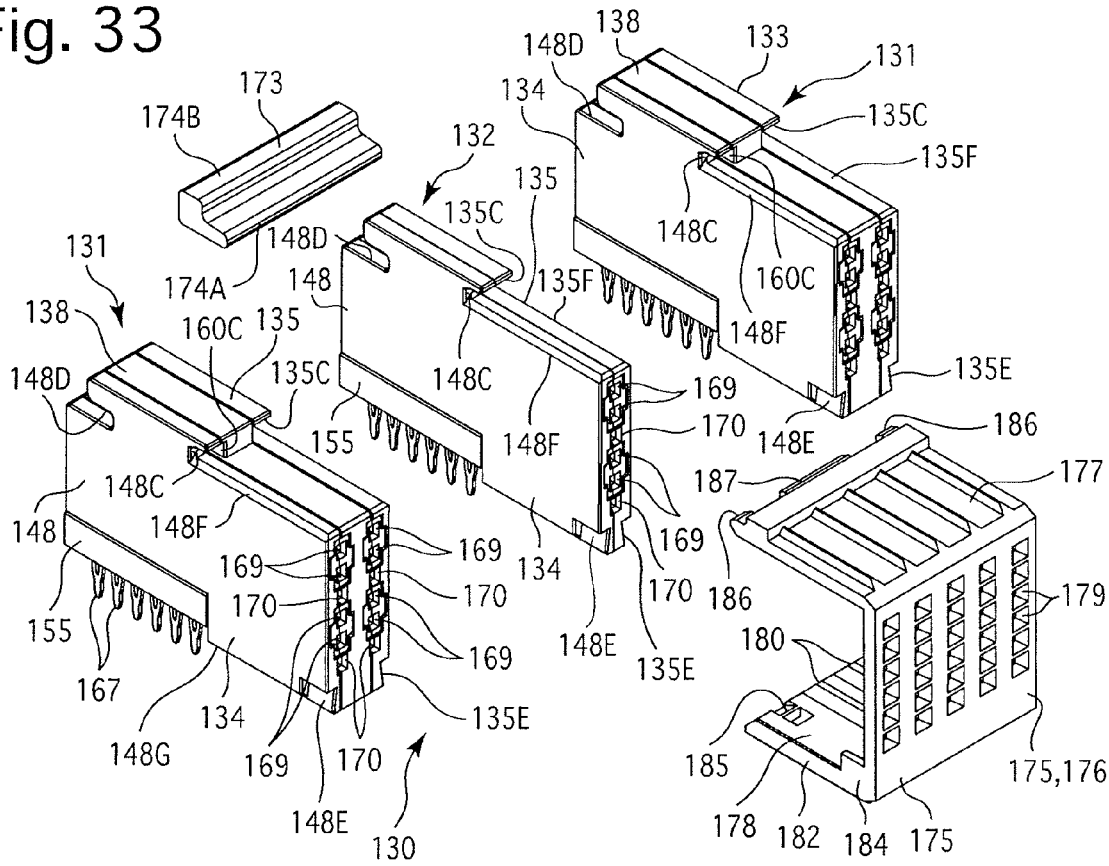
FIG. 33 is an exploded front perspective view of the receptacle of the second embodiment of the connector, which is disassembled into five pieces: two side contact modules, a center contact module, a retainer and a connecting rod, viewed obliquely from above.

The conductive layer portion 148 is provided with a front engaging groove 148C and a rear engaging groove 148D which correspond to the engaging groove 135C and the rear engaging groove 135D of the conductive layer portion 135, respectively. The conductive layer portion 148 is provided, on the right side at positions thereon which correspond to the positions of the four engaging recesses 135A, with four engaging projections 148A (see FIGS. 34 and 35), respectively, and is further provided, on the right side of the conductive layer portion 148 at positions thereon which correspond to the positions of the two engaging pins 135B, with two engaging pins 148B having the same shapes as the two engaging pins 135B, respectively (see FIG. 35). The conductive layer portion 148 is provided, on the left side thereof in the vicinity of the bottom front corner of the conductive layer portion 148, with a key groove 148E which is bilaterally symmetrical shaped with respect to the key groove 135E. An upper edge 148F and a lower edge 148G of the front half of the left side of the conductive layer portion 148 are chamfered as shown in FIGS. 33, 48 and 49.

An insulating portion 155 made of an insulating synthetic resin is fitted into the right side of the conductive layer portion 148. The insulating portion 155 is molded with the use of molding dies (not shown) separately from the conductive layer portion 148 (the material of the insulating portion 155 and the method of molding thereof are the same as those of the insulating portion 143).

The insulating portion 155 is provided on the right side thereof with four opening recesses 156 (see FIGS. 34 and 35) which correspond to the four opening recesses 144, respectively, that are formed on the insulating portion 143 of the holding plate 133. The insulating portion 155 is further provided on the right side thereof with associated four end accommodation grooves (not shown) which correspond to the four end accommodation grooves 145, respectively. On the other hand, although no communication grooves corresponding to the communication grooves 142 of the insulating portion 143 are formed on the insulating portion 155, the insulating portion 155 is provided, on portions thereof which face the four communication grooves 142, with four pressure ribs 154 which are substantially identical in side shape to the four communication grooves 142, respectively (see FIG. 35). The insulating portion 155 is further provided on the left side thereof with two engaging recesses 155A which correspond to the two engaging recesses 143A of the insulating portion 143, respectively (see FIG. 35).

Figure 36:
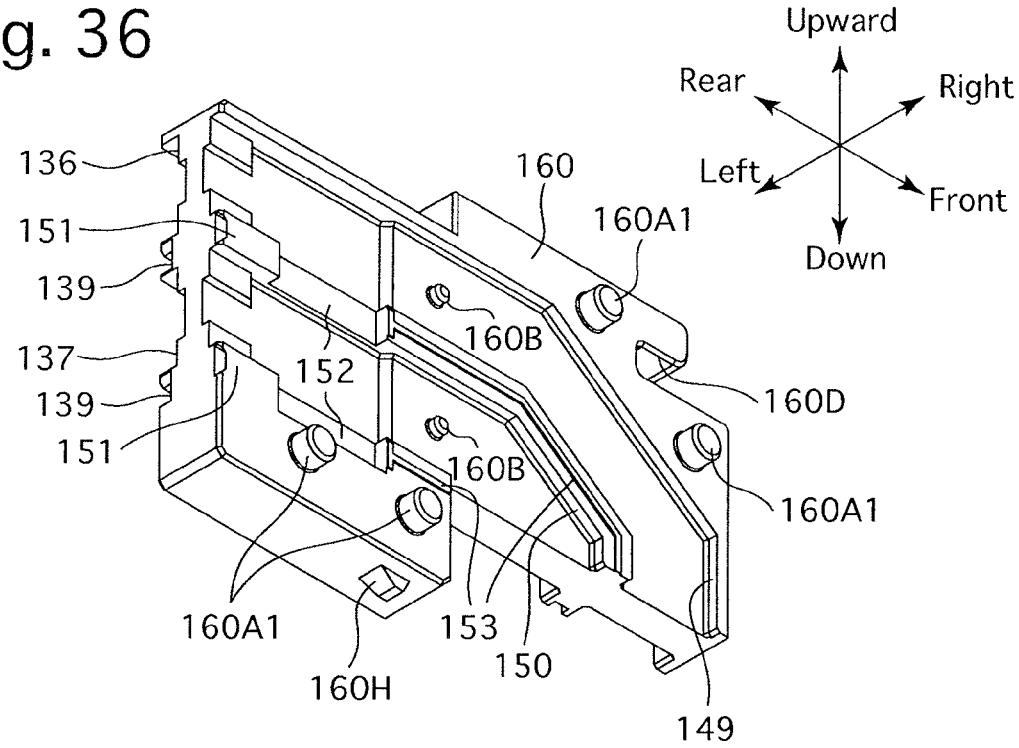
FIG. 36 is a perspective view of the conductive layer portion of the center holding plate of the side contact module shown in FIG. 35 in a state before an insulating portion is molded integrally with the conductive layer portion, viewed obliquely from below.
Figure 38:
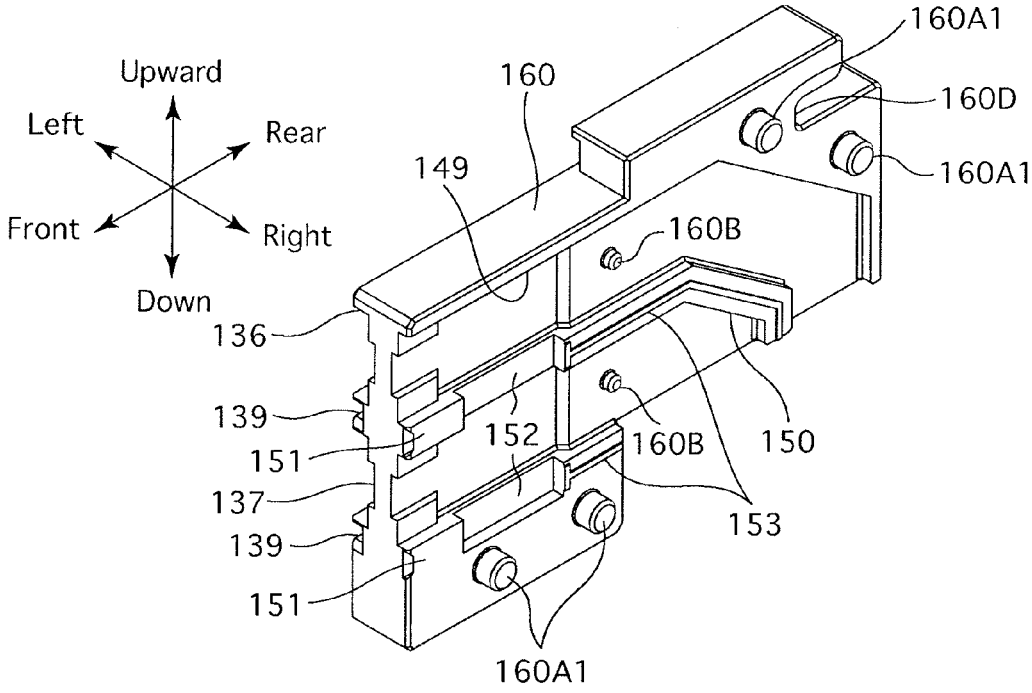
FIG. 38 is a perspective view of the conductive layer portion shown in FIG. 36, viewed obliquely from the upper right side.
Figure 39:
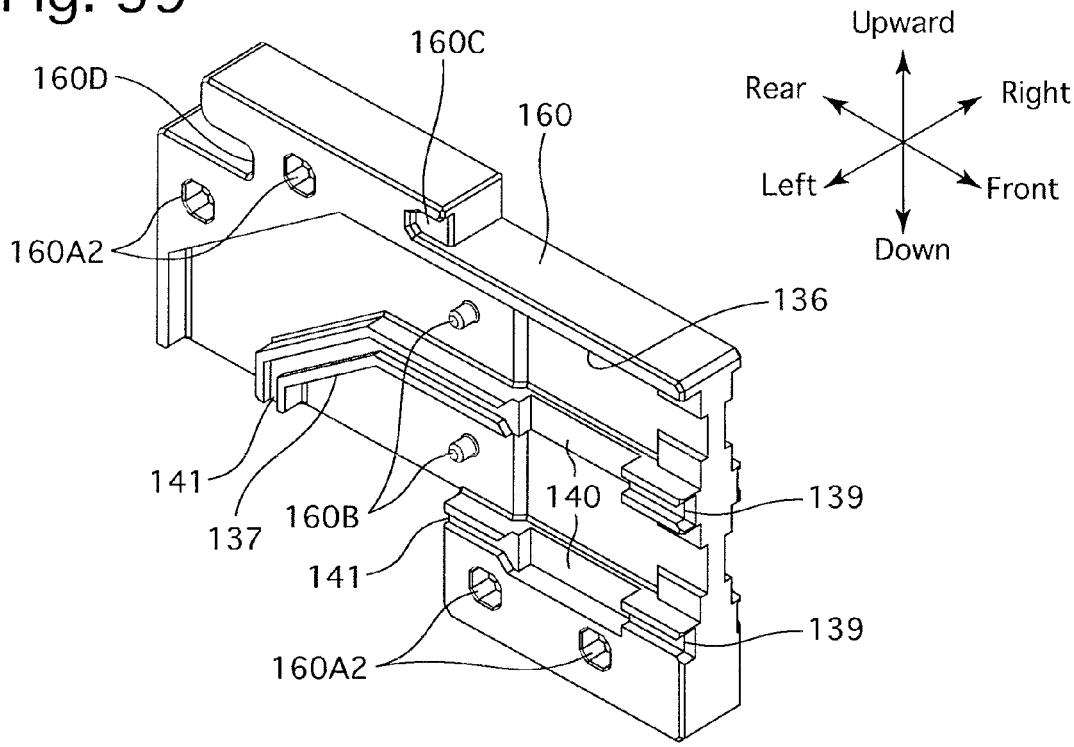
FIG. 39 is a perspective view of the conductive layer portion shown in FIG. 36, viewed obliquely from the upper left side.

The shape of the conductive layer portion 160 of the holding plate 138, which is held between the holding plates 133 and 134, is shown in FIGS. 36, 38 and 39. The material of the conductive layer portion 160 (including the material of plating) is the same as those of the conductive layer portions 135 and 148. The conductive layer portion 160 is molded with the use of molding dies (not shown) in the same manner as the conductive layer portion 135 and 148.

As shown in FIG. 38, the conductive layer portion 160 is provided on the right side thereof with two insulation recesses 149 and 150, two opening-forming projecting portions 151, intermediate recessed portions 152 and two pressure ribs 153, which are identical in shape and size to those formed on the conductive layer portion 148. One of the two pressure ribs 153 projects from the surface of a rib on the right side of the conductive layer portion 160 between the two insulation recesses 149 and 150, while the other of the two pressure ribs 153 projects from a portion on the right side of the conductive layer portion 160 directly below the insulation recess 150 (a portion on the right side of the conductive layer portion 160 in the vicinity of one of four engaging projections 160A1 that project from the right side of the conductive layer portion 160). The conductive layer portion 160 is further provided, at positions on the right side thereon which face the positions of the four engaging recesses 135A, with four engaging projections 160A1 engageable in the four engaging recesses 135A, respectively, and is further provided, at positions on the right side thereon which face the positions of the two engaging pins 135B, with two engaging pins 160B having the same shapes as the two engaging pins 135B, respectively. As shown in FIG. 39, the conductive layer portion 160 is provided on the left side thereof with two insulation recesses 136 and 137, two opening recesses 139, two end accommodation grooves 140 and two communication grooves 141. Additionally, the conductive layer portion 160 is provided, at positions on the left side thereof which correspond to the positions of the four engaging projections 160A1, with four engaging recesses 160A2, respectively, and is further provided, at positions on the left side of the conductive layer portion 160 which correspond to the positions of the two engaging pins 143A, with two engaging pins 160B, respectively. The conductive layer portion 160 is provided, on the left side thereof at the upper front end of the conductive layer portion 160, with a front engaging groove 160C, and is provided, at the upper rear end of the conductive layer portion 160, with a rear engaging groove 160D. As shown in FIG. 36, the conductive layer portion 160 is provided on the bottom surface thereof with a locking lug 160H.

After the conductive layer portion 160 is molded, the insulating portions 155 and 143, which are molded separately from the conductive layer portion 160, are fitted into the right and left sides of the conductive layer portion 160 to become integral therewith, which completes the holding plate 138.

Note that the side edges (upper and lower side edges) of each insulating portion 143 and 155 in each associated insulation recess (136, 137, 149 and 150) are covered by the associated conductive layer.

A set of six contacts are held between the insulating portion 143 of the holding plate 133 and the insulating portion 155 of the holding plate 138, and another set of six contacts are held between the insulating portion 155 of the holding plate 134 and the insulating portion 143 of the holding plate 138. Each of these two sets of contacts is composed of two ground contacts 165A and 165D and four signal contacts 165B, 165C, 165E and 165F. The two ground contacts 165A and 165D and the four signal contacts 165B, 165C, 165E and 165F are stamp molded out of metal. More specifically, to make each contact 165A through 165F, a base material (e.g., phosphor bronze, beryllium copper, titanium copper, stainless steel, or Corson-copper alloy) is coated firstly with a base plating (e.g., nickel (Ni) plating) and subsequently with a finish plating (e.g., gold(Au) plating, tin(Sn)-copper(Cu) plating, or tin(Sn)-lead(Pb) plating). The side shapes of the ground contacts 165A and 165D and the signal contacts 165B, 165C, 165E and 165F are all in the shape of a substantially letter L and mutually different in length. The front ends and the lower ends of all the ground contacts 165A and 165D and the signal contacts 165B, 165C, 165E and 165F are formed as bifurcated resilient (spring) portions 166 and press-fit terminals 167, respectively.

One set of six contacts (the ground contacts 165A and 165D, and the signal contacts 165B, 165C, 165E and 165F) (hereinafter referred to as a first set of contacts), another set of six contacts (the ground contacts 165A and 165D, and the signal contacts 165B, 165C, 165E and 165F) (hereinafter referred to as a second set of contacts) and the two of the holding plates 133, 134 and 138 are combined into one with these two sets of six contacts being held between the two holding plates 133 and 138 and between the two holding plates 134 and 138, respectively, in the following manner.

Firstly, the bifurcated resilient portions 166 of the ground contacts 165A and 165D of the first set of contacts are accommodated in the two end accommodation grooves 140 of the conductive layer portion 135 of the holding plate 133, respectively, and middle portions (conductive positions) of the ground contacts 165A and 165D of the first set of contacts between the bifurcated resilient portions 166 and the press-fit terminals 167 thereof are respectively held by the two communication grooves 141 of the conductive layer portion 135 of the holding plate 133 and the communication grooves 146 of the insulating portion 143 so that the press-fit terminals 167 of the ground contacts 165A and 165D of the first set of contacts project downward from the bottom end of the holding plate 133. On the other hand, the bifurcated resilient portions 166 of the ground contacts 165A and 165D of the second set of contacts are accommodated in the two end accommodation grooves 140 of the conductive layer portion 160 of the holding plate 138, respectively, and middle portions (conductive positions) of the ground contacts 165A and 165D of the second set of contacts between the bifurcated resilient portions 166 and the press-fit terminals 167 thereof are respectively held by the two communication grooves 141 of the conductive layer portion 160 of the holding plate 138 so that the press-fit terminals 167 of the ground contacts 165A and 165D of the second set of contacts project downward from the bottom end of the holding plate 138. At the same time, the bifurcated resilient portions 166 of the signal contacts 165B, 165C, 165E and 165F of the first set of contacts are accommodated in the four end accommodation grooves 145 of the insulating portion 143 of the holding plate 133, respectively, and middle portions (conductive positions) of the signal contacts 165B, 165C, 165E and 165F of the first set of contacts between the bifurcated resilient portions 166 and the press-fit terminals 167 thereof are respectively held by the two communication grooves 142 of the insulating portion 143 of the holding plate 133 so that the press-fit terminals 167 of the signal contacts 165B, 165C, 165E and 165F of the first set of contacts project downward from the bottom end of the holding plate 133. On the other hand, the bifurcated resilient portions 166 of the signal contacts 165B, 165C, 165E and 165F of the second set of contacts are accommodated in the four end accommodation grooves 145 of the insulating portion 143 of the holding plate 138, respectively, and middle portions (conductive positions) of the signal contacts 165B, 165C, 165E and 165F of the second set of contacts between the bifurcated resilient portions 166 and the press-fit terminals 167 thereof are respectively held by the two communication grooves 142 of the insulating portion 143 of the holding plate 138 so that the press-fit terminals 167 of the signal contacts 165B, 165C, 165E and 165F of the second set of contacts project downward from the bottom end of the holding plate 138.

Figure 44:
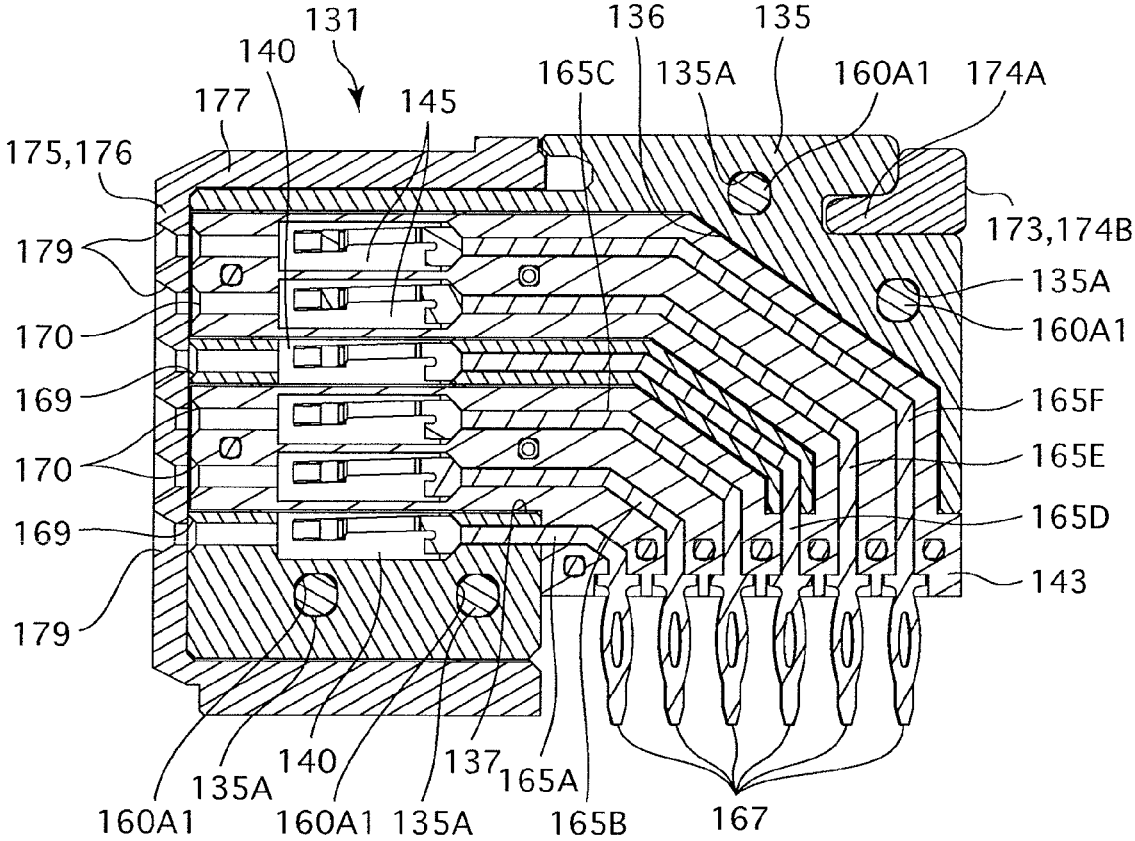
FIG. 44 is a cross sectional view of the receptacle of the second embodiment of the connector taken along the XLIV-XLIV line shown in FIG. 43, viewed in the direction of the appended arrows.
Figure 45:
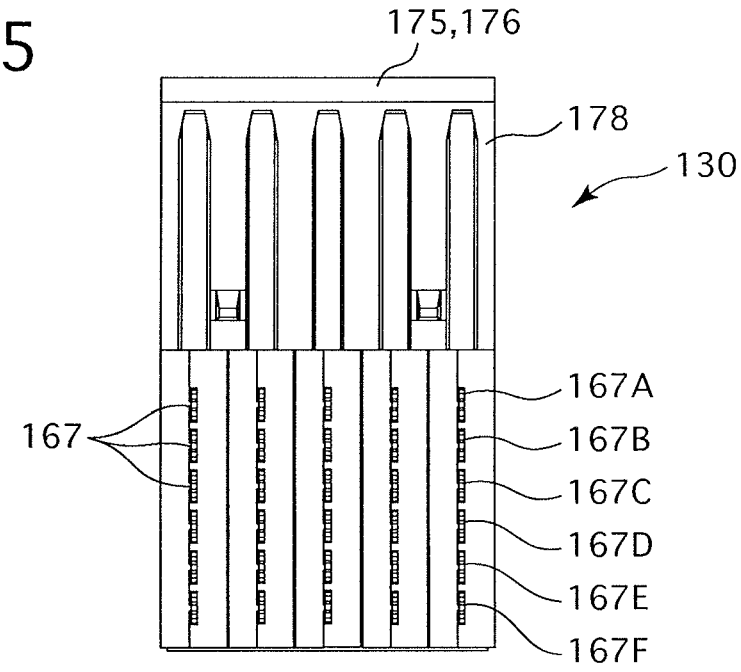
FIG. 45 is a bottom view of the receptacle of the second embodiment of the connector.
Figure 46:
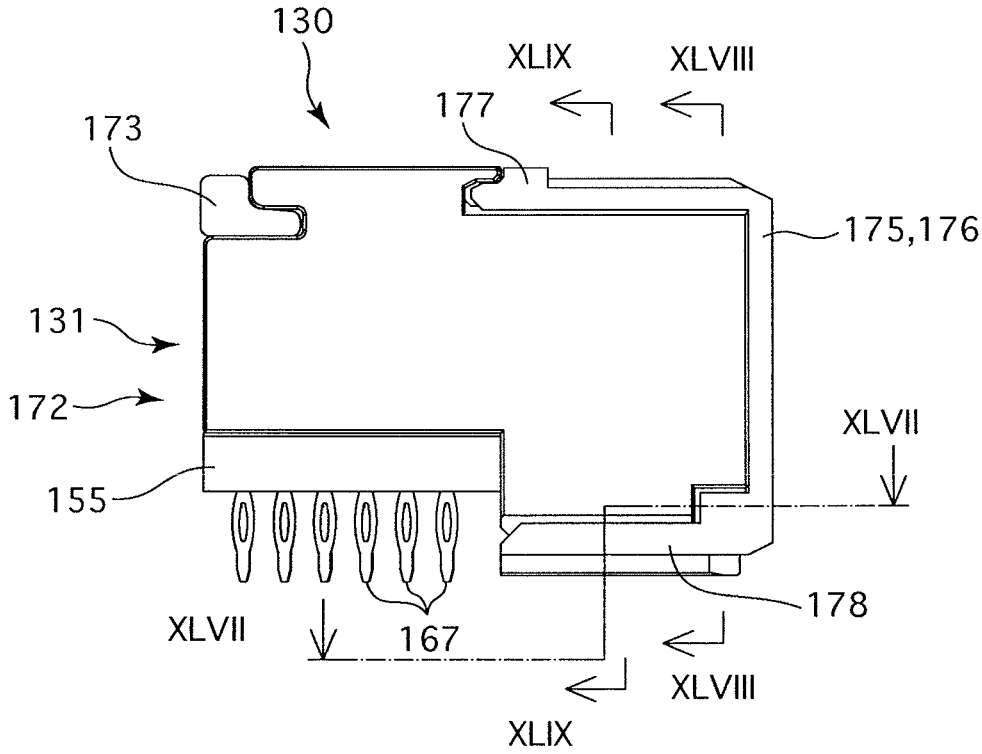
FIG. 46 is a side elevational view of the receptacle of the second embodiment of the connector.

Furthermore, the right side of the holding plate 138 (which includes the conductive layer portion 160 and the insulating portion 155) is combined with the left side of the holding plate 133 (which includes the conductive layer portion 135 and the insulating portion 143) to which the ground contacts 165A and 165D and the signal contacts 165B, 165C, 165E and 165F have been installed, and the right side of the holding plate 134 (which includes the conductive layer portion 148 and the insulating portion 155) is combined with the left side of the holding plate 138 (which includes the conductive layer portion 160 and the insulating portion 143). At this time, the four engaging projections 160A1 of the conductive layer portion 160 are fitted into the four engaging recesses 135A of the conductive layer portion 135, respectively, and the four engaging projections 148A of the conductive layer portion 148 are fitted into the four engaging recesses 160A2 of the conductive layer portion 160, respectively. Thereupon, the right side of the insulating portion 155 of the holding plate 134 comes into intimate contact with the left side of the insulating portion 143 of the holding plate 138, the right side of the insulating portion 155 of the holding plate 138 comes into intimate contact with the left side of the insulating portion 143 of the holding plate 133, the right side of the conductive layer portion 148 comes into intimate contact with the left side of the conductive layer portion 160, and the right side of the conductive layer portion 160 comes into intimate contact with the left side of the conductive layer portion 135. Additionally, the four opening recesses 144 of each insulating portion 143 and the four opening recesses 156 of the associated insulating portion 155, which face each other, form four engaging holes 169 at the front ends of the insulating portions 143 and 155 (see FIGS. 29 and 33). Likewise, the two opening recesses 139 of the conductive layer portion 135 and the two opening-forming projecting portions 151 of the conductive layer portion 160 (with the two opening-forming projecting portions 151 blocking the left-side openings of the two opening recesses 139) form two engaging holes 170 at the front end of the contact module 131 (specifically at the front ends of the conductive layer portions 135 and 160), and the two opening recesses 139 of the conductive layer portion 160 and the two opening-forming projecting portions 151 of the conductive layer portion 148 form two engaging holes 170 at the front end of the contact module 131 (specifically at the front ends of the conductive layer portions 148 and 160) (see FIGS. 29 and 33). Additionally, as shown in FIG. 44, the bifurcated resilient portions 166 of the signal contacts 165B, 165C, 165E and 165F of the first set of contacts are respectively accommodated in the spaces formed between the four end accommodation grooves 145 on the insulating portion 143 of the holding plate 133 and the aforementioned four end accommodation grooves (not shown) on the insulating portion 155 of the holding plate 138, respectively. Likewise, the bifurcated resilient portions 166 of the signal contacts 165B, 165C, 165E and 165F of the second set of contacts are respectively accommodated in the spaces formed between the four end accommodation grooves 145 on the insulating portion 143 of the holding plate 138 and the aforementioned four end accommodation grooves (not shown) on the insulating portion 155 of the holding plate 134, respectively. Additionally, the upper pressure rib 153 (narrower in width than the grand contact 165D) on the right side of the conductive layer portion 160 of each contact module 131 is in press contact with the left side of the ground contact 165D of the first set of contacts while the right side of this ground contact 165D is in press contact with the bottom surface (left side) of the associated communication recess (contact holding recess) 141 of the conductive layer portion 135. Likewise, the lower pressure rib 153 on the right side of the conductive layer portion 160 of each contact module 131 is in press contact with the left side of the ground contact 165A of the first set of contacts while the right side of the same ground contact 165A is in press contact with the bottom surface of the associated communication recess 141 of the conductive layer portion 135. Similarly, the upper pressure rib 153 on the right side of the conductive layer portion 148 of each contact module 131 is in press contact with the left side of the ground contact 165D of the second set of contacts while the right side of the same ground contact 165D is in press contact with the bottom surface of the associated communication recess (contact holding recess) 141 of the conductive layer portion 160. Likewise, the lower pressure rib 153 on the right side of the conductive layer portion 148 of each contact module 131 is in press contact with the left side of the ground contact 165A of the second set of contacts while the right side of the same ground contact 165A is in press contact with the bottom surface of the associated communication recess 141 of the conductive layer portion 160. Accordingly, electrical continuity is securely established between the ground contacts 165A and 165D of the first set of contacts and the conductive layer portions 135 and 160 while electrical continuity is securely established between the ground contacts 165A and 165D of the second set of contacts and the conductive layer portions 148 and 160, respectively. Moreover, the signal contacts 165B, 165C, 165E and 165F of the first set of contacts are held between the bottom surfaces (left sides) of the communication grooves (contact holding grooves) 142 of the insulating portion 143 of the holding plate 133 and the four pressure ribs 154 on the right side of the insulating portion 155 of the holding plate 138, respectively, to be in contact with both the bottom surfaces (left sides) of the same communication grooves (contact holding grooves) 142 and the same four pressure ribs 154, and the signal contacts 165B, 165C, 165E and 165F of the second set of contacts are held between the bottom surfaces (left sides) of the communication grooves (contact holding grooves) 142 of the insulating portion 143 of the holding plate 138 and the four pressure ribs 154 on the right side of the insulating portion 155 of the holding plate 134, respectively, to be in contact with both the bottom surfaces (left sides) of the same communication grooves (contact holding grooves) 142 and the same four pressure ribs 154.

Hence, each of the two contact modules 131 (the right contact module 131 and the left contact module 131) are assembled in the above described manner.

The structures of the contact module 132, which is held between the two contact modules 131, will be discussed hereinafter.

The contact module 132 is assembled by joining the left side of the holding plate 133 (which includes the conductive layer portion 135 and the insulating portion 143) and the right side of the holding plate 134 (which includes the conductive layer portion 148 and the insulating portion 155) to each other with a set of six contacts (the two grand contacts 165A and 165D and the four signal contacts 165B, 165C, 165E and 165F) being held between the holding plates 133 and 134. Upon the contact module 132 being assembled in this manner, the four engaging holes 169 and the two engaging holes 170 are formed at the front end of the contact module 132 (see FIGS. 29 and 33).

The manner of assembling the contact module 132 is similar to the manner of assembling each contact module 131.

Namely, in the first place, the bifurcated resilient portions 166 of the ground contacts 165A and 165D are accommodated in the two end accommodation grooves 140 of the conductive layer portion 135 of the holding plate 133, respectively, and middle portions (conductive positions) of the ground contacts 165A and 165D between the bifurcated resilient portions 166 and the press-fit terminals 167 thereof are respectively held by the two communication grooves 141 of the conductive layer portion 135 of the holding plate 133 and the communication grooves 146 of the insulating portion 143 so that the press-fit terminals 167 of the ground contacts 165A and 165D project downward from the bottom end of the conductive layer portion 135 of the holding plate 133. Additionally, the bifurcated resilient portions 166 of the signal contacts 165B, 165C, 165E and 165F are accommodated in the four end accommodation grooves 145 of the insulating portion 143 of the holding plate 133, respectively, and middle portions (conductive positions) of the signal contacts 165B, 165C, 165E and 165F between the bifurcated resilient portions 166 and the press-fit terminals 167 thereof are respectively held by the two communication grooves 142 of the insulating portion 143 of the holding plate 133 so that the press-fit terminals 167 of the signal contacts 165B, 165C, 165E and 165F project downward from the bottom end of the conductive layer portion 135 of the holding plate 133. Furthermore, the right side of the holding plate 134 (which includes the conductive layer portion 148 and the insulating portion 155) is combined with the left side of the holding plate 133 (which includes the conductive layer portion 135 and the insulating portion 143) to which the ground contacts 165A and 165D and the signal contacts 165B, 165C, 165E and 165F have been installed, and the four engaging projections 148A of the conductive layer portion 148 are fitted into the four engaging recesses 135A of the conductive layer portion 135, respectively. Thereupon, the upper pressure rib 153 on the right side of the conductive layer portion 148 of the contact module 132 is in press contact with the left side of the ground contact 165D while the right side of the same ground contact 165D is in press contact with the bottom surface of the associated communication recess (contact holding recess) 141 of the conductive layer portion 135. Likewise, the lower pressure rib 153 on the right side of the conductive layer portion 148 of the contact module 132 is in press contact with the left side of the ground contact 165A while the right side of the same ground contact 165A is in press contact with the bottom surface of the associated communication recess 141 of the conductive layer portion 135. Moreover, the signal contacts 165B, 165C, 165E and 165F are held between the bottom surfaces (left sides) of the communication grooves (contact holding grooves) 142 of the insulating portion 143 of the holding plate 133 and the four pressure ribs 154 on the right side of the insulating portion 155 of the holding plate 134, respectively.

Figure 29:
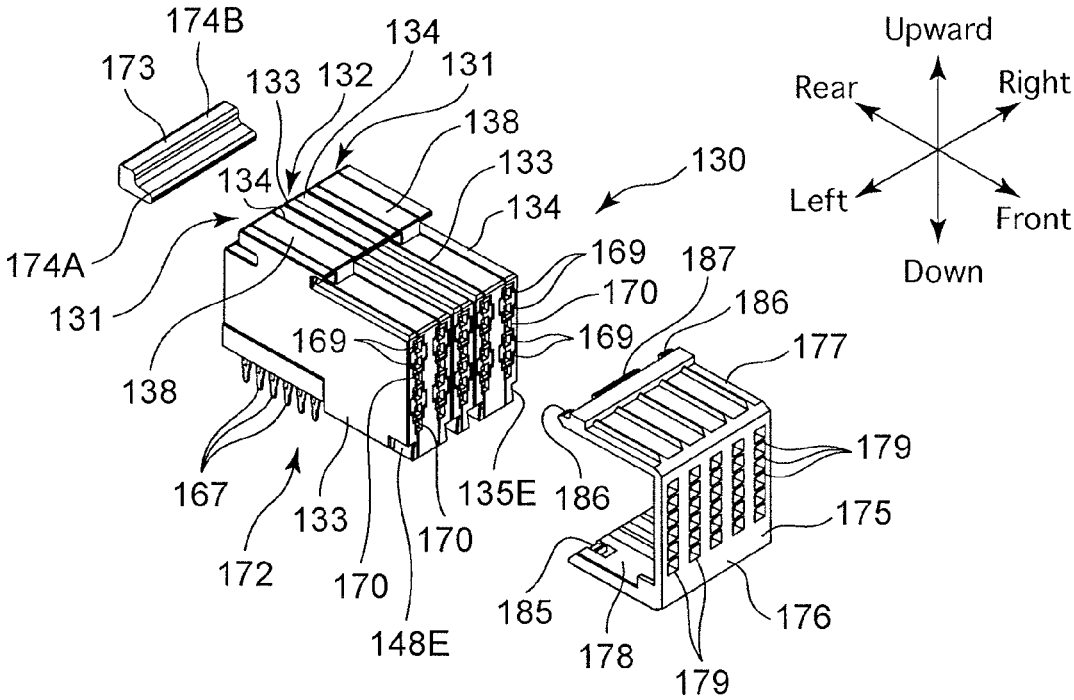
FIG. 29 is an exploded front perspective view of the receptacle of the second embodiment of the connector, which is disassembled into three pieces: a contact module group, a retainer and a connecting rod, viewed obliquely from above.
Figure 30:
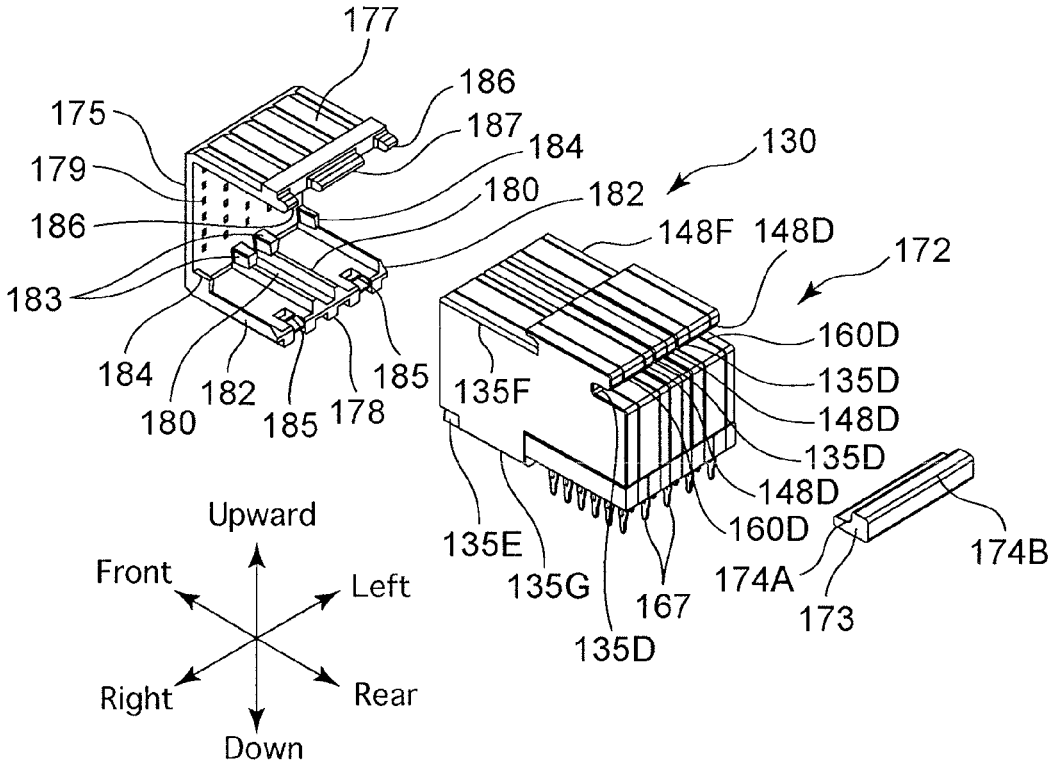
FIG. 30 is an exploded rear perspective view of the contact module group, the retainer and the connecting rod that are shown in FIG. 29, viewed obliquely from above.
Figure 31:
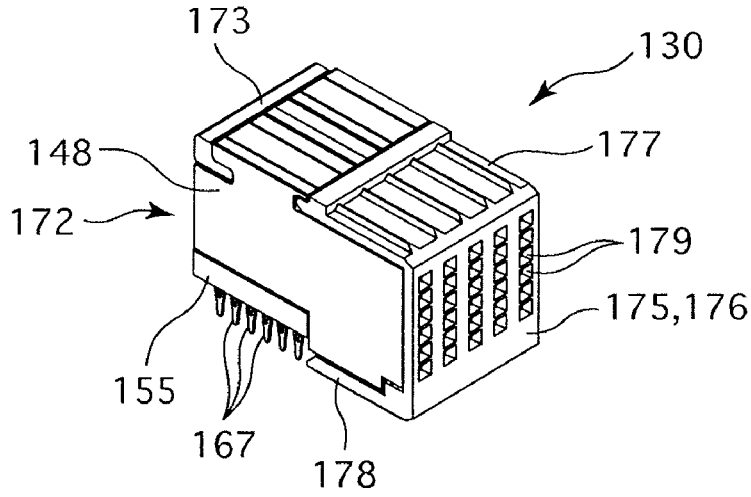
FIG. 31 is a front perspective view of the receptacle of the second embodiment of the connector, viewed obliquely from above.
Figure 32:
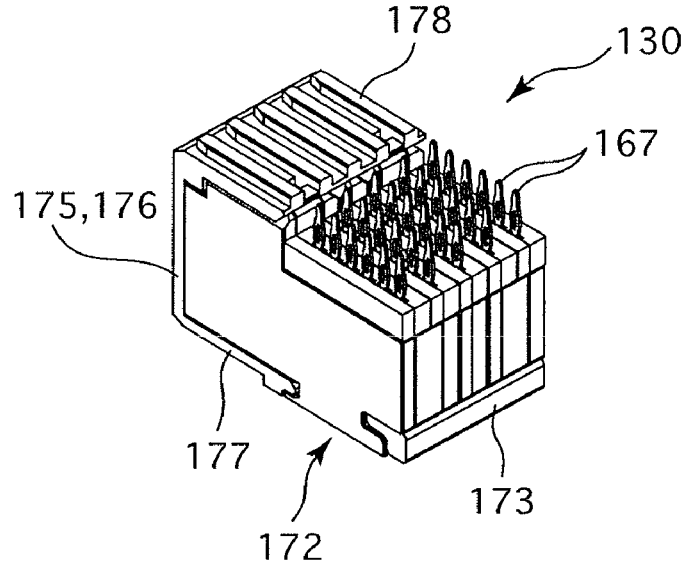
FIG. 32 is a rear perspective view of the receptacle of the second embodiment of the connector, viewed obliquely from below.

Two contact modules 131 and one contact module 132, each of which is assembled in the above described manner, are arranged in layers in the left-right direction as shown in FIGS. 29 and 30 to constitute a contact module group 172. The connecting bar 173 and the retainer 175 are the elements which prevent the two contact modules 131 and the contact module 132 from separating from each other.

The connecting bar 173 is an element with a substantially L-shaped cross section which is substantially identical in length (in the left-right direction) to the contact module group 172, and is provided with an insertion jutting portion 174A and a contacting portion 174B.

The retainer 175 is an element having a substantially U-shaped cross section. The retainer 175 is provided with a vertical side 176, an upper side 177 and a lower side 178. The upper side 177 and the lower side 178 extend rearward from the upper and lower ends of the vertical side 176, respectively.

The vertical side 176 is provided with five columns of through holes 179 arranged in the left-right direction, wherein each column includes six through holes 179. Namely, a total of thirty through holes 179 are formed in the vertical side 176.

The lower side 178 is provided, in a central part on the top surface thereof, with a pair of guide keys (right and left guide keys) 180 which extend in the forward-rearward direction. The lower side 178 is provided, on the top surface thereof at the right and left ends thereof with a pair of guide keys 182 which extend in the forward-rearward direction. As shown in FIG. 30, the lower side 178 is provided at the front ends of the pair of guide keys 180 with two engaging keys 183 which project upward. As shown in FIGS. 47 and 48, each of the two engaging keys 183 increases in width (dimensions in the left-right direction) in the direction from down to up and also increases in width in the direction from rear to front. In other words, the right and left sides of each engaging key 183 are formed as tapered surfaces. The lower side 178 is provided at the front ends of the pair of guide keys 180 with two engaging keys 184 which project upward. The inner surfaces of the engaging keys 184 are formed as beveled surfaces which approach each other in the direction from rear to front and approach each other in the bottom thereof in upward direction (toward the right on the left engaging key 184 and toward the left on the right engaging key 184). In addition, the lower side 178 is provided on the top surface thereof with a pair of lock holes (right and left lock holes) 185 in which the locking lugs 160H of the conductive layer portions 160 of the two contact modules 131 engage upon the retainer 175 being attached to the contact module group 172, which is composed of the two contact modules 131 and the contact module 132.

The upper side 177 is provided at the rear end thereof with a pair of engaging projections (right and left engaging projections) 186. The upper side 177 is provided, at the rear end thereof between the pair of engaging projections 186, with an engaging projection 187 which is greater in width than each engaging projection 186. As shown in FIG. 48, the upper side 177 is provided in a central part on the lower surface thereof with a pair of guide keys 188 which extend from the front end to the rear end of the lower surface of the upper side 177, and is further provided at the right and left ends of the lower surface of the upper side 177 with a pair of guide keys (right and left guide keys) 189 which extend from the front end to the rear end of the lower surface of the upper side 177.

The manner of combining the contact module group 172, the connecting bar 173 and the retainer 175 into one will be discussed hereinafter.

Firstly, the manner of combining the contact module group 172 and the retainer 175 will be discussed hereinafter.

In this case, firstly the retainer 175 is brought to approach the contact module group 172 as shown in FIGS. 29 and 30. Subsequently, as shown in FIG. 49, the pair of guide keys 180 of the lower side 178 are brought to be engaged in two grooves each having a substantially V-shaped cross section, respectively, wherein one of the two grooves (left groove) is formed between a lower-left chamfered edge 148G of the conductive layer portion 148 of the contact module 132 and a lower-right chamfered edge 135G of the conductive layer portion 135 of the left contact module 131, and the other groove (right groove) is formed between a lower-right chamfered edge 135G of the conductive layer portion 135 of the contact module 132 and a lower-left chamfered edge 148G of the conductive layer portion 148 of the right contact module 131. At the same time, the right and left guide keys 182 of the lower side 178 are brought to be engaged with a lower-left chamfered edge 148G of the conductive layer portion 148 of the left contact module 131 and a lower-right chamfered edge 135G of the conductive layer portion 135 of the right contact module 131, respectively. In addition, as shown in FIG. 49, the pair of guide keys 188 of the upper side 177 are brought to be engaged in two grooves each having a substantially V-shaped cross section, respectively, wherein one of the two grooves (left groove) is formed between an upper-left chamfered edge 148F of the conductive layer portion 148 of the contact module 132 and an upper-right chamfered edge 135F of the conductive layer portion 135 of the left contact module 131, and further wherein the other groove (right groove) is formed between an upper-right chamfered edge 135F of the conductive layer portion 135 of the contact module 132 and an upper-left chamfered edge 148F of the conductive layer portion 148 of the right contact module 131. At the same time, the right and left guide keys 189 of the upper side 177 are brought to be engaged with an upper-left chamfered edge 148F of the conductive layer portion 148 of the left contact module 131 and an upper-right chamfered edge 135F of the conductive layer portion 135 of the right contact module 131, respectively. Thereafter, the retainer 175 is slidingly moved rearward on the contact module group 172 along the guide keys 180, 182, 188 and 189. Upon the retainer 175 being fully moved rearward relative to the contact module group 189, the rear surface (inner surface) of the vertical side 176 comes in contact with the front surface of the contact module group 172, and thereupon, the upper side 177 covers a front half of the top surface of the contact module group 172 while the lower side 178 covers a front half of the bottom surface of the contact module group 172. Moreover, the left engaging projection 186 engages in both the front engaging groove 148C and the front engaging groove 160C of the left contact module 131, the right engaging projection 186 engages in the front engaging groove 135C of the right contact module 131, the engaging projection 187 engages a laterally-elongated groove which is formed on top of the contact module group 172 by the front engaging groove 135C of the left contact module 131, the front engaging groove 148C and the front engaging groove 135C of the contact module 132, and the front engaging groove 148C and the front engaging groove 160C of the right contact module 131. Furthermore, as shown in FIG. 48, the pair of engaging keys 183 of the lower side 178 are engaged in a groove formed between the key groove 148E of the contact module 132 and the key groove 135E of the left contact module 131 and a groove formed between the key groove 135E of the contact module 132 and the key groove 148E of the right contact module 131, respectively. Furthermore, as shown in FIG. 48, the pair of engaging keys 184 are engaged in the key groove 148E of the left contact module 131 and the key groove 135E of the right contact module 131, respectively. Accordingly, each contact module 131 and 132 is held between the adjacent engaging keys 183 and 184. Furthermore, the locking lugs 160H of the conductive layer portions 160 of the two contact modules 131 engage in the pair of lock holes 185 of the lower side 178, respectively (this state of engagement between the locking lugs 160H and the pair of lock holes 185 is not shown in the drawings).

The contact module group 172 and the retainer 175 are combined into one integral module in the above described manner.

Next the manner of combining the contact module group 172 and the connecting bar 173 will be discussed hereinafter.

Upon completion of the contact module group 172, the rear engaging groove 135D of each conductive layer portion 135, the rear engaging groove 148D of each conductive layer portion 148D and the rear engaging groove 160D of each conductive layer portion 160 are aligned in the left-right direction to form a laterally-elongated engaging groove (see FIGS. 30, etc.). The connecting bar 173 is fixed to the contact module 172 to be integral therewith by fitting the insertion jutting portion 174A into this laterally-elongated engaging groove while making the front surface of the contacting portion 174B contact with the rear end surface of the top end of the contact module group 172 (see FIG. 44).

After the completion of the receptacle 130 by combining the contact module group 172, the connecting bar 173 and the retainer 175 into one integral module in the above described manner, the press-fit terminals 167 of the ground contacts 165A and 165D and the signal contacts 165B, 165C, 165E and 165F, which project downward from a bottom surface of the receptacle 130, are driven (press-fitted) into through holes (not shown) formed in a circuit board CB1, respectively (see FIGS. 27 and 28). Thereupon, the press-fit terminals 167 of the ground contacts 165A and 165D are electrically connected to a ground pattern on the circuit board CB1 while the press-fit terminals 167 of the signal contacts 165B, 165C, 165E and 165F are electrically connected to a circuit pattern on the circuit board CB1.

Next, the plug 120 will be discussed with reference mainly to FIGS. 50 through 56.

The plug 120 is provided with two contact modules 121, a contact module 122, a connecting bar 173 and a retainer 110 as relatively large elements of the plug 120.

Each contact module 121 is identical in structure to each contact module 131 except that each contact module 121 is provided with four ground contact pins 125A and 125D and eight signal contact pins 125B, 125C, 125E and 125F, whereas each contact module 131 is provided with the four ground contacts 165A and 165D and the eight signal contacts 165B, 165C, 165E and 165F.

Figure 51:
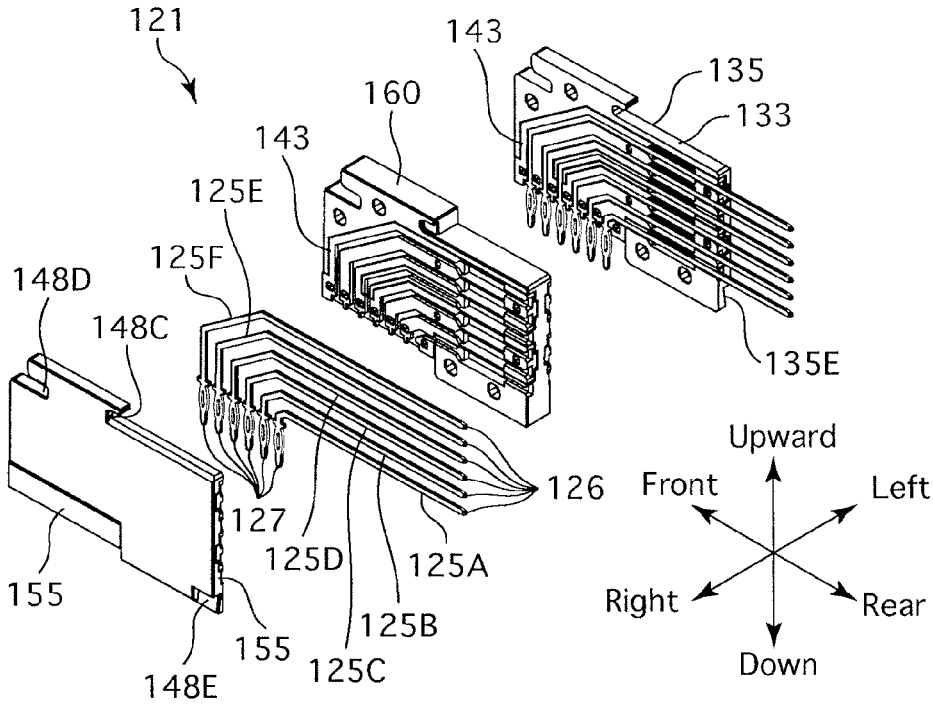
FIG. 51 is an exploded perspective view of each side contact module shown in FIG. 50.
Figure 52:
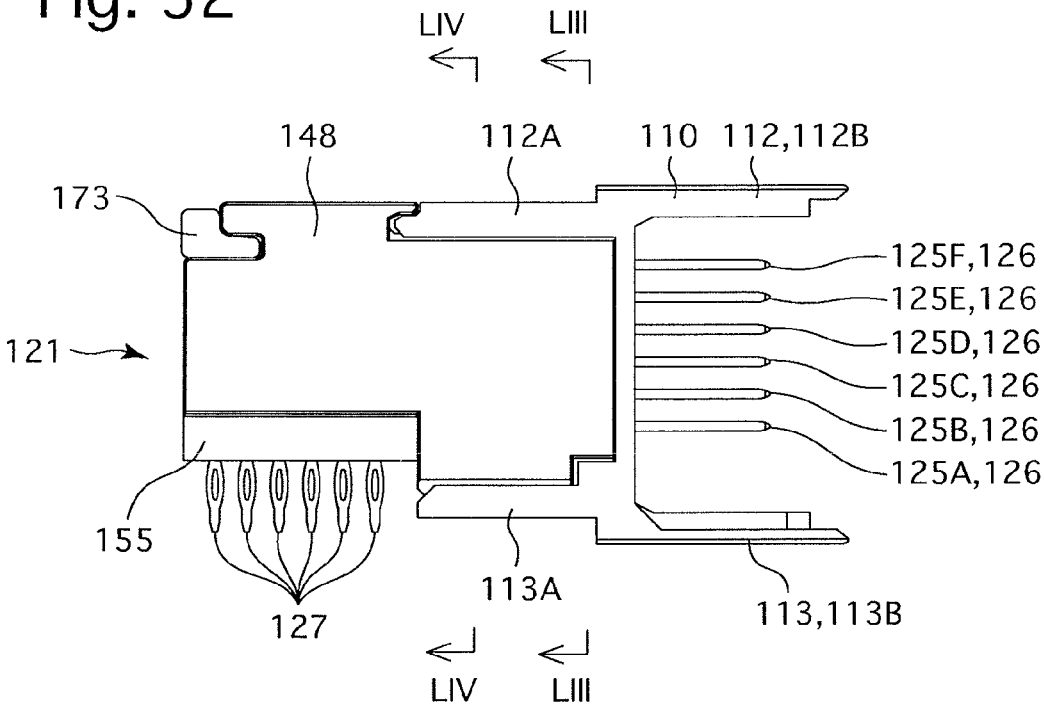
FIG. 52 is a side elevational view of the plug shown in FIG. 51.
Figure 53:
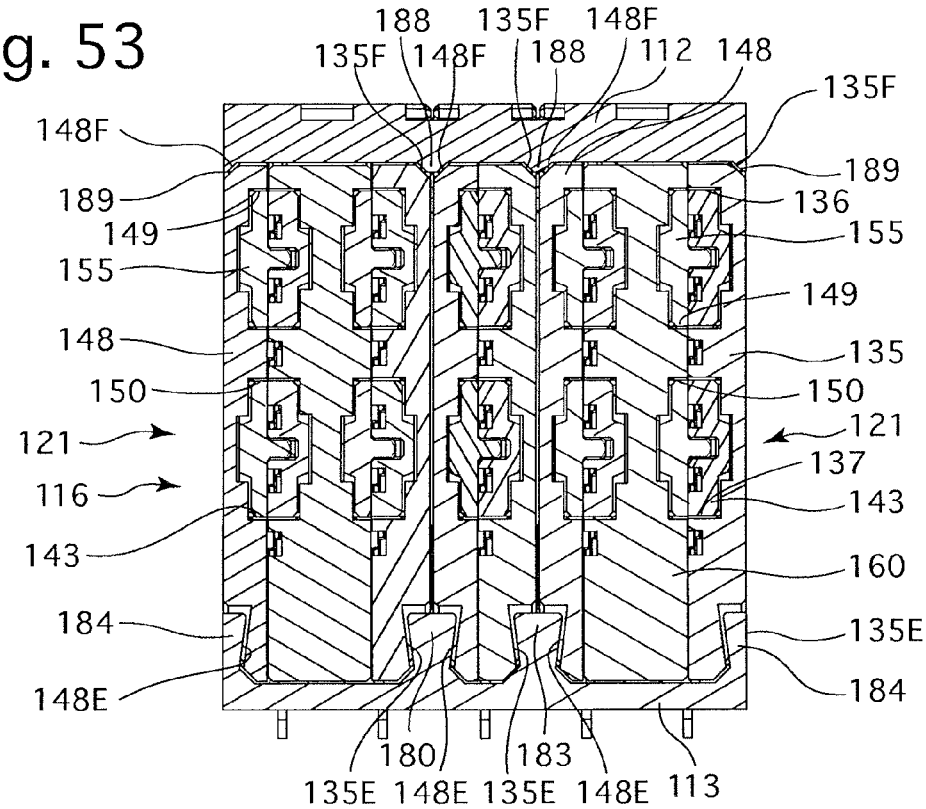
FIG. 53 is a cross sectional view taken along the LIII-LIII line shown in FIG. 52, viewed in the direction of the appended arrows.
Figure 54:
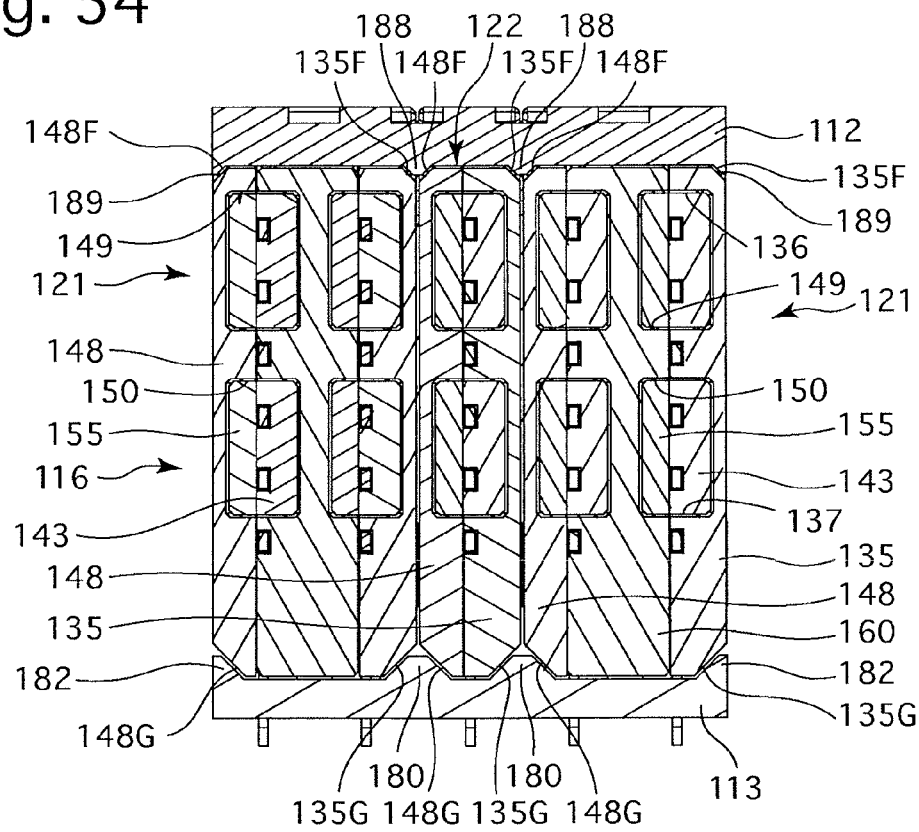
FIG. 54 is a cross sectional view taken along the LIV-LIV line shown in FIG. 52, viewed in the direction of the appended arrows.
Figure 55:
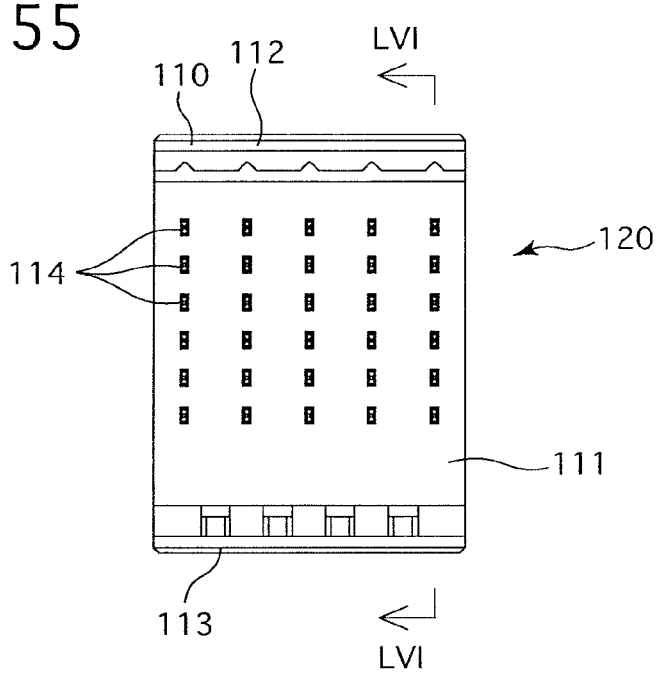
FIG. 55 is a rear elevational view of the plug of the second embodiment of the connector.

As shown in FIG. 51, etc., the ground contact pins 125A and 125D and the signal contact pins 125B, 125C, 125E and 125F of each contact module 121 are each provided with a terminal contact 126 and a press-fit terminal 127 and greater in length in the forward-rearward direction than the ground contacts 165A and 165D and the signal contacts 165B, 165C, 165E and 165F, respectively. The terminal contacts 126 of the ground contact pins 125A and 125D and the signal contact pins 125B, 125C, 125E and 125F of each contact module 121 are connected with the bifurcated resilient portions 166 of the ground contacts 165A and 165D and the signal contacts 165B, 165C, 165E and 165F of the associated contact module 131, respectively, when the plug 120 and the receptacle 130 are connected to each other. The ground contact pins 125A and 125D and the signal contact pins 125B, 125C, 125E and 125F are stamp molded out of metal. More specifically, to make each contact 125A through 125F, a base material (e.g., phosphor bronze, beryllium copper, titanium copper, stainless steel, or Corson-copper alloy) is coated firstly with base plating (e.g., nickel (Ni) plating) and subsequently with finish plating (e.g., gold(Au) plating, tin(Sn)-copper(Cu) plating, or tin(Sn)-lead(Pb) plating).

The manner of assembling each contact module 121 is the same as the manner of assembling each contact module 131.

The contact module 122 is identical in structure to the contact module 132 except that the contact module 122 is provided with four ground contact pins 125A and 125D and eight signal contact pins 125B, 125C, 125E and 125F, whereas the contact module 132 is provided with four ground contacts 165A and 165D and eight signal contacts 165B, 165C, 165E and 165F.

The contact module 122 is assembled in the same manner as the contact module 132.

The retainer 110 is an element having a substantially H-shaped cross section. The retainer 110 is provided with a vertical side 111, an upper side 112 and a lower side 113. The upper side 112 extends both forward and rearward from the upper end of the vertical side 111. Likewise, the lower side 113 extends both forward and rearward from the lower end of the vertical side 111. The upper side 112 is provided with a contact-module retaining portion 112A and a receptacle retaining portion 112B which extend forward and rearward, respectively. Likewise, the lower side 113 is provided with a contact-module retaining portion 113A and a receptacle retaining portion 113B which extend forward and rearward, respectively.

The vertical side 111 is provided with five columns of through holes 114 arranged in the left-right direction, wherein each column includes six through holes 114. Namely, a total of thirty through holes 114 are formed in the vertical side 111. The contact-module retaining portion 113A is provided with a pair of guide keys 180, a pair of guide keys 182, two engaging keys 183, two engaging keys 184 and a pair of lock holes 185 which are all formed in the same manner as those of the retainer 175 (see FIG. 50).

Figure 56:
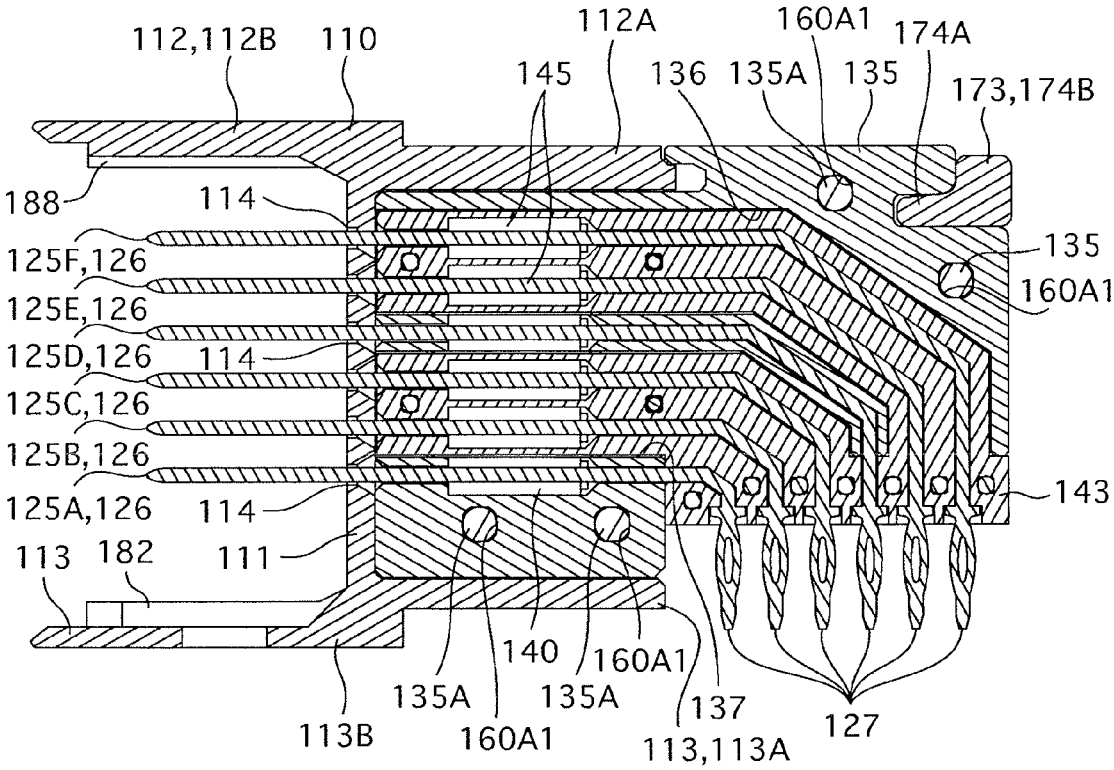
FIG. 56 is a cross sectional view taken along the LVI-LVI line shown in FIG. 55, viewed in the direction of the appended arrows.

The plug 120 that has the above described structure is completed by mounting the retainer 110 and the connecting bar 173 to the contact module group 116 in the same manner as the receptacle 131 after the completion of the contact module group 116 by combining the two contact module 121 and the contact module 122 into one. Upon the vertical side 111 being mounted to the contact module group 116, the terminal contacts 126 of the ground contact pins 125A and 125D and the signal contact pins 125B, 125C, 125E and 125F project rearward from the vertical side 111 through the corresponding through holes 114 of the vertical side 111, respectively, as shown in FIG. 56.

Upon the press-fit terminals 127 of the ground contact pins 125A and 125D being driven (press-fitted) into through holes (not shown) formed in a circuit board CB2 (see FIGS. 27 and 28), the press-fit terminals 127 of the ground contact pins 125A and 125D are electrically connected to a ground pattern on the circuit board CB2 while the press-fit terminals 127 of the signal contact pins 125B, 125C, 125E and 125F are electrically connected to a circuit pattern on the circuit board CB2.

When the receptacle 130 and the plug 120 that have the above described structures are connected to each other so that the receptacle retaining portion 112B of the retainer 110 covers the upper surface of the upper side 177 of the retainer 175 and so that the receptacle retaining portion 113B of the retainer 110 covers the bottom surface of the lower side 178 of the retainer 175 as shown in FIG. 28, the terminal contacts 126 of the ground contact pins 125A and 125D and the signal contact pins 125B, 125C, 125E and 125F of each contact module 121 firstly pass through the corresponding through holes 179 and subsequently engage in the corresponding engaging holes 169 and 170, respectively, thus entering inside of the receptacle 130 (specifically, entering the inside of the associated contact module 131 or 132). Thereupon, each terminal contact 126 enters the bifurcated resilient portion 166 of the associated ground or signal contact 165A, 165B, 165C, 165D, 165E or 165F while resiliently deforming the same bifurcated resilient portion 166 to establish connection therewith, respectively.

Therefore, the ground contact pins 125A and 125D of the plug 120 are electrically connected to a ground pattern formed on the circuit board CB1 on the receptacle 130 side and the ground contacts 165A and 165D of the receptacle 130 are electrically connected to a ground pattern formed on the circuit board CB2 on the plug 120 side, while the signal contact pins 125B, 125C, 125E and 125F of the plug 120 are electrically connected to a circuit pattern formed on the circuit board CB1 on the receptacle 130 side and the signal contacts 165B, 165C, 165E and 165F of the receptacle 130 are electrically connected to a circuit pattern formed on the circuit board CB2 on the plug 120 side.

The above illustrated second embodiment of the connector 100 can obtain effects similar to those obtained in the first embodiment of the connector 10 because the basic structure of the second embodiment of the connector 100 is the same as the basic structure of the first embodiment of the connector 10.

In addition, since two sets of contacts 165A through 165F are sandwiched between three holding plates (133, 134 and 138) while two sets of contact pins 125A through 125F are sandwiched between three holding plates (133, 134 and 138) in each of the contact modules 121 and 131 of the second embodiment of the connector 100, each of the contact modules 121 and 131 of the second embodiment of the connector 100 have the following advantages with respect to each contact module 31 of the first embodiment of the connector 10, in which a set of contacts (65A through 65F) are sandwiched between two holding plates (33 and 34).

First of all, for instance, a total of four holding plates are required to sandwich two sets of contacts in the first embodiment of the connector, whereas a total of three holding plates can do the same in the second embodiment of the connector. Namely, according to the second embodiment of the connector, since the number of components, the number of assembly procedures, and the time required for the plating process performed on each component can be reduced, it is possible to achieve an improvement in productivity and a reduction in production cost.

Furthermore, since each of the contact modules 121 and 131 is composed of the two holding plates 133 and 134 and the holding plate 138 that is mechanically stronger and greater in thickness than either of the two holding plates 133 and 134, the mechanical strength of each contact module and the contact module group itself in the second embodiment of the connector can be made higher than that in the first embodiment of the contact module 31.

Moreover, more than one plug connector 120 or more than one receptacle 130 can be arranged in the left-right direction with all the contacts (125A through 125F and 165A through 165F) being positioned at regular intervals in the left-right direction because neither of the retainers 110 and 175 has side walls (either a left side wall or a right side wall) and because, among the three holding plates 133, 134 and 138 of the two contact modules 121 of the plug 120 that respectively include the left side portion and the right side portion of the plug 120, the two conductive layer portions 135 and 148 of each contact module 121 that respectively include the left side portion and the right side portion of each contact module 121 are each designed to be smaller in wall thickness than a half the wall thickness of the conductive layer portion 160, and further because, among the three holding plates 133, 134 and 138 of the two contact modules 131 of the receptacle 130 that respectively include the left side portion and the right side portion of the receptacle 130, the two conductive layer portions 135 and 148 of each contact module 131 that respectively comprise the left side portion and the right side portion of each contact module 131 are each designed to be smaller in wall thickness than a half the wall thickness of the conductive layer portion 160.

Furthermore, each contact pin (125A through 125F) of the plug 120 can be easily held at a predetermined position (i.e., all the contact pins 125A through 125F of the plug 120 can be placed in proper alignment) since the through holes 114 are formed in the vertical plate portion 111 of the retainer 110. Likewise, since the through holes 179 are formed in the vertical side 176 of the retainer 175, each contact pin (165A through 165F) of the receptacle 130 can be easily lead into the associated contact module 131 or 132 of the receptacle 130 (i.e., the ground contact pins 165A and 165D and the signal contact pins 165B, 165C, 15E and 165F of the receptacle 130 can be easily made contact with the ground contacts 125A and 125D and the signal contacts 125B, 125C, 125E and 125F of the plug 120, respectively).

Although the present invention has been described based on the above illustrated first and second embodiments of the connectors, the present invention is not limited solely to these embodiments; making various modifications to these embodiments is possible.

Figure 57:
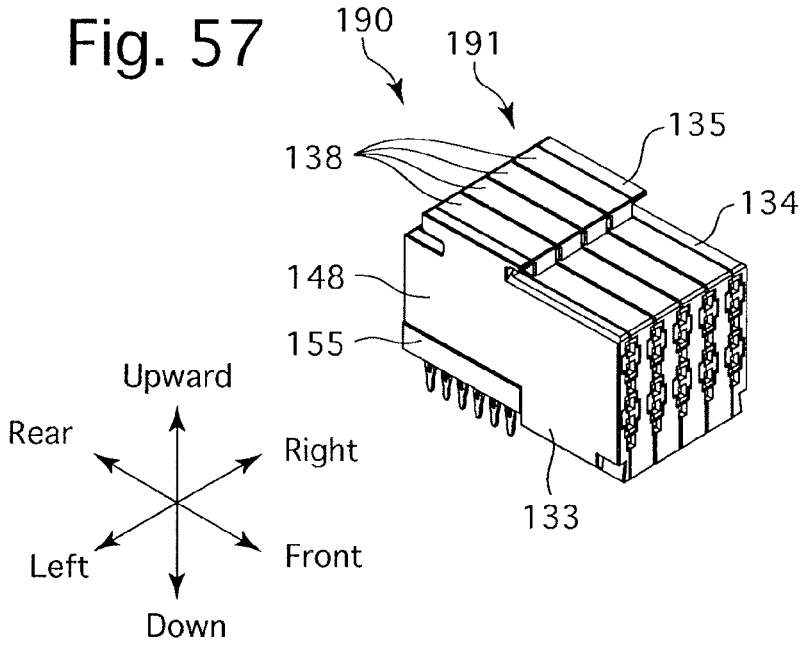
FIG. 57 is a perspective view of a contact module group in a modified embodiment of the receptacle, viewed obliquely from the upper left side.
Figure 58:
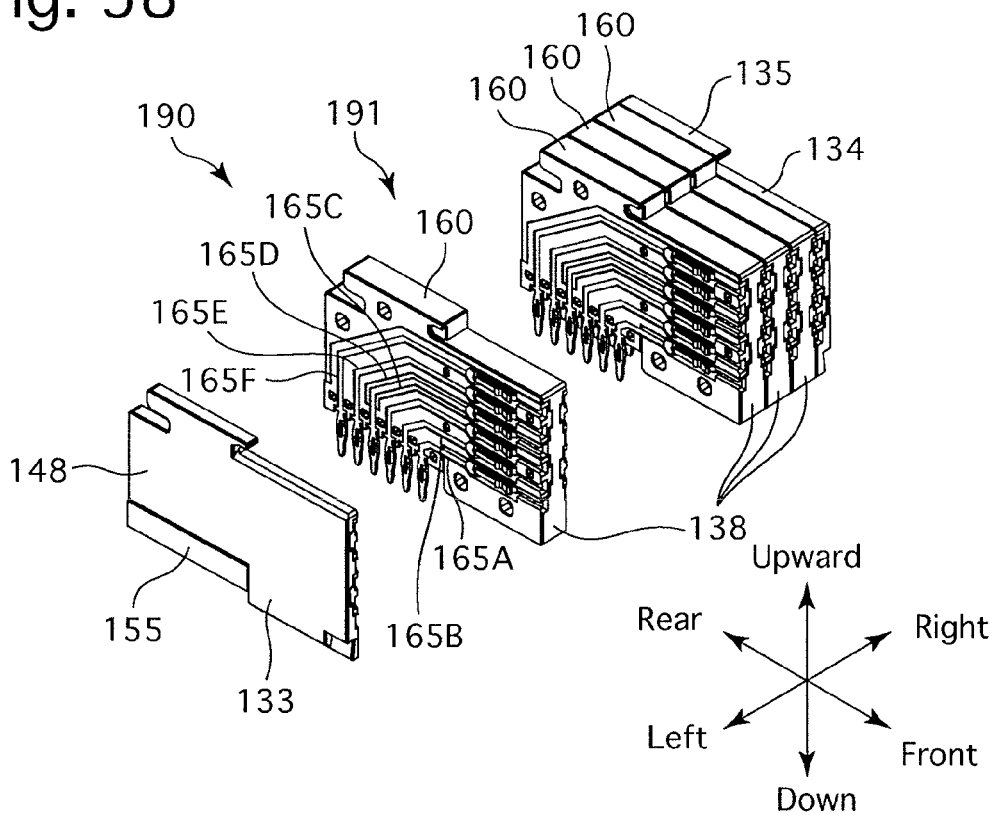
FIG. 58 is an exploded perspective view of the contact module group shown in FIG. 57, showing a state where the contact module group is partly disassembled.

For instance, although each contact module 31 includes the two holding plates (a pair of holding plates) 33 and 34 in the first embodiment of the connector and each of the contact modules 121 and 131 includes the three holding plates 133, 134 and 138 in the second embodiment of the connector, it is possible that each contact module include more than three holding plates so that contacts or contact pins are held between adjacent holding plates. FIGS. 57 and 58 show an example of this modified embodiment of the receptacle. A contact module group 191 of this modified embodiment of a receptacle 190 is composed of six holding plates (four holding plates 138, a left holding plate 133 and a right holding plate 134) and five sets of contacts 165A through 165F, and each set of contacts 165A through 165F is held between the adjacent holding plates.

Figure 59:
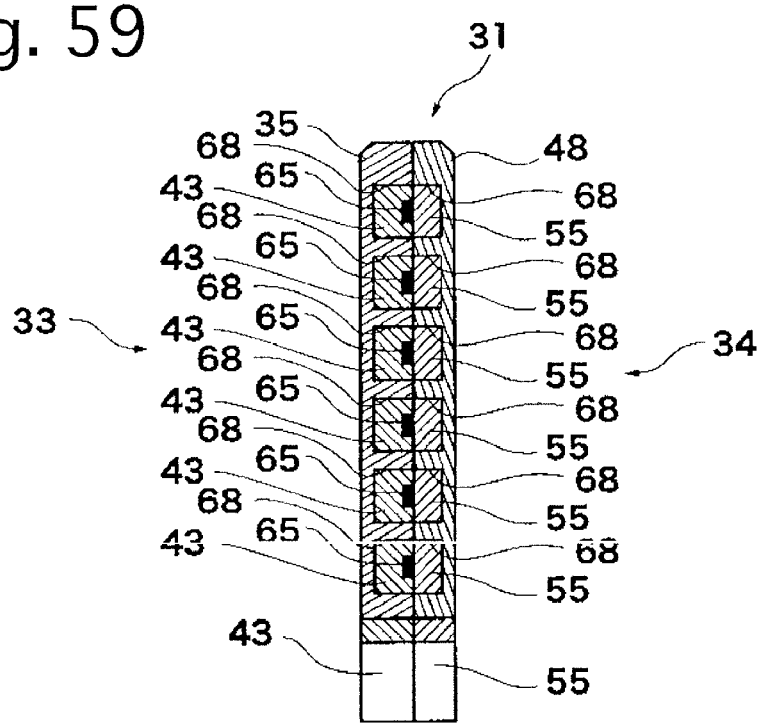
FIG. 59 is a view similar to that of FIG. 10, showing a modified embodiment of each contact module of the receptacle in the first embodiment of the connector.
Figure 60:
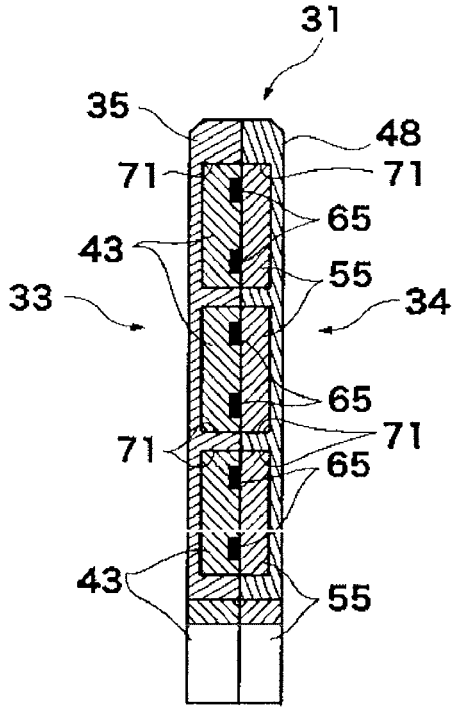
FIG. 60 is a view similar to that of FIG. 10, showing another modified embodiment of each contact module of the receptacle in the first embodiment of the connector.

Additionally, all the contacts (or contact pins) of each of the receptacle 30, the plug 120 and the receptacle 130 can consist of only signal contacts (or signal contact pins) as shown in FIGS. 59 and 60 though the contacts of each of the receptacle 30, the plug 120 and the receptacle 130 consist of two types of contacts (the ground contacts 65A and 65 and the signal contacts 65B, 65C, 65E and 65F, or the ground contact pins 125A and 125D and the signal contact pins 125B, 125C, 125E and 125F, or the ground contacts 165A and 165D and the signal contacts 165B, 165C, 165E and 165F).

FIG. 59 shows a modified embodiment of each contact module 31 of the receptacle 30 of the first embodiment of the connector, wherein each contact module 31 is modified for use in single-ended signaling. In this modified embodiment, the conductive layer portions 35 and 48 are provided on the laterally-opposed surfaces thereof with a total of six insulation recesses 68 and corresponding six insulation recesses 68, respectively. In addition, the conductive layer portion 35 is provided in the six insulation recesses 68 thereof with six insulating portions 43 which are fitted into the six insulation recesses 68 so as to occupy the six insulation recesses 68, respectively, and the conductive layer portion 48 is provided in the six insulation recesses 68 thereof with six insulating portions 55 which are fitted into the six insulation recesses 68 so as to occupy the six insulation recesses 68, respectively. A signal contact 65 is held between each insulating portion 43 and the associated insulating portion 55.

FIG. 60 shows another modified embodiment of each contact module 31 of the receptacle 30 of the first embodiment of the connector, wherein each contact module 31 is modified for use in differential signaling. In this modified embodiment, the conductive layer portions 35 and 48 are provided on the laterally-opposed surfaces thereof with a total of three insulation recesses 71 and corresponding three insulation recesses 71, respectively. In addition, the conductive layer portion 35 is provided in the three insulation recesses 71 thereof with three insulating portions 43 which are fitted into the three insulation recesses 71 so as to occupy the three insulation recesses 71, respectively, and the conductive layer portion 48 is provided in the three insulation recesses 71 thereof with three insulating portions 55 which are fitted into the three insulation recesses 71 so as to occupy the three insulation recesses 71, respectively. Two signal contacts 65 are held between each insulating portion 43 and the associated insulating portion 55.

Although not shown in the drawings, the number of contacts or contact pins held between the conductive layer portion and the conductive layer portion of the adjacent holding plates 33 and 34 can be any number so long as the number is at least one. In addition, it is possible that contact holding grooves and corresponding contact holding grooves be formed on two conductive layer portions which face each other, respectively. Additionally, it is also possible that contact holding grooves and no contact holding grooves be formed on two conductive layer portions which face each other, respectively.

In addition, in the first embodiment of the connector, it is possible to combine all the ten contact modules 31 into one integral module by a retainer similar to the retainer 175 of the second embodiment of the connector instead of combining all the ten contact modules 31 into one integral by the retainer 75.

Figure 61:
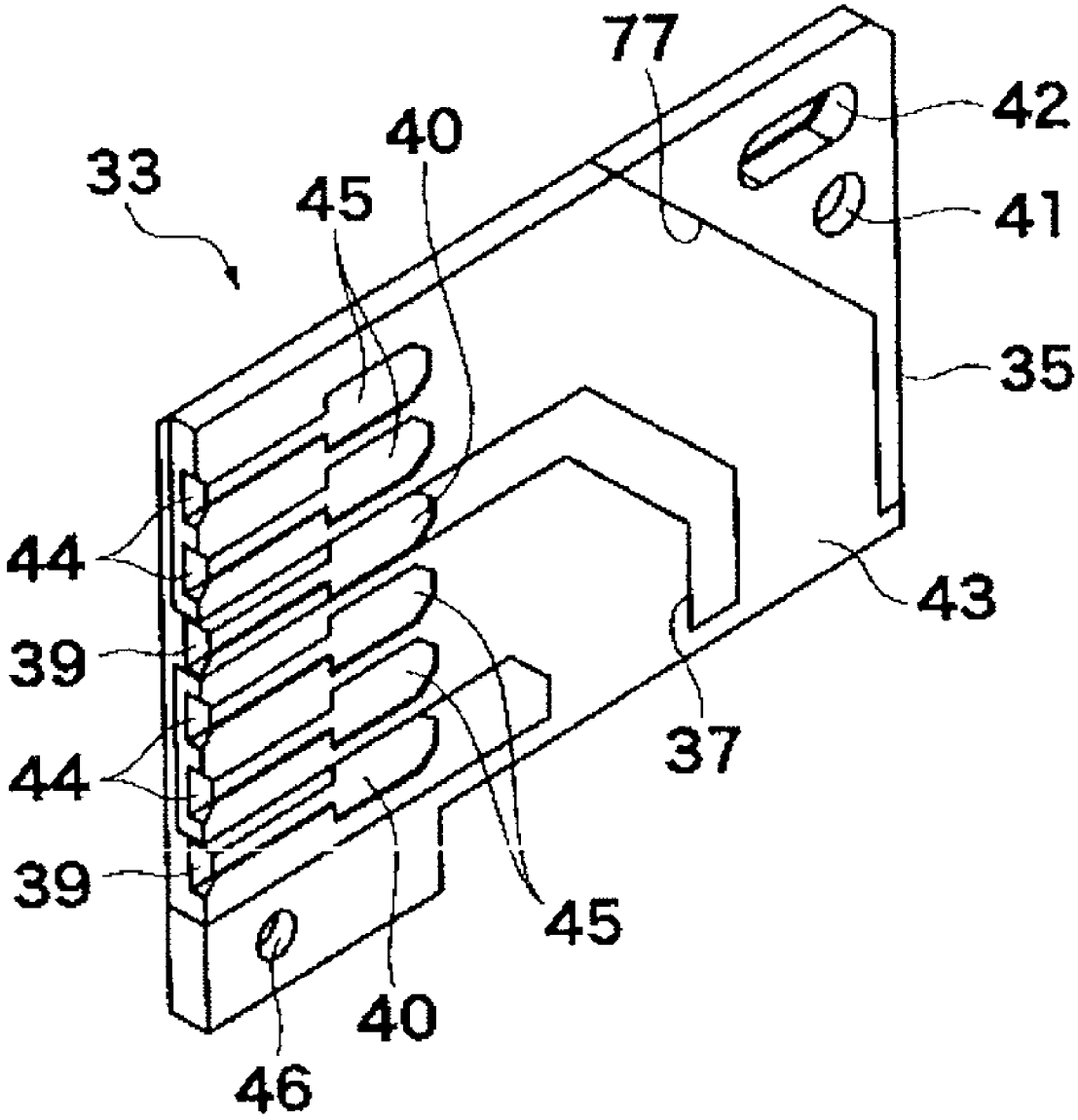
FIG. 61 is a view similar to that of FIG. 12, showing one of the two holding plates of another modified embodiment of each contact module of the receptacle in the first embodiment of the connector.

In addition, although the side edges (upper and lower side edges in the illustrated first embodiment of the connector) of each insulation recess (36, 37, 49 and 50) in either of the two holding plates 33 and 34, which extend parallel to the associated signal contact 65B, 65C, 65E or 65F, are covered by the associated conductive layer portion 35 or 48 and also the side edges (upper and lower side edges in the illustrated second embodiment of the connector) of each insulation recess (136, 137, 149 and 150) in each of the three holding plates 133, 134 and 138, which extend parallel to the associated signal contact 165B, 165C, 165E or 165F, are covered by the associated conductive layer portion 135, 148 or 160, the side edges of each insulation recess (36, 37, 49 and 50) in either of the two holding plates 33 and 34 can be shaped so as only to be partly covered by the associated conductive layer portion 35 or 48, and also the side edges of each insulation recess (136, 137, 149 and 150) in each of the three holding plates 133, 134 and 138 can be shaped so as only to be partly covered by the associated conductive layer portion 135, 148 or 160. FIG. 61 shows an example of this modified embodiment (one of the two holding plates of a modified embodiment of each contact module of the receptacle in the first embodiment of the connector). In this embodiment, the conductive layer portion 35 of the holding plate 33 is provided on the inner surface thereof with two insulation recesses 77 and 37 which correspond to the two insulation recesses 36 and 37 of the holding plate 33 shown in FIGS. 12 and 13, respectively, and the insulation recess 77 (the upper portion thereof) is not partly covered by the conductive layer portion 35.

In addition, in the first embodiment of the connector, it is possible that the holding plate 33 be made by forming the conductive layer portion 35 on a synthetic-resin-made member, subsequently making the insulating portion 43 as a member separated from the conductive layer portion 35 (as a member independent of the conductive layer portion 35), and subsequently fitting the insulating portion 43 into the conductive layer portion 35, and that the holding plate 34 be made by forming the conductive layer portion 48 on a synthetic-resin-made member, subsequently making the insulating portion 55 as a member separated from the conductive layer portion 48 (as a member independent of the conductive layer portion 48), and subsequently fitting the insulating portion 55 into the conductive layer portion 48. Additionally, in the second embodiment of the connector, it is possible that each conductive layer portion (135, 148 and 160) be formed on a synthetic-resin-made member, and then the associated insulating portion (143 or 155) be molded integrally with this conductive layer portion with the use of molding dies (by so-called two-color forming).

In addition, it is possible that firstly the conductive layer portion (35, 48, 135, 148 or 160) be formed over the surface of a synthetic-resin-made member, subsequently a portion of this conductive layer portion (plating) on which the insulating portion (43, 55, 143 or 155) is to be formed be removed, and subsequently the insulating portion (43, 55, 143 or 155) be formed on this removed portion.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A receptacle comprising a plurality of contact modules, each of which includes a plurality of contacts, one of common ends of said contacts being connected to a corresponding plurality of contact pins of a plug, respectively, when said receptacle and said plug are connected to each other, and the other of said common ends of said contacts being connected to a circuit board, wherein each of said plurality of contact modules includes a plurality of holding plates arranged in a direction of thickness of said each contact module, wherein at least one conductive layer and at least one insulating portion are formed on each of opposed surfaces of adjacent holding plates of said plurality of holding plates, and wherein at least one of said plurality of contacts is held between said insulating portions that are formed on said opposed surfaces of said adjacent holding plates, respectively.

2. The receptacle according to claim 1, wherein said opposed surfaces of said adjacent holding plates comprise first opening recesses and second opening recesses, respectively, said first opening recesses and second opening recesses being open at common end surfaces of said adjacent holding plates, respectively, wherein engaging holes, through which an outside and an inside of said each contact module are communicatively connected to each other, is formed by said first opening recesses and said second opening recesses upon said adjacent holding plates being joined to each other, and wherein electrical continuity is established between said contacts of said each contact module and said contact pins of said plug upon said contact pins of said plug being inserted into said each contact module through said engaging holes, respectively.

3. The receptacle according to claim 1, wherein at least one of said adjacent holding plates comprises a plurality of contact holding grooves formed on said insulating portion, said contacts being engaged in said contact holding grooves to be held thereby, respectively.

4. The receptacle according to claim 1, wherein some of said contacts are held between said insulating portions formed on said adjacent holding plates, and wherein the remainder of said plurality of contacts are held between said conductive layers formed on said adjacent holding plates.

5. The receptacle according to claim 1, wherein a plurality of said insulating portions are formed on each of said opposed surfaces of said adjacent holding plates with said conductive layer on said each of said opposed surfaces of said adjacent holding plates being provided on opposite sides of each of said plurality of insulating portions; and wherein only one of said contacts is held between each of said insulating portions that are formed on said opposed surfaces of said adjacent holding plates, respectively.

6. The receptacle according to claim 1, wherein each of said plurality of contact modules comprises two adjacent holding plates of said plurality of holding plates.

7. The receptacle according to claim 1, wherein each of said plurality of contact modules comprises at least three holding plates of said plurality of holding plates.

8. The receptacle according to claim 1, wherein said conductive layer is formed entirely over each of said opposed surfaces of said adjacent holding plates of said plurality of holding plates, and wherein said insulating portion is formed partly on said conductive layer.

9. The receptacle according to claim 8, wherein said conductive layer covers a pair of side edges of each of said insulating portions positioned on both sides of said plurality of contacts.

10. The receptacle according to claim 1, wherein a continuous conductive layer is formed on all surfaces of said adjacent holding plates other than said opposed surfaces of said adjacent holding plates.

11. The receptacle according to claim 1, wherein each of said plurality of holding plates comprises:

a conductive layer portion including a resin-made substrate on which said conductive layer is plated, and at least one insulation recess formed on a surface which faces the other of said adjacent holding plates; and said insulating portion made of a resin material and is provided in said insulation recesses so as to occupy said insulation recesses.

12. The receptacle according to claim 1, further comprising a retainer which is attached to a contact module group formed by said plurality of contact modules arranged in layers to combine said plurality of contact modules into one integral module.

13. A plug including a plurality of contact modules each of which includes a plurality of contact pins, one of common ends of said contact pins being inserted into a receptacle to be connected to a corresponding plurality of contacts included in said receptacle, respectively, when said plug and said receptacle are connected to each other, and the other of said commons ends of said plurality of contact pins being connected to a circuit board, wherein each of said contact modules includes a plurality of holding plates arranged in a direction of thickness of said each contact module, wherein at least one conductive layer and at least one insulating portion are formed on each of opposed surfaces of adjacent holding plates of said holding plates, and wherein at least one of said contact pins is held between said insulating portions that are formed on said opposed surfaces of said adjacent holding plates, respectively.

14. The plug according to claim 13, wherein said opposed surfaces of said adjacent holding plates comprise first opening recesses and second opening recesses, respectively, said first opening recesses and said second opening recesses being open at common end surfaces of said adjacent holding plates, respectively, wherein engaging holes through which outside and inside of said each contact module are communicatively connected to each other are formed by said first opening recesses and said second opening recesses upon said adjacent holding plates being joined to each other, and wherein said contact pins project to the outside of said each contact module through said engaging holes.

15. The plug according to claim 13, wherein each of said plurality of contact modules comprises two adjacent holding plates of said plurality of holding plates.

16. The plug according to claim 13, wherein each of said plurality of contact modules comprises at least three holding plates of said plurality of holding plates.

17. The plug according to claim 13, wherein said conductive layer is formed entirely over each of said opposed surfaces of said adjacent holding plates of said plurality of holding plates, and wherein said insulating portion is formed partly on said conductive layer.

18. The plug according to claim 17, wherein said conductive layer covers a pair of side edges of each of said insulating portions positioned on both sides of said plurality of contacts.

19. The plug according to claim 13, wherein a continuous conductive layer is formed on all surfaces of said adjacent holding plates other than said opposed surfaces of said adjacent holding plates.

20. The plug according to claim 13, wherein each of said plurality of holding plates comprises:

a conductive layer portion including a resin-made substrate on which said conductive layer is plated, and at least one insulation recess formed on a surface which faces the other of said adjacent holding plates; and said insulating portion made of a resin material and is provided in said insulation recesses so as to occupy said insulation recesses.

21. The plug according to claim 13, further comprising a retainer which is attached to a contact module group formed by said plurality of contact modules arranged in layers to combine said plurality of contact modules into one integral module.

22. A method of making a receptacle with a plurality of contact modules, each of which includes a plurality of contacts, one of common ends of said contacts being connected to a corresponding plurality of contact pins of a plug, respectively, when said receptacle and said plug are connected to each other, and the other of said common ends of said contacts being connected to a circuit board, said method comprising:

forming a plurality of conductive layer portions which each include a resin-made substrate which has been plated;

forming a plurality of holding plates by putting a resin-made insulating portion on each of said conductive layer portions so as to occupy a part of a surface thereof;

forming said contact modules by arranging said holding plates in a direction of thickness of said each contact module and by joining opposed surfaces of adjacent holding plates thereof, on which said insulating resin-made insulating portion is placed, to each other so that at least one of said contacts is held between said insulating portions that are formed on said opposed surfaces of said adjacent holding plates; and connecting said contact modules into one integral module.

23. The method of making a receptacle according to claim 22, wherein said connecting of said contact modules into one integral module comprises:

arranging said plurality of contact modules in layers to form a contact module group; and attaching a retainer to said contact module group.

24. A method of making a plug with a plurality of contact modules each of which includes a plurality of contact pins, one of common ends of said contact pins being inserted into a receptacle to be connected to a corresponding plurality of contacts included in said receptacle, respectively, when said plug and said receptacle are connected to each other, and the other of said common ends of said plurality of contact pins being connected to a circuit board, said method comprising:

forming a plurality of conductive layer portions which each include a resin-made substrate which has been plated, respectively;

forming a plurality of holding plates by putting a resin-made insulating portion on each of said conductive layer portions so as to occupy a part of a surface thereof;

forming said contact modules by arranging said holding plates in a direction of thickness of said each contact module and by joining opposed surfaces of adjacent holding plates thereof, on which said insulating resin-made insulating portion is placed, to each other so that at least one of said contact pins is held between said insulating portions that are formed on said opposed surfaces of said adjacent holding plates; and connecting said contact modules into one integral module.

25. The method of making a plug according to claim 24, wherein said connecting of said contact modules into one integral module comprises:

arranging said plurality of contact modules in layers to form a contact module group; and attaching a retainer to said contact module group.

* * * * *